US011787220B2

(12) United States Patent
Chassot et al.

(10) Patent No.: US 11,787,220 B2
(45) Date of Patent: Oct. 17, 2023

(54) SECURITY ELEMENT, SECURITY DOCUMENT INCLUDING A SECURITY ELEMENT, AND DEVICE AND METHOD FOR PRODUCING A SECURITY ELEMENT

(71) Applicant: KOENIG & BAUER AG, Würzburg (DE)

(72) Inventors: Daniel Chassot, Bienne (CH); Sébastien Dufey, St-Prex (CH); Giovanni Galuffo, Lausanne (CH); Hervé Guillerey, La Conversions (CH)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/771,547

(22) PCT Filed: Jan. 12, 2021

(86) PCT No.: PCT/EP2021/050456

§ 371 (c)(1),
(2) Date: Apr. 25, 2022

(87) PCT Pub. No.: WO2021/180374

PCT Pub. Date: Sep. 16, 2021

(65) Prior Publication Data

US 2022/0363083 A1 Nov. 17, 2022

(30) Foreign Application Priority Data

Mar. 11, 2020 (DE) ..... 10 2020 106 639.2
Mar. 11, 2020 (DE) ..... 10 2020 106 641.4

(51) Int. Cl.
*B42D 25/324* (2014.01)
*B41F 9/00* (2006.01)
(Continued)

(52) U.S. Cl.
CPC ..... *B42D 25/324* (2014.10); *B41F 9/002* (2013.01); *B41F 11/02* (2013.01); *B41F 13/11* (2013.01); *B41F 31/07* (2013.01); *B42D 25/405* (2014.10)

(58) Field of Classification Search
CPC ..... B42D 25/324; B42D 25/405; B41F 9/002; B41F 9/00; B41F 11/02; B41F 13/11; B41F 31/07
(Continued)

(56) References Cited

U.S. PATENT DOCUMENTS 4,033,059 A 7/1977 Hutton et al.
4,604,951 A 8/1986 Ichikawa et al.
(Continued)

FOREIGN PATENT DOCUMENTS

CA 965125 A 3/1975
CN 101544098 A 9/2009
(Continued)

OTHER PUBLICATIONS

International Search Report of PCT/EP2021/050456 dated Jul. 12, 2021.

*Primary Examiner* — Justin V Lewis
(74) *Attorney, Agent, or Firm* — MATTINGLY & MALUR, PC

(57) ABSTRACT

In some examples, a security element includes a substrate that, on one of its sides, includes at least one security feature extending over a first area, the security feature being configured in the form of a three-dimensional intaglio structure. A first ink group in the security feature includes a plurality of first raised image elements containing intaglio printing ink of the first color, and at least one second ink group in the security feature includes a plurality of raised image elements containing intaglio printing ink of a second color that differs
(Continued)

a)

b)

from the first color, and these are provided and arranged offset and spaced apart from one another such that they form an optically variable structure and/or at least some of the mutually adjacent image elements, which differ from one another in the color, occlude and/or expose one another to varying degrees from a varying viewing angles.

17 Claims, 17 Drawing Sheets

(51) Int. Cl.

| | |
|---|---|
| ***B41F 11/02*** | (2006.01) |
| ***B41F 13/11*** | (2006.01) |
| ***B41F 31/07*** | (2006.01) |
| ***B42D 25/405*** | (2014.01) |

(58) Field of Classification Search
USPC ..... 283/67, 70, 72, 74, 94, 98, 901
See application file for complete search history.

(56) References Cited

U.S. PATENT DOCUMENTS

| | | | | |
|---|---|---|---|---|
| 10,007,233 | B2 | 6/2018 | Schilling et al. | |
| 2010/0236432 | A1 | 9/2010 | Foresti et al. | |
| 2014/0312606 | A1* | 10/2014 | Lister | G03C 5/60 430/320 |
| 2015/0192897 | A1 | 7/2015 | Schilling et al. | |
| 2019/0232708 | A1* | 8/2019 | Holmes | B42D 25/373 |

FOREIGN PATENT DOCUMENTS

| | | | |
|---|---|---|---|
| CN | 101544098 | B | 6/2012 |
| DE | 2334702 | A | 1/1974 |
| DE | 10126264 | A1 | 12/2002 |
| DE | 102006050290 | A1 | 4/2008 |
| DE | 102007035161 | A1 | 1/2009 |
| DE | 102012105571 | A1 | 1/2014 |
| WO | 2001/72525 | A1 | 10/2001 |
| WO | 2003/052702 | A2 | 6/2003 |
| WO | 2005077656 | A1 | 8/2005 |
| WO | 2020/161058 | A2 | 8/2020 |

* cited by examiner a)

b)

a)

b)

a)

b)

SECURITY ELEMENT, SECURITY DOCUMENT INCLUDING A SECURITY ELEMENT, AND DEVICE AND METHOD FOR PRODUCING A SECURITY ELEMENT

CROSS-REFERENCES TO RELATED APPLICATIONS

This application is the US national phase, under 35 USC § 371, of PCT/EP2021/050456, filed on Jan. 12, 2021, published as WO 2021/180374 A1 on Sep. 16, 2021, and claiming priority to DE 10 2020 106 641.4, filed on Mar. 11, 2020, and DE 10 2020 106 639.2, filed Mar. 11, 2020, the disclosures of which are expressly incorporated by reference herein in their entireties.

TECHNICAL FIELD

Examples herein relate to a security element, to a security document including a security element, and to a device and a method for producing a security element. For example, a security element includes a substrate that, on one of its sides, includes at least one security feature extending over a first area. The security feature is configured in the form of a three-dimensional intaglio structure or at least comprising such an intaglio structure, the intaglio structure comprising raised first image elements that, at least in the area of their upper side, contain intaglio printing ink of a first color, at least one of the first image elements being situated adjacent to at least one further image element comprised by the intaglio structure, which has a second color that differs from the first color. In some examples, a security document, such as a banknote incorporates the security element.

Further, in some examples, a method for producing the security element includes a substrate being fed into a gravure printing unit operating according to an intaglio printing method and being printed at a printing nip by a forme cylinder. The forme cylinder, on its circumference, may have an image-producing pattern of recesses, of which some first recesses are inked by an inking unit with intaglio printing ink of a first color, and by which the substrate, when passing through the printing nip, is provided with raised first image elements, which contain intaglio printing ink of the first color in the area of the upper side.

Further, in some examples, a device for producing the security element includes a gravure printing unit operating according to an intaglio printing method to which, on the input side, substrate that is still unprinted or already printed according to another printing method can be fed and can be printed at a printing nip by a forme cylinder. The forme cylinder, on its circumference, has an image-producing pattern of recesses, of which some first recesses can be inked by an inking unit with a first intaglio printing ink, and by which the substrate can be provided with raised first image elements, and to the upper side of which intaglio printing ink of the first color (c1) can be applied. The printing unit includes an inking unit cylinder configured as a first relief inking cylinder, via which first recesses on the forme cylinder can be indirectly or directly inked with the first intaglio printing ink.

BACKGROUND

U.S. Pat. No. 4,604,951 A discloses a banknote including a three-color intaglio print image, which, by way of example, has a peripheral first, for example dark green pattern, a second, for example sepia pattern for a right profile image and a central number, and a third, for example dark blue pattern, which represents a lower left mark. The three image regions are formed by separate printing surfaces and are inked by three different inking units. The inking is carried out by way of duct rollers, which have recesses on their outer surfaces. Regions of the recesses which correlate with the image regions are provided, wherein the recesses correlate, for example, in their size with the line thickness on the forme cylinder. The regions of recesses are selected to be greater than the corresponding image regions. An ink film is transferred by projections corresponding to the recesses via a pattern roller to the plate cylinder by the duct roller comprising the recesses. On the outer surface, the pattern roller, in the circumferential direction, comprises a number of projections corresponding to the number of copies in the circumferential direction, extending contiguously over the surface area of the image region to be inked with the relevant ink.

The printing ink is applied onto the structured duct roller by an ink fountain. During printing, a distance of 0.03 to 0.05 mm is set between the duct roller and the ink blade. Further provided is an adjustment mechanism for positioning the structured duct roller in relation to the plate cylinder in the circumferential direction and in the axial direction.

An inking system of an intaglio printing press is known from WO 2005/077656 A1, wherein the intaglio plate is inked directly, in one embodiment, and additionally via a collector cylinder, in another embodiment, from a selective inking cylinder by way of a chablon roller. Printing ink is applied to the selective inking cylinder at its circumferential surface by a spraying device or a duct roller that cooperates with an ink fountain.

CN 101544098 B relates to a duct roller, an ink transfer device, and an ink transfer system of a gravure printing press. The ink is transferred from an ink reservoir via a duct roller, which has an engraving on its circumference that corresponds to the engraving on the gravure cylinder, to an elastic inking roller, and from there to the gravure cylinder. While the ink is applied to the duct roller, its outer surface is in contact with a hook-shaped scraper to scrape the ink off at the non-engraved locations. In this way, rather than a uniform ink film, an ink pattern of varying thickness, similar to the form of a relief, that corresponds to the pattern of engravings on the gravure cylinder is applied to the elastic inking roller. The contact pressure on the outer cylindrical surface can be adjustable via an adjustment device.

DE 10 2007 035 161A1 proposes improving optical tilt effects by superimposing a first embossed structure with a second embossed structure. This can either be achieved, in a first embodiment, by attaching second embossed elements in a "stub-like manner" to the first elements, i.e., so that these continue in a different shape and direction, or, in a second embodiment, by partially varying the geometry of the first embossed elements.

In DE 10 2006 050 290 A1, the register imprecisions are to be disguised, which are inevitably created by successively printing lines of different colors onto substrate. For this purpose, an embossed structure is superimposed onto such a multicolor raster structure, which carries a first piece of information, is located in a partial region of the raster structure, and carries a piece of information that overlaps with the first piece of information. The first piece of information is formed by modulation of the preferably successively or possibly simultaneously printed lines, and the embossed structure is formed by embossing the printed substrate in such a way that different colors end up on the different flanks of the respective embossment.

In DE 23 34 702 A, latent or transitory images of a print image generated by intaglio printing are generated by using areas varying in height, orientation or shape, for the purpose of creating the image, against a uniform background containing lines that have the same orientation and height. The imprint can be produced as is customary by inking the printing forme by applying an intaglio printing ink, wiping the surface smooth, and pressing it against the paper sheet.

To protect the printed product, US 2010/0236432 A1 describes applying a transparent coating, wherein the coating process can be carried out before or after wiping of the plate cylinder. The printing unit comprises a gravure cylinder cooperating with an impression cylinder, an ink collecting cylinder, and multiple chablon cylinders to be inked by corresponding devices. The raised relief-like areas extend over the entire line pattern of a pictorial or alpha-numerical intaglio motif to be inked on the respective chablon cylinder.

WO 03/052702 A2 relates to a value document including an image produced by recess printing, wherein a halftone image including partial surfaces of different tonal values can be produced by way of ink layers of different thickness. These are implemented by different engraving depths on the printing plate. Separation edges or ink trap elements in the engravings prevent printing ink from running into adjacent zones of different depths.

In U.S. Pat. No. 4,033,059 A, variable intaglio prints are generated on value documents by arranging groups of lower print image elements between image elements of a greater height arranged in a matrix-like manner. As an alternative, groups of image elements having a certain orientation are superimposed onto a regular structure of image elements having the same height, but a different orientation.

WO 01/72525 A1 discloses an embodiment of a printed image created by intaglio printing, according to which surface areas are printed with ink films of varying thickness by way of intaglio printing, and the background for these surface areas can likewise be ink-carrying and convey additional information by virtue of its shape and contour.

DE 101 26 264 A1 relates to a gravure cylinder comprising a ceramic coating into which, for the purpose of microprinting, engravings having a corresponding width of less than 200 μm are introduced by way of a laser.

The post-published WO 2020/161058 A2 discloses an intaglio printing unit comprising an inking unit cylinder including engravings that correspond to individual engravings of the forme cylinder, and an inking unit cylinder that cooperates therewith downstream and includes elevations that correspond to individual engravings of the forme cylinder.

To design security-relevant objects, in particular documents, so as to be as protected against forgery as much as possible, or at least to protect these against simple copying, they are provided with security elements comprising one or more security features.

These are usually directly comprised by the object to be secured, in particular the document, as part thereof, or they may be provided on a carrier substrate, which is applied to the security-relevant object or document, e.g., integrally bonded therewith, so as not to be removable from the object without destruction, for example.

Such security-relevant objects are, for example, security-relevant documents, such as identification documents, certificates or preferably securities, in particular banknotes. In a particularly advantageous embodiment, security elements of such objects include security features that are or have been produced using a gravure printing method, in particular steel engraving or intaglio printing method. In addition to optical impressions, this also allows haptic sensory impressions to be implemented at the same time.

SUMMARY

It is an object of the invention to devise a novel security element, a security document including a security element, as well as a device and a method for producing such a security element.

The object is attained by a security element that includes a first group comprised by the security feature includes a plurality of first raised image elements containing intaglio printing ink of the first color, and at least one second ink group comprised by the security feature includes a plurality of raised image elements containing intaglio printing ink of a second color that differs from the first color, and are provided and arranged offset and spaced apart from one another such that they form an optically variable structure and/or at least some of the mutually adjacent image elements, which differ from one another in the color, occlude and/or expose one another to varying degrees from a varying viewing angles.

Additionally, in some examples, the security element is incorporated into a security document in which the security element is printed directly onto the substrate which forms a basis of the security document or onto a substrate acting as a carrier substrate, which is applied, in particular integrally bonded, to the substrate which forms the basis of the security document.

In addition, in some examples, the method for producing a security element includes that on the forme cylinder, first recesses are inked, which in the region of their smallest diameter have a width of no more than 1,000 μm, and that first recesses of this type on the forme cylinder are inked with the first printing ink indirectly or directly by way of an inking unit cylinder configured as a first relief inking cylinder, which, on its circumference, comprises elevations which correspond to individual first recesses of this type on the forme cylinder and/or two or more non-contiguous elevations), which are in each case spaced no more than 2,000 μm apart from respective adjacent elevations. Further, individual first recesses on the forme cylinder are selectively inked by way of corresponding elevations on the first relief inking cylinder, and adjacent second recesses on the forme cylinder, which are spaced no more than 1,000 μm apart from first recesses, are indirectly or directly inked via a second relief inking cylinder with intaglio printing ink of a second color by way of second elevations that are provided on the circumference of the second relief inking cylinder, and which provide the substrate, when passing through the print nip, with raised second image elements that are adjacent to the first raised image elements, with the second recesses being inked by way of elevations on the second relief inking cylinder that correspond to individual second recesses on the forme cylinder.

Furthermore, in some examples, a device for producing the security element includes that on the forme cylinder, first recesses are provided, which in the region of their smallest diameter have a width of no more than 1,000 μm, and that the relief inking cylinder, on its circumference, comprises elevations that correspond to individual first recesses of this type on the forme cylinder and/or two or more non-contiguous elevations, which are in each case spaced no more than 2,000 μm apart from respective adjacent elevations. Individual first recesses on the forme cylinder are selectively inkable by way of corresponding elevations on the first relief inking cylinder, and adjacent second recesses that are spaced no more than 1,000 μm apart from first recesses are provided on the forme cylinder, which in the region of their smallest diameter have a width of no more than 1,000 μm and can be inked by the inking unit with a second intaglio printing ink that differs from the first intaglio printing ink. Further, elevations that correspond to individual second recesses on the forme cylinder are provided for inking the second recesses on the relevant second relief inking cylinder.

The advantages to be achieved with the invention are, in particular, that the protection against forgery of gravure printing-based or intaglio-based security features can be considerably enhanced compared to known designs. This applies in particular to intaglio structures which are not first produced as blind embossings of printed substrates, but in at least a portion of the structure, preferably the entire structure, at the same time have also been or are provided with intaglio printing ink in the region of the elevations. This ensures an exact register between the ink and the embossing pattern and/or allows proof of authenticity by abrasion of ink onto a differently colored surface, as is typical for intaglio print elements.

The security element according to the invention is a security element produced using a gravure printing method, in particular steel engraving or intaglio printing method, wherein further security elements that are produced in another manner may also be provided.

The enhanced protection against forgery results from an intaglio-based security feature, which includes one or more three-dimensional intaglio structures, also referred to as intaglio patterns, to represent images or patterns having a high resolution in terms of shading and/or ink intensity in the same image area. In contrast to printed, purely planer images or patterns, a three-dimensional intaglio structure or a three-dimensional intaglio pattern as used herein shall be understood to mean a printed structure or a printed pattern, including at least a number of image elements that are raised tangibly and/or significantly, i.e., for example, by at least 5 μm, in particular at least 10 μm, in relation to a base, and that are inked, in particular with intaglio printing ink.

In a particularly advantageous embodiment, the resolution and/or arrangement of the image-producing image elements are such that these supply an image or pattern that varies with the viewing angle or perspective.

A security element comprises a substrate that, on one of its sides, includes at least one security feature that extends over a first area and that is configured in the form of a three-dimensional gravure printing pattern, in particular intaglio pattern, or a three-dimensional intaglio structure, or at least encompasses the same, and comprises raised first elements of a first color and/or a first height, which are inked, in particular, at least on the upper side and/or in an upper area, preferably with gravure printing ink, in particular intaglio printing ink, of a first color. At least one of the first image elements, in particular multiple such first image elements, is or are in each case arranged, preferably at a distance of no more than 1,000 μm, adjacent to at least one further image element comprised by the intaglio structure, in particular at least two further image elements comprised by the intaglio structure, which has or have a color that differs from the first color and/or a different height, in particular by at least 20% and/or at least 1 μm, and/or ink film thickness.

In an advantageous embodiment, a multicolor gravure printing pattern, in particular intaglio pattern, is formed by a plurality of first and further, differently colored image elements, in which individual first image elements are surrounded on multiple sides by differently colored image elements in such a way that, as a result of the arrangement thereof, a multicolor gravure print image, in particular intaglio print image, having a color resolution, i.e., a distance between image elements of different colors, of 1,000 μm (in words: one thousand micrometers) or less is present in some areas.

In another advantageous embodiment, in addition to one or more of the aforementioned variant embodiments or instead, the first and further image elements are inked, in particular at least in the area of their upper side, with gravure printing ink, in particular intaglio printing ink, of a first color and/or include a gravure printing ink, in particular intaglio printing ink, of a first color in the upper area.

In another advantageous embodiment, in addition to one or more aforementioned variant embodiments or instead, the two further image elements adjacent to the first image element have the same second color, which differs from the first color, or have a respective other second and third color, which differs from the first color.

In another advantageous embodiment, in addition to one or more of the aforementioned variant embodiments or instead, the differently colored second image elements are inked with gravure printing ink, in particular intaglio printing ink, of a second color and/or include gravure printing ink, in particular intaglio printing ink, of a second color in the upper area.

In another advantageous embodiment, in addition to one or more aforementioned variant embodiments or instead, the second color is determined by the color of the unprinted substrate or by a coating, in particular printing ink, that differs from the gravure printing ink, in particular intaglio printing ink, and is applied to the substrate before the three-dimensional gravure printing pattern, in particular intaglio pattern, is applied.

In another advantageous embodiment, in addition to one or more aforementioned variant embodiments or instead, the first and the respective adjacent raised image element are separated from one another by a trough and have a distance of no more than 1,000 μm from one another and/or have a distance that corresponds to no more than ten times a maximum elevation of the higher of the two raised image elements that are adjacent to one another.

In another advantageous embodiment, in addition to one or more aforementioned variant embodiments or instead, a first group, comprised by the security feature, comprising a plurality of first raised image elements containing gravure printing ink, in particular intaglio printing ink, of the first color and at least one second group, comprised by the security feature, comprising a plurality of image elements of a second color different from the first color, in particular an intaglio printing ink of a second color, are provided and arranged offset and spaced apart from one another so as to form an optically variable structure and/or so that at least some of the differently colored image elements that are adjacent to one another occlude and/or expose one another to varying degrees from a varying viewing angle.

In another advantageous embodiment, in addition to one or more aforementioned variant embodiments or instead, several groups of image elements that differ in terms of the color, for example in the color of the intaglio printing ink, are provided, arranged with respect to one another and configured with different and/or varying heights so as to be effective in the manner of pixel-like image components that are situated at lower and higher levels, which, depending on the variation of the viewing angle in relation to the surface of the security element and/or depending on the variation of the viewing direction about an axis that is perpendicular to the security feature at the observed location, convey changing image information and/or different optical sensory impressions or perceptions.

In another advantageous embodiment, in addition to one or more aforementioned variant embodiments or instead, image elements of two or more groups of image elements that differ in terms of the color, for example in the color of the intaglio printing ink, are provided, configured with heights that differ for the groups and/or vary within a group and/or over the extension of image elements and, viewed along a functional direction, are arranged in a pattern in such a way, in a sequence and spaced apart from one another, that they, when the viewing angle is varied in a plane that is spanned by the functional direction and an axis that is perpendicular to the security feature at the observed location, conveys a color effect and/or color gradient that changes with the viewing angle.

In another advantageous embodiment, in addition to one or more aforementioned variant embodiments or instead, the ratio between the heights of the respective adjacent raised first and second image elements of different colors, for example of the intaglio printing ink, varies over the groups of alternating first and second image elements, in at least an alignment extending in the functional direction.

In another advantageous embodiment, in addition to one or more aforementioned variant embodiments or instead, the height of the image elements of one of the aforementioned groups varies across the group, while that of the other group varies in an opposing manner thereto or is constant.

In another advantageous embodiment, in addition to one or more aforementioned variant embodiments or instead, first, linear image elements, e.g., of a first aforementioned group of a first color, have a step-like or continuously varying ink film thickness and/or height across their longitudinal extension.

In advantageous refinements, second raised linear image elements of a second group having a different color can be provided between the first raised image elements that vary in their ink film thickness and/or height, and can all have the same height or a height that varies across the second group, but is constant over the respective image element, or can have an ink film thickness and/or height that also varies in a step-like manner or continuously across their longitudinal extension.

In another advantageous embodiment, in addition to one or more aforementioned variant embodiments or instead, the maximum of the height of image elements that vary over their extension varies across the group.

In an alternative advantageous variant embodiment, a further, second image element is provided adjacent to the first image element at a distance of no more than 1,000 μm, which has an ink film thickness that is greater by at least 1 μm and/or by at least half the ink film thickness of the first image element, and a further, third image element is provided adjacent to the second image element at a distance of no more than 1,000 μm, which has an ink film thickness that is greater by at least 1 μm, in particular at least 20 μm, and/or by at least half the ink film thickness of the second image element.

The security element is preferably comprised by a security document, in particular a banknote, wherein the security element is printed directly onto the substrate which forms the basis of the security document or onto a substrate acting as a carrier, which is applied to the security document.

During the production of a security element, in particular an aforementioned security element, substrate is fed to a gravure printing unit operating according to a gravure printing method, in particular intaglio printing method, and is printed at a printing nip by a forme cylinder, wherein the forme cylinder, on its circumference, has an image-producing pattern of recesses, of which some first recesses are inked by an inking unit with gravure printing ink, in particular intaglio printing ink, of a first color, and by which the substrate is provided with raised first image elements, when passing through the printing nip, which contain gravure printing ink, in particular intaglio printing ink, of the first color in the area of the upper side. On the forme cylinder, first recesses are inked, which in the region of their smallest diameter have a width of no more than 1,000 μm, wherein such first recesses on the forme cylinder are inked with the first printing ink indirectly or directly via an inking unit cylinder configured as a relief inking cylinder, which, on its circumference, comprises elevations that correspond to individual such first recesses on the forme cylinder and/or elevations which have a width that is no more than 0.5 mm greater than the width of the corresponding first recesses on the forme cylinder and/or which match individual first recesses on the forme cylinder having a width that is no more than ten times greater and/or which individually match recesses on the forme cylinder that are spaced 1,000 μm apart and/or which comprises, on its outer cylindrical surface, regions including at least five non-contiguous elevations on a surface area of no more than 10 $cm^2$ and/or including two or more non-contiguous elevations, which are each spaced at a distance of, e.g., no more than 2,000 μm, preferably no more than 1,000 μm, apart from respective adjacent elevations. In particular for multicolor printing, recesses that are adjacent to one another, and in particular belong to the same security feature, on the same forme cylinder can be spaced more than 1,000 mm apart from one another.

In an advantageous embodiment, individual first elevations on the first relief inking cylinder are selectively inked by ink-carrying recesses on the circumference of an inking unit cylinder configured as a gravure inking cylinder, which likewise correspond to the first recesses on the forme cylinder which correspond to the relevant elevations.

In another advantageous embodiment, in addition to one or more of the aforementioned variant embodiments or instead, adjacent second recesses on the forme cylinder that are spaced no more than 1,000 μm apart from the first recesses, which in the region of their smallest diameter have a width of no more than 1,000 μm, are not inked and provide the substrate with raised second image elements, when passing through the inking nip, without applying gravure printing ink, in particular intaglio printing ink, thereto. In an alternative and preferred embodiment, such second recesses are inked via a second relief inking cylinder with gravure printing ink, in particular intaglio printing ink, of a second color by way of elevations that are provided on the circumference of the second relief inking cylinder. The inking is preferably carried out by way of elevations on the second relief inking cylinder, in the manner in which these were already described for the first relief inking cylinder.

In another advantageous embodiment, spaced apart from one or a respective first recess of a first depth, e.g., of 10 to 14 μm, by no more than 1,000 μm and/or at least 50 μm, one or a respective adjacent second recess of a second depth, which differs from the first depth by at least 20% or at least 3 μm, e.g., of 13 μm to 17 μm, and optionally spaced apart from the latter, e.g., by no more than 1,000 μm and/or at least 50 μm, one or a respective third recess of a third depth, which differs by at least 20% and/or at least 20 μm from the second depth, e.g., of 35 to 45 μm, on the forme cylinder are inked indirectly or directly via the same relief inking cylinder with intaglio printing ink of a first same color, wherein the first and second, and optionally third, recesses provide the substrate, when passing through the printing nip, with one or more first and one or more second, and optionally with one or more third, raised image elements, which contain, in the region of their respective upper side, intaglio printing ink of ink film thicknesses that differ from one another. In the process, the first and second, and optionally third, recesses are provided with the intaglio printing ink in each case indirectly by way of respective ink-carrying recesses on the same gravure inking cylinder provided in the inking unit, which in each case correspond to respective first and second, and optionally third, recesses on the forme cylinder and are spaced apart from one another. The first, second, and optionally third recesses have at least a width, i.e., in the direction of their optionally smaller extension in the outer cylindrical surface, of 100 μm, in particular at least 150 μm.

A security element including a security feature, in particular such a security feature, can preferably be produced by means of a device comprising a gravure printing unit operating according to a gravure printing method, in particular intaglio printing method, to which, on the input side, substrate that is still unprinted or has already been printed according to another printing method, can be fed and printed by a forme cylinder at a printing nip. On its circumference, the forme cylinder comprises an image-producing pattern of recesses, of which some first recesses can be inked by an inking unit with a first gravure printing ink, in particular intaglio printing ink, and by which the substrate is provided with raised first image elements, and to the upper side of which the gravure printing ink, in particular intaglio printing ink, of the first color is applied, wherein the printing unit comprises an inking unit cylinder configured as a relief inking cylinder, by way of which first recesses on the forme cylinder can be inked indirectly or directly with the first gravure printing ink, in particular intaglio printing ink. First recesses are provided on the forme cylinder, which in the region of their smallest diameter have a width of no more than 1,000 μm, wherein the relief inking cylinder, on its circumference, includes elevations that correspond to individual such first recesses on the forme cylinder, and/or elevations which have a width that is greater by no more than 0.5 mm than the width of the corresponding first recesses on the forme cylinder and/or which match individual first recesses on the forme cylinder with a width that is greater by no more than a factor of ten and/or which individually match recesses on the forme cylinder that are spaced 1,000 μm apart from one another and/or which comprises, on its outer cylindrical surface, regions having at least five non-contiguous elevations over a surface area of no more than 10 $cm^2$ and/or having two or more non-contiguous elevations, each of which is spaced no more than 2,000 μm, preferably no more than 1,000 μm, apart from a respective adjacent elevation.

Preferably, an inking unit cylinder configured as a gravure inking cylinder is provided, which comprises ink-carrying recesses on the circumference, which correspond to the first recesses on the forme cylinder that correspond to the relevant elevations, and by which individual first elevations on the first relief inking cylinder can be selectively inked.

For the adjacent printing of image elements of a different color, a corresponding second relief inking cylinder, and optionally a corresponding second gravure inking cylinder, are provided in one embodiment. For example, adjacent second recesses that are spaced no more than 1,000 μm apart from first recesses are provided on the forme cylinder, which in the region of their smallest diameter have a width of no more than 1,000 μm and can be inked by the inking unit, e.g., from the second gravure inking cylinder, with a second intaglio printing ink that differs from the first intaglio printing ink, wherein a second gravure inking cylinder is provided with ink-carrying recesses on the circumference, which correspond to second recesses on the forme cylinder and by way of which elevations on the second relief inking cylinder, which correspond to recesses on the forme cylinder, can be inked.

In another advantageous embodiment, adjacent second recesses of a second depth, which differs by at least 20% and/or 3 μm from the first depth, which are no more than 1,000 μm apart from first recesses of a first depth, and possibly third recesses of a third depth, which differs by at least 20% and/or at least 20 μm from the second depth, which are spaced apart from the second recesses, are provided on the forme cylinder, which in the region of their smallest diameter have a width of no more than 1,000 μm and can be inked indirectly or directly by the inking unit via the same relief inking cylinder with intaglio printing ink of a first same color, wherein the intaglio printing ink can be fed to the first and second, and optionally third, recesses on the forme cylinder in each case indirectly by way of respective ink-carrying recesses of the same gravure inking cylinder provided in the inking unit which each correspond to the first and second recesses on the forme cylinder and are spaced apart from one another.

By designing the printing unit with an aforementioned gravure inking cylinder and/or an aforementioned relief inking cylinder, it is possible to match finest structures of image elements that differ in terms of the color and/or in the color shade, i.e., the ink film thickness, using the intaglio method.

Further variants or details for the security element, for a method, or for a device for producing can be derived individually or in combination from the following description.

BRIEF DESCRIPTION OF THE DRAWINGS

Exemplary embodiments of the invention are illustrated in the drawings and will be described in greater detail below. The drawings show.

DETAILED DESCRIPTION

A security element 001 according to the invention is a security element 001 produced by way of a gravure printing method, in particular steel engraving or intaglio printing method, wherein further security elements 001 that are produced in another manner can also be provided on the object B or the carrier B.

Figure 1A:
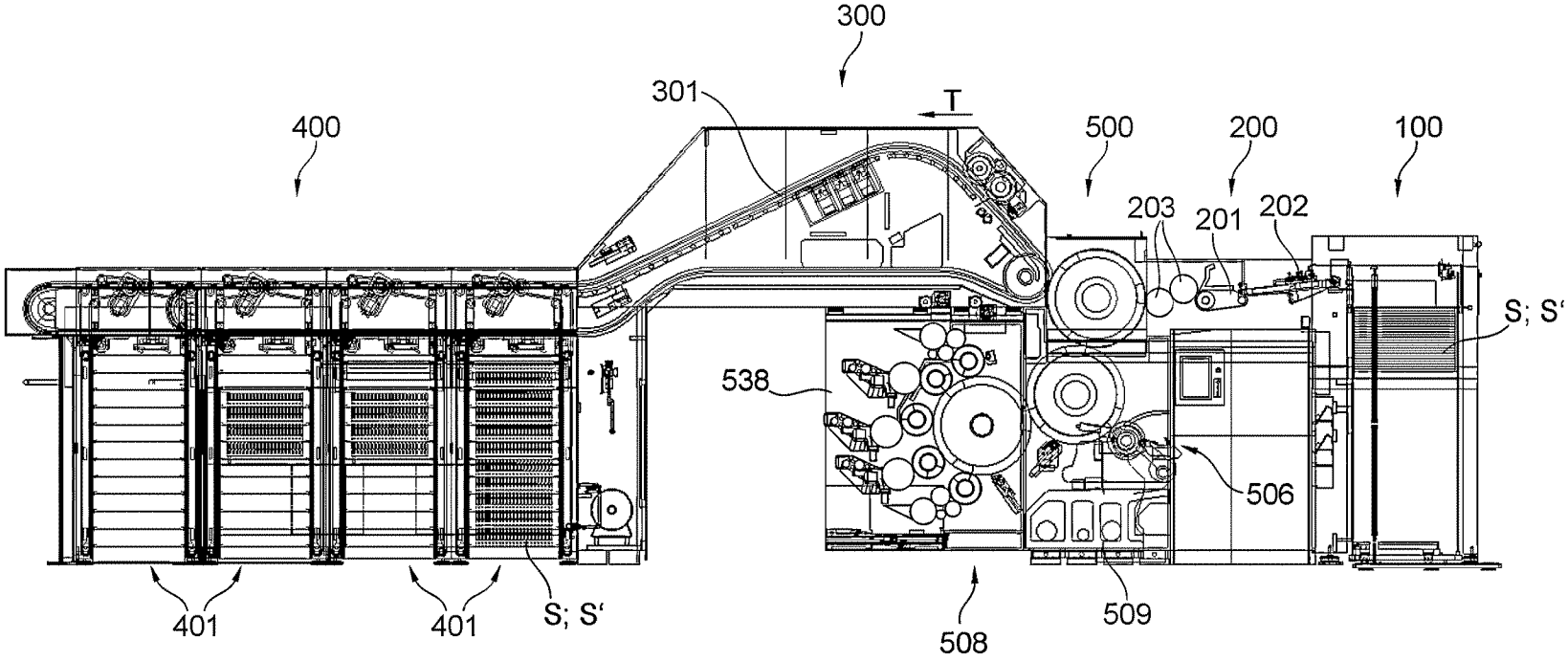
FIG. 1*a* a side view of a printing press, in particular a gravure printing press in a first embodiment.
Figure 4A:
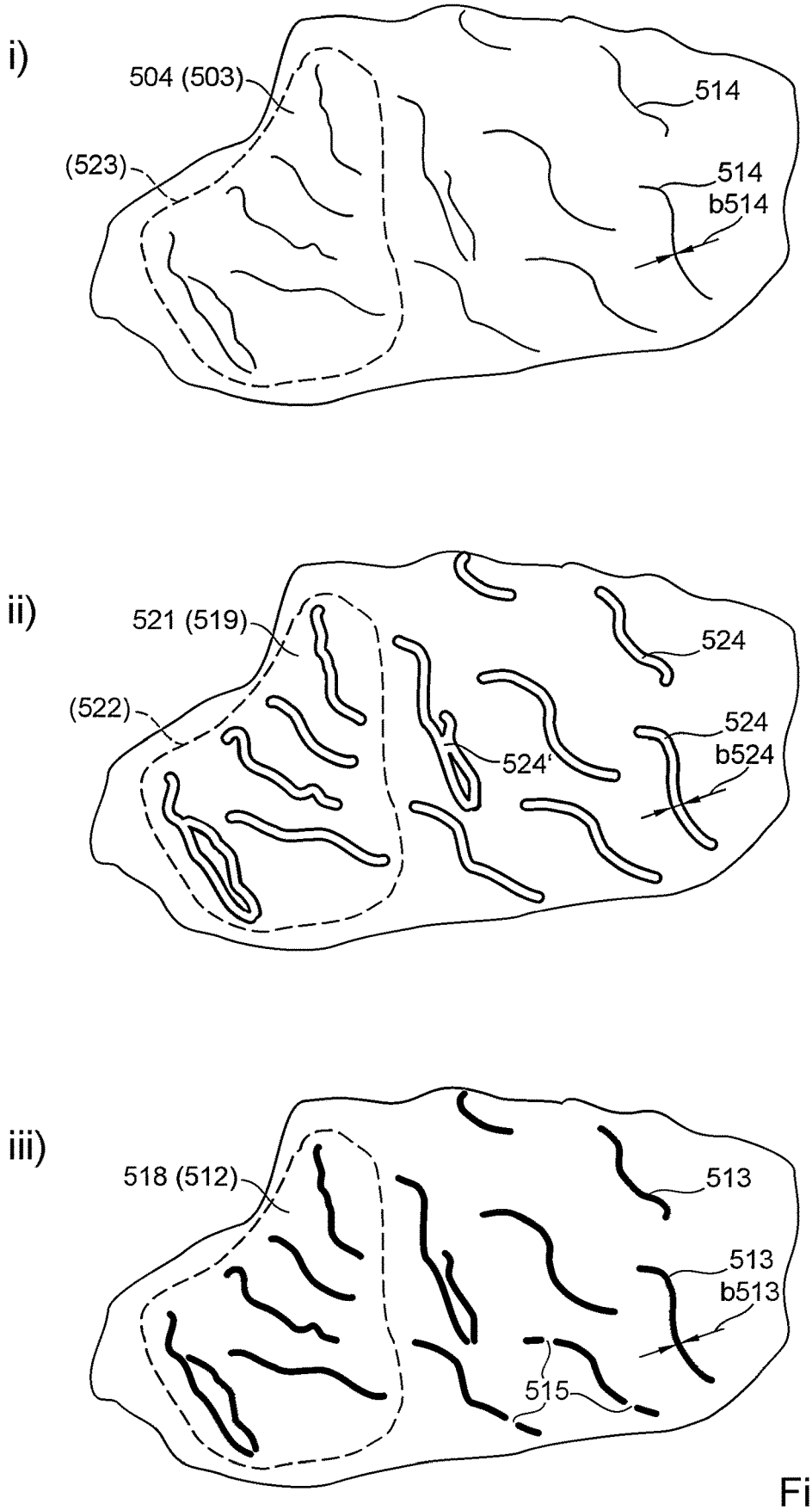
FIG. 4*a* a schematic illustration of i) a pattern of recesses on the forme cylinder, ii) a pattern of corresponding elevations on the inking unit cylinder that has the elevations, and iii) a pattern of corresponding recesses on the inking unit cylinder that has the recesses.
Figure 4B:
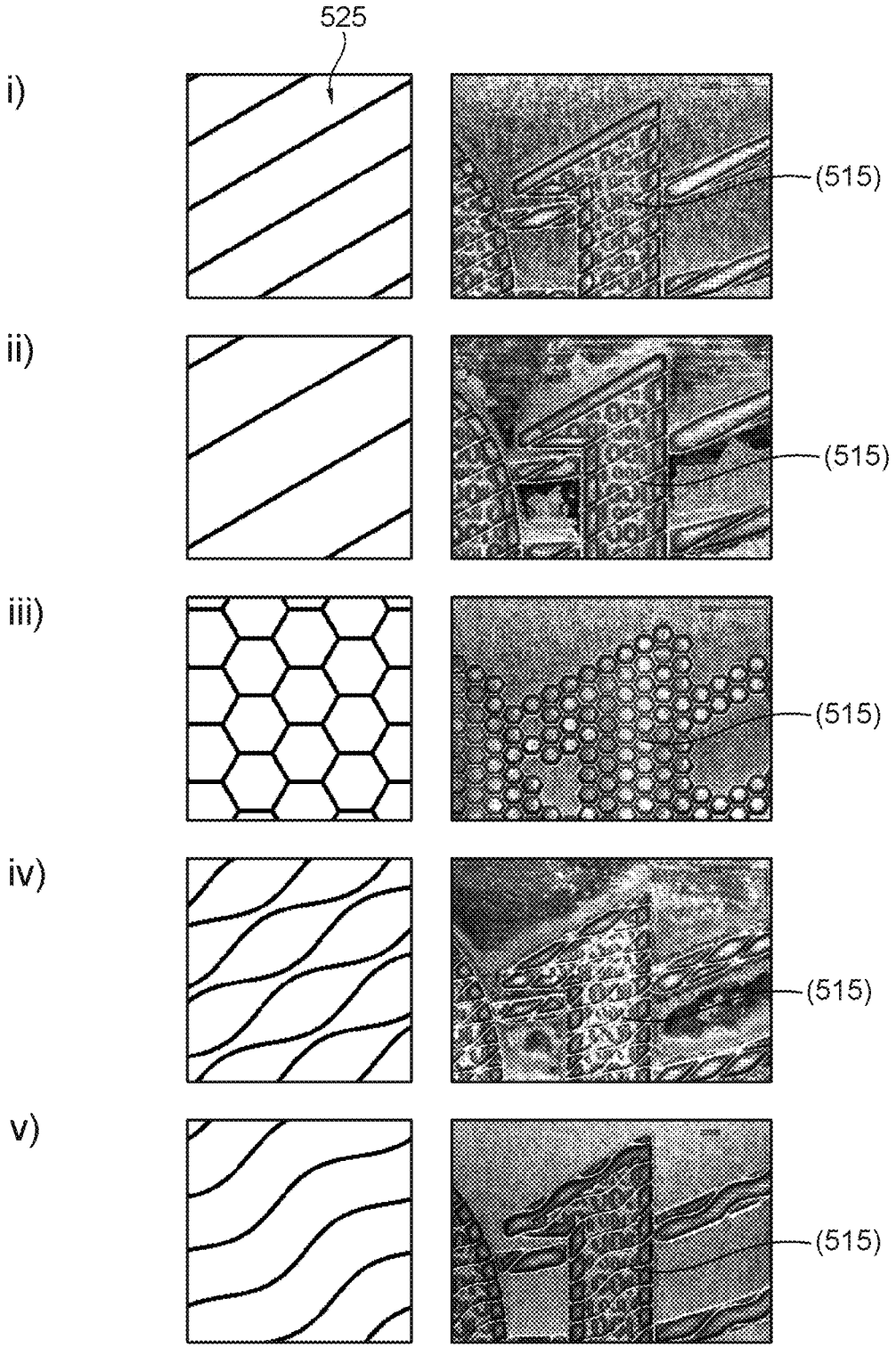
FIG. 4*b* a schematic detail illustration of advantageous embodiments of the formation of recesses on the inking unit cylinder.

A security feature 001 according to the invention can preferably be produced by a printing press, in particular a security printing press, as it is shown, for example, in FIG. 1*a*) to FIG. 4*b*) and described in more detail hereafter.

Figure 5:
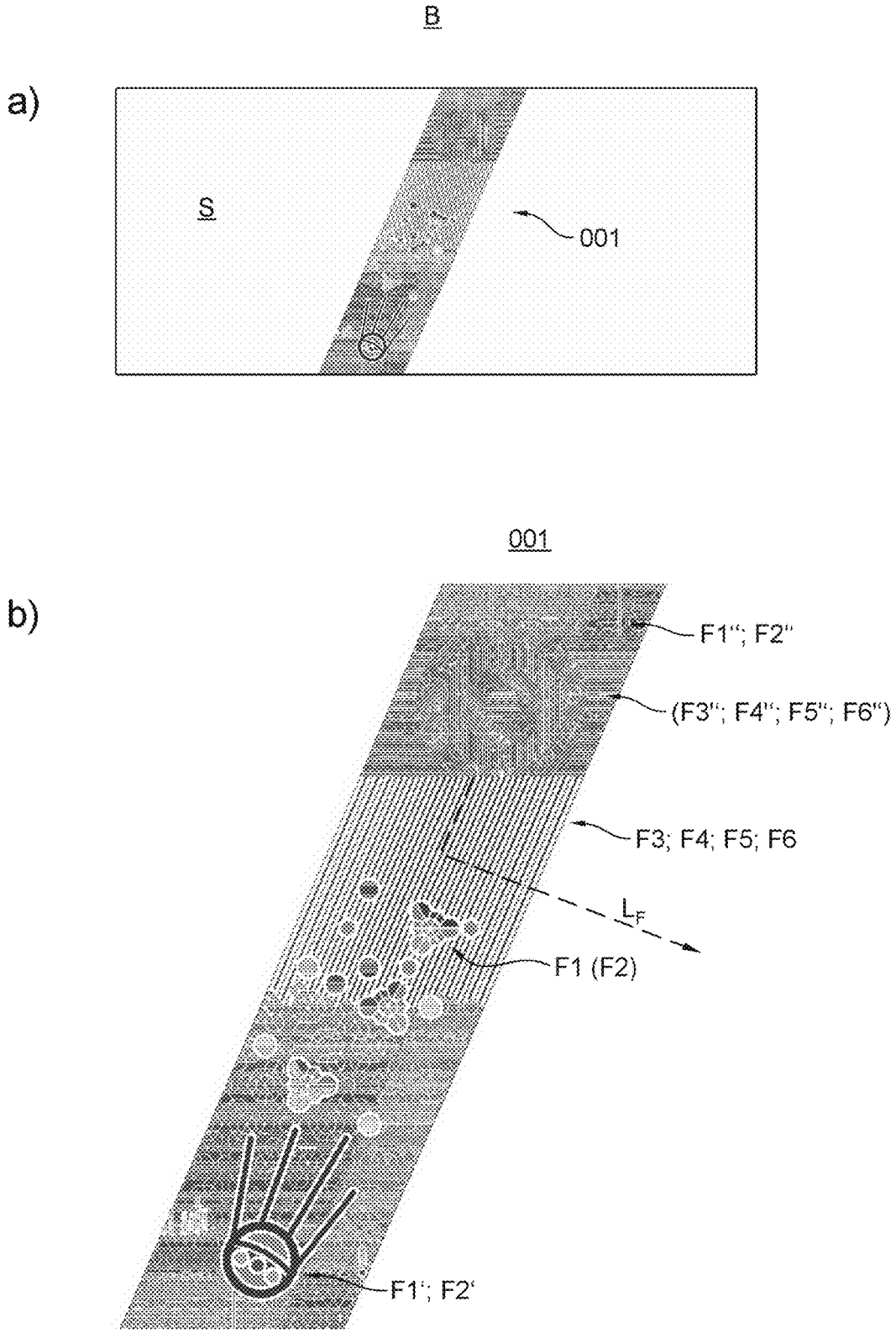
FIG. 5 an exemplary embodiment a) for an object, which is provided with security features, including a security element based on the example of a banknote, and b) an enlarged detail of the security element, comprising security features, that has been applied by way of gravure printing.
Figure 6:
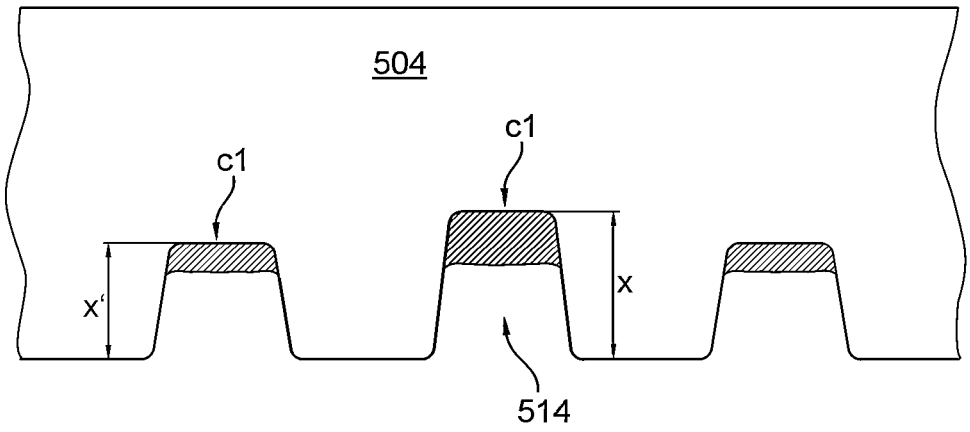
FIG. 6 a schematic illustration a) of a detail of an object treated by gravure printing, in particular steel engraving or intaglio printing, and b) of the corresponding detail of a printing forme used for this purpose, including recesses or engravings of varying depths.
Figure 6:
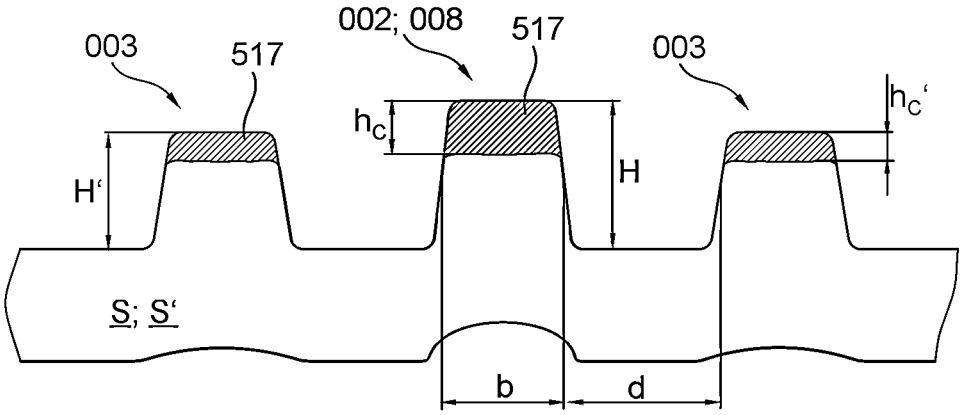
Figure 7:
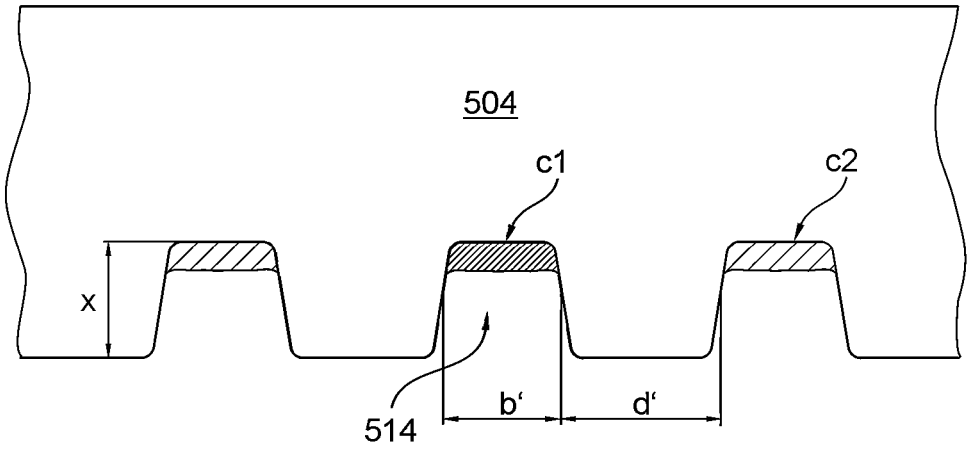
FIG. 7 a schematic illustration a) of a detail of an object treated by gravure printing, in particular steel engraving or intaglio printing, and b) of the corresponding detail of a printing forme used for this purpose, using intaglio printing inks of different colors.
Figure 7:
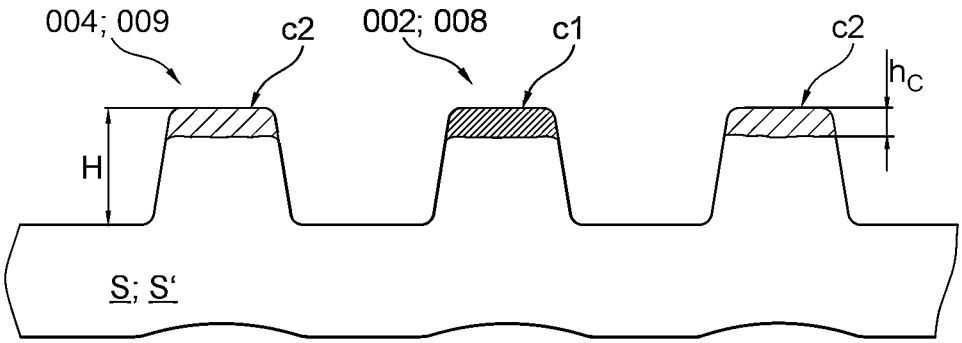

FIG. 5*a*), by way of example, shows a security element 001 including multiple security features F1; F2; F3; F4; F5; F6 on an object B, in particular a security document B, preferably a banknote B, and FIG. 5*b*), by way of example, shows an enlarged illustration of the security element 001 from FIG. 5*a*), wherein it is indicated in parentheses that the security feature 001 shown there can be applied not only directly onto the object B, here, a security document B, in particular a banknote B, but, in general, also onto a substrate 014 serving as a carrier, e.g., a carrier substrate 014, for example a film 014. Preferably, however, it is applied directly onto the object B, e.g., the security document B, in particular the banknote B. In the case of the latter, the security element 001 or the at least one security feature F1; F2; F3; F4; F5; F6 is preferably applied onto the substrate S; S' of the multiple-up $N_i$ pertaining to the later banknote B, which, unless explicitly excluded, shall also be encompassed hereafter by the wording of "applying onto the banknote" or "applying onto the security document."

The security features F1; F2; F3; F4; F5; F6 shown here by way of example have in common, e.g., that their security-relevant effect is the result of a gravure printing process, in particular a steel engraving or intaglio printing process, or is produced by gravure printing, in particular steel engraving or intaglio printing. The feature of a using an effect or of a security feature F1; F2; F3; F4; F5; F6 thus produced are tangible image elements 002; 003; 004; 006; 007; 008; 009, which are raised in relation to a base plane, i.e., the unembossed plane, of the object surface or document surface or security element surface and which, in the region of their elevation, ideally are essentially only provided with printing ink 517, in particular with gravure printing ink or intaglio printing ink 517, on the upper side of the respective substrate elevation that is embossed during the aforementioned gravure printing process, i.e., in the region of the plateaus, backs or peaks that are formed, or are simultaneously provided with the embossing during the printing process. In contrast to, for example, predominantly penetrated printing inks, the printing ink 517, e.g., gravure printing ink 517, in particular intaglio printing ink 517, that is applied during the gravure printing process, in particular steel engraving or intaglio printing process, rests with a portion of its ink film thickness $h_C$; $h_C'$; $h_C''$ on the substrate S; S' and/or is itself still paste-like on the finished product and/or has not thoroughly dried and/or leaves abrasion marks in the case of friction contact with a white paper.

The ink film thickness $h_C$; $h_C'$; $h_C''$ of the image elements 002; 003; 004; 006; 007; 008; 009 provided with intaglio printing ink 517, at least in the region of the upper side, is, e.g., at least 2 μm, in particular at least 4 μm, in advantageous embodiments, is, for at least some of the image elements 002; 003; 004; 006; 007; 008; 009, e.g., at least 10 μm. The ink film thickness $h_C$; $h_C'$; $h_C''$ is advantageously as much as 200 μm, in particular as much as 150 μm, e.g., as much as 100 μm.

A height H; H'; H'', e.g., overall height H; H'; H'', of the raised image elements 002; 003; 004; 006; 007; 008; 009; 011; 012 above the base plane, on at least a section or at at least a highest point of the raised image element 002; 003; 004; 006; 007; 008; 009; 011; 012, is, for example, at least 5 μm, in particular at least 10 μm, and advantageously, for at least some of the image element 002; 003; 004; 006; 007; 008; 009; 011; 012, is at least 20 μm and/or, e.g., no more than 300 μm, in particular no more than 200 μm, advantageously no more than 150 μm. In particular, the height H; H'; H", on at least a section or at a highest point of the raised image element 002; 003; 004; 006; 007; 008; 009; 011; 012, is, for example, in a range of 5 μm to 200 μm, preferably 10 μm to 150 μm.

The security features F1; F2; F3; F4; F5; F6 of the security elements 001 according to the invention or of an object B comprising the same are now characterized in that raised image elements 002; 003; 004; 006; 007; 008; 009; 011; 012 formed by gravure printing, in particular intaglio printing, are provided, which are spaced only little apart from one another and differ in their color c1; c2; c3; cS and/or in their ink film thickness $h_C$; $h_C'$; $h_C''$, i.e., in particular, in the perceptible brightness or intensity of the relevant color c1; c2; c3 and/or height H; H'; H".

Figure 8:
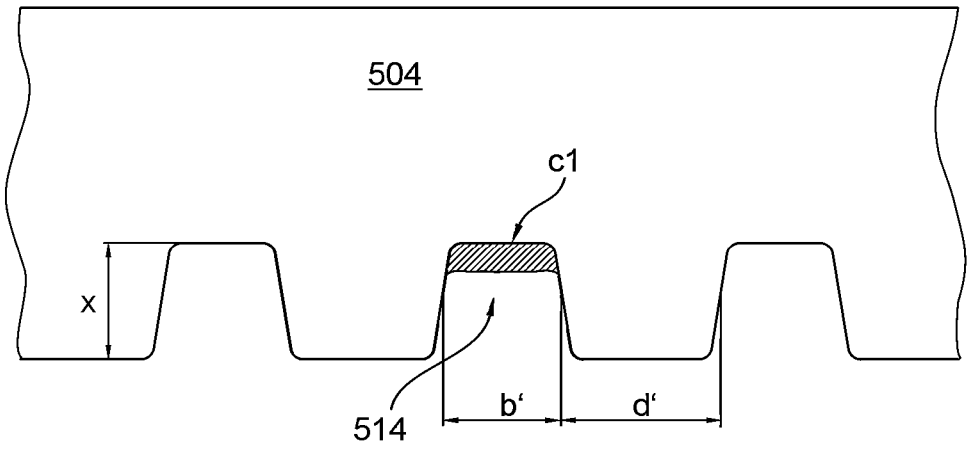
FIG. 8 a schematic illustration a) of a detail of an object treated by gravure printing, in particular steel engraving or intaglio printing, and b) of the corresponding detail of a printing forme used for this purpose, wherein both image elements to which gravure printing ink, in particular intaglio printing ink has been applied, and image elements to which no gravure printing ink or intaglio printing ink has yet been applied, are provided.
Figure 8:
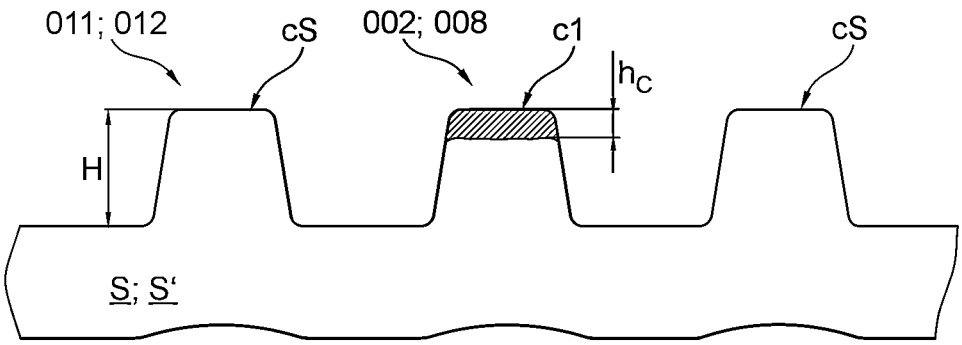

A security element 001 or security document B according to the invention comprises at least one first security feature F1; F2; F3; F4; F5; F6, which has been or is applied to one side of the security element 001 or security document B by way of a gravure printing method and extends over at least one first region, wherein the security feature F1; F2; F3; F4; F5; F6 comprises at least one first raised image element 002; 008, which is raised in relation to a bottom level of the security element 001 or security document B, and contains gravure printing ink 517 in the raised, in particular upper, region, and at least one adjacent second raised image element 003; 004; 006; 007; 009; 011; 012, which is likewise raised in relation to the bottom level of the security element 001 or security document B. This second raised, in particular adjacent, image element 003; 004; 006; 007; 009; 011; 012 can contain gravure printing ink 517 in the raised, in particular upper, region, or was only embossed, without ink being applied. The at least one first and the at least one second image element 002; 003; 004; 006; 007; 008; 009; 011; 012 are formed by way of intaglio printing, in particular in the same printing process, and differ in the color c1; c2; c3; cS and/or in the ink film thickness $h_C$; $h_C'$; $h_C''$, e.g., the perceptible brightness or intensity of the relevant color c; c'; c" and/or in the height H; H'; H", e.g., the overall height H; H'; H" of the raised image elements 002; 003; 004; 006; 007; 008; 009; 011; 012 in relation to the level therebetween or the aforementioned bottom level. Embossing without simultaneously applying gravure printing ink or intaglio printing ink shall be synonymous here with the presence or application of a "film thickness of zero." The relevant image element 011; 012 then has the color cS of, e.g., the unprinted or previously coated, in particular printed, substrate S; S' (see, e.g., FIG. 8, FIG. 12 and FIG. 13).

The color cS of a, for example, previously coated or printed substrate S; S' can, e.g., in the region of the elevations to which gravure printing ink has not been applied again and/or in the region situated between two image elements 002; 003; 004; 006; 007; 008; 009; 011; 012, be formed by the color cS of a coating 013, in particular printing ink 013, e.g., offset printing ink, letterpress printing ink or flexographic printing ink or screen printing ink, that has been applied onto the substrate S; S'. In an advantageous embodiment, the coating 013 or printing ink 013, e.g., applied by way of flexographic or screen printing ink, can be configured as ink containing magnetic particles or as a so-called optically variable ink (OVI).

The first and second raised image elements 002; 003; 004; 006; 007; 008; 009; 011; 012 are separated from one another by a trough and have a distance d; d' of, e.g., no more than 1,000 μm (in words: one thousand micrometers), in particular no more than 600 μm, with respect to one another and/or a distance d; d' that corresponds to no more than ten times, in particular no more than five times, a maximum elevation of the higher of the two adjacent raised image elements 002; 003; 004; 006; 007; 008; 009; 011; 012. A minimum distance can, e.g., be at least 10 μm, in particular at least 50 μm. The distance d; d' of such adjacent raised image elements 002; 003; 004; 006; 007; 008; 009; 011; 012 is preferably 200 μm to 500 μm. Different distances d; d' can be present between pairs of a plurality of image elements 002; 003; 004; 006; 007; 008; 009; 011; 012. Likewise, image elements 002; 003; 004; 006; 007; 008; 009; 011; 012 of different widths b; b' may be present.

In the possibly present case that the lateral flanks of the raised image elements 002; 003; 004; 006; 007; 008; 009; 011; 012 do not run perpendicularly to the bottom level of the security element 001 or security document B, the distance d; d' shall be understood to mean the distance of the positions, projected into the plane of the bottom level, of the half heights of the mutually facing flanks of the involved image elements 002; 003; 004; 006; 007; 008; 009; 011; 012, and a width b; b' of an image element 002; 003; 004; 006; 007; 008; 009; 011; 012 shall be understood to mean the width between the positions, projected into the plane of the bottom level, of the half heights of the flanks of the relevant image element 002; 003; 004; 006; 007; 008; 009; 011; 012 which face away from one another.

In the possibly present case that the height H; H'; H" or the ink film thickness $h_C$; $h_C'$; $h_C''$ is not constant over the width b; b' of the relevant image element 002; 003; 004; 006; 007; 008; 009; 011; 012, the height H; H'; H" or the ink film thickness $h_C$; $h_C'$; $h_C''$ for linear image elements 002; 003; 004; 006; 007; 008; 009; 011; 012 is considered to be that which is present at a certain point of the line on its half width b; b', and for areal image elements 002; 003; 004; 006; 007; 008; 009; 011; 012 it is considered to be that which is present in the geometric center of gravity of the relevant image element 002; 003; 004; 006; 007; 008; 009; 011; 012. In case of doubt, a linear image element 002; 003; 004; 006; 007; 008; 009; 011; 012 shall be understood to mean an image element having a substantially constant width b; b', i.e., except for possibly tapered end sections, with a drop below the maximum width b; b' of no more than 10%, and a length that is at least three times the size of the maximum width b; b'.

In the case of adjacent image elements 002; 003; 006; 007; 008; 009; 011; 012 that are, however, separated from one another by a trough, having differing ink film thicknesses $h_C$; $h_C'$; $h_C''$ and/or heights H; H'; H", these are, e.g., configured with ink film thicknesses $h_C$; $h_C'$; $h_C''$ and/or heights H; H'; H" that differ by, e.g., at least 20% of the smaller or smallest of the heights H; H'; H" and/or, e.g., by at least 1 μm, advantageously by at least 3 μm, in particular at least 5 μm, e.g., for at least some of the mutually adjacent image elements 002; 003; 006; 007; 008; 009; 011; 012 even with at least 10 μm. For example, at least one or more second image elements 003; 004; 006; 007; 009 are provided with a height H'; H" that is greater by at least 20% and/or, e.g., by at least half the height H of the adjacent first image element 002; 008, and/or an ink film thickness $h_C'$; $h_C''$ that is greater by at least 20% and/or e.g., by at least half the ink film thickness $h_C$ of the first image element 002; 008.

Apart from, e.g., the case in which an application of gravure printing ink or intaglio printing ink 517 is entirely absent, i.e., a film thickness of zero, a minimum thickness of e.g., at least 2 μm, advantageously at least 4 μm, in particular at least 5 μm, is preferably present for the ink film having the lowest of two or three different ink film thicknesses $h_C$; $h_C'$; $h_C''$ that are different from zero.

Regardless of the aforementioned raised image elements 002, 003; 004; 006; 007; 008; 009; 011; 012 having a small distance d; d' and having a different ink film thickness $h_C$; $h_C'$; $h_C''$ and/or height H; H'; H" and/or color c; c'; c"; cS, particularly, however, in conjunction therewith, image elements 008; 009; 012 can be provided, which have an ink film thickness $\tilde{h}c$ and/or a height $\tilde{H}$ that varies, e.g., continuously, e.g., monotonically or in a fluctuating manner. An ink film thickness $\tilde{h}c$ within the relevant image element 008; 009 varies, for example, by at least 5 μm, preferably by at least 10 μm, in particular by at least 20 μm. A height $\tilde{H}$, with or without gravure printing ink applied, likewise, for example, varies by at least 5 μm, preferably by at least 10 μm, in particular by at least 20 μm.

In particularly advantageous embodiments, in each case a plurality of first and second raised image elements 002; 003; 004; 006; 007; 008; 009; 011; 012 are provided, in the region of the security feature F1; F2; F3; F4; F5; F6, in such a way that they, at least viewed in a direction $L_F$ extending in the plane of the security feature F1; F2; F3; F4; F5; F6, a direction $L_F$ also referred to here, e.g., as functional direction $L_F$, are alternately arranged and at least partially one behind the other, so that they, in their collectivity, form a so-called latent image or pattern, which for various viewing angles ϕ, i.e., angles between the viewing direction directed at a point of the security feature F1; F2; F3; F4; F5; F6 and the plane of the security element 001 or security document B at the relevant point, constitutes or supplies image information that varies in terms of the color impression and/or in the image content or an optically varying optical sensory impression or perception. A varying or preferably fixed distance d; d' between, viewed in the functional direction $L_F$, the respective first and second, or between the respective second and first, image elements 002; 003; 004; 006; 007; 008; 009; 011; 012 can be provided over all or at least a multiplicity of the first and second image elements 002; 003; 004; 006; 007; 008; 009; 011; 012. Instead or in addition, the distances d; d' in each case between the first and the following second image element 002; 003; 004; 006; 007; 008; 009; 011; 012 as well as the second and the subsequent first image element 002; 003; 004; 006; 007; 008; 009; 011; 012 can differ from one another, or preferably can be the same.

On this aforementioned basis of, in particular only slightly, spaced-apart image elements 002; 003; 004; 006; 007; 008; 009; 011; 012 of different colors c; c'; c"; cS and/or different and optionally varying ink film thicknesses $h_C$; $h_C'$; $h_C''$; $\tilde{h}_C$ and/or heights H; H'; H"; $\tilde{H}$, different types of gravure printing-based or intaglio-based security features F1; F2; F3; F4; F5; F6 or security elements 001 or security documents B comprising such gravure printing-based or intaglio-based security features F1; F2; F3; F4; F5; F6 are configured or can be configured.

Figure 9:
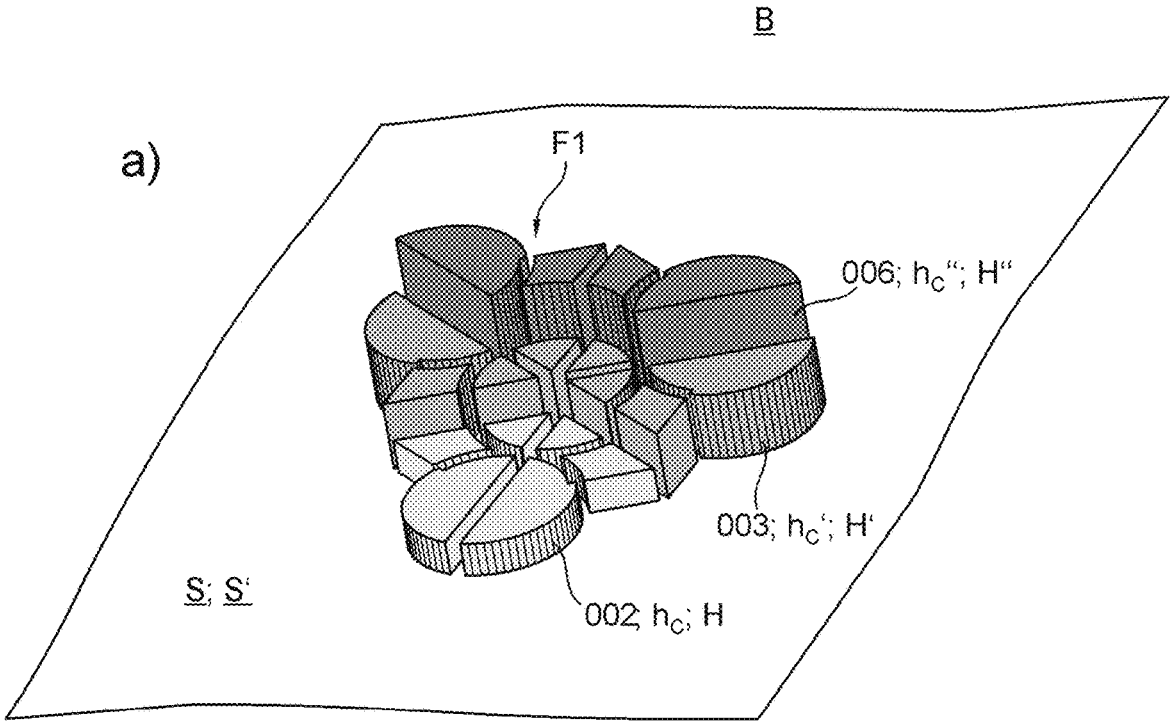
FIG. 9 an embodiment of a first group of embodiments for a security feature including image elements that are situated closely adjacent to one another and have significantly different ink film thicknesses a) in a perspective illustration and b) in a top view.
Figure 9:
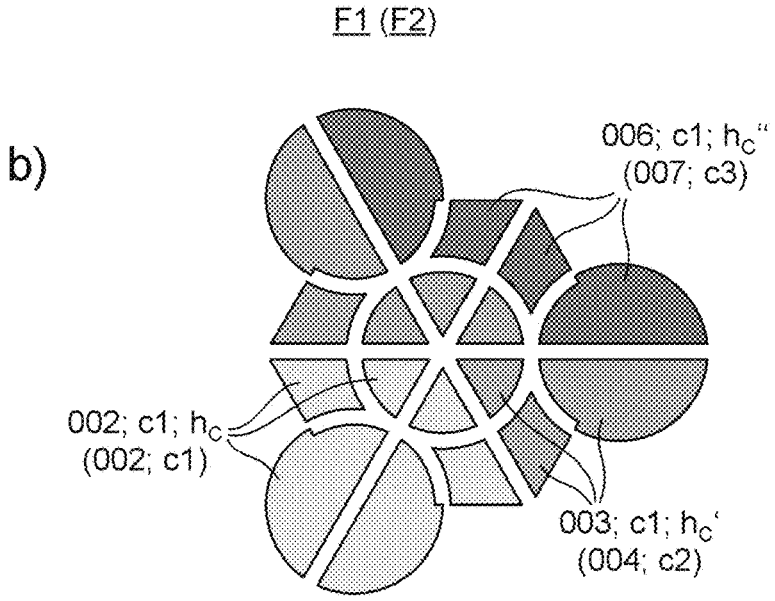

In a first group of embodiments for a security feature F1; F2, for example, two or more raised image elements 002; 003; 004; 006 are provided, which are adjacent to one another at least in pairs and which have an aforementioned maximum distance d; d', wherein, in a first embodiment, a plurality of image elements 002; 003; 006 that are adjacent to one another, e.g., within the above-described meaning, have different ink film thicknesses $h_C$; $h_C'$; $h_C''$, and, e.g., accompanying different overall heights H; H'; H". FIG. 9*a*) and FIG. 9*b*), for example, show by way of example a security feature F1 that was already indicated in FIG. 5, which comprises raised image elements 002; 003; 006 as parts or segments of a multi-piece pattern, serving as a motif, here, e.g., in the manner of a rosette or a kaleidoscope, which form ink film thicknesses $h_C$; $h_C'$; $h_C''$ and, e.g., heights H; H'; H" that differ from one another, and as a result form parts or segments of, in particular significantly, varying intensity, i.e., color shade of the same color c; c'; c", that are situated closely next to one another. In the example of FIG. 9, image elements 002; 003; 006 of three different ink film thicknesses $h_C$; $h_C'$; $h_C''$ are provided for the security feature F1, which, e.g., in increments of, e.g., in each case at least 20% of the smaller of two image elements 002; 003; 006 that are adjacent to one another and/or, for example, by at least 1 μm, advantageously at least 3 μm, preferably at least 5 μm. Two directly adjacent image elements of the three image elements 002; 003; 006 can even differ in their ink film thickness $h_C$; $h_C'$; $h_C''$ by at least 10 μm, in particular at least 20 μm. The overall height H' of the second image element 003 can, e.g., be greater by at least 20% and/or at least 3 μm than that of the first image element 002; 008, and the height H" of the third image element 006 can be greater by at least 20% and/or at least 20 μm than that of the second image element 003. In addition or instead, the ink film thickness $h_C'$ of the second image element 003 can, e.g., be greater by at least 20% and/or at least 1 μm than that of the first image element 002; 008, and the ink film thickness $h_C''$ of the third image element 006 can be greater by at least 20% and/or at least 10 μm than that of the second image element 003.

In the shown first embodiment of this group, the relevant image elements 002; 003; 006 or segments have the same color c1; c2; c3. This results in a variation of this color c1; c2; c3 in the color shade, i.e., a variation of the same color c1; c2; c3 in its perceived intensity or brightness. A graduation in the height H; H'; H" of image elements 002; 003; 006 of the same motif with different heights H; H'; H" can, for example, be a height H of 12±1 μm for image elements 002 of a first, e.g., smallest, height H, 15±1 μm for image elements 003 of a second, e.g., average, height H', and 40±5 μm for image elements 006 of a third, e.g., greatest, height H".

For the described embodiment as well as, unless defined otherwise, for other embodiments, as described herein, of image elements 002; 003; 006; 007; 008; 009 containing intaglio printing ink 517, a portion of the overall height H; H'; H" attributable to the printing ink 517 can, in an advantageous embodiment, be approximately one third, i.e., e.g., 33±3% of the height H; H'; H" of the raised image element 002; 003; 006; 007; 008; 009.

The three image elements 002; 003; 006 of the same motif or pattern having such different heights H; H'; H" can, e.g., each have a width of at least 120 μm, in particular at least 150 μm, and/or a distance with respect to one another of at least 50 μm, in particular at least 60 μm. In a second embodiment of this first group of embodiments, only hinted at in FIG. 9*b*) by parentheses, the security feature F2 includes a plurality of image elements 002; 004; 007 that are adjacent to one another and contain printing ink 517 of different colors c1; c2; c3. For example, the security feature F2 hinted at in FIG. 9*b*) comprises raised image elements 002; 004; 007 as segments of the multi-piece pattern, here, e.g., in the form of a rosette or a kaleidoscope, including different colors c1; c2; c3, such as, e.g., blue, purple and red.

In a third, mixed embodiment of the first group, both segments of different colors c1; c2; c3 and segments of different ink film thicknesses $h_C$; $h_C'$; $h_C''$ of the same color c1; c2; c3 or different colors c1; c2; c3 can be provided.

Instead of a pictorial pattern including planar segments of different, but, e.g., substantially constant, ink film thicknesses $h_C$; $h_C'$; $h_C''$, it is possible to provide a group of linear image elements 002; 003; 004; 006; 007; 008; 009, which run parallel to one another, next to one another, whose ink film thickness $h_C$; $h_C'$; $h_C''$ varies from image element 002; 003; 004; 006; 007; 008; 009; 011; 012 to image element 002; 003; 004; 006; 007; 008; 009; 011; 012, e.g., across the group of image elements 002; 003; 004; 006; 007; 008; 009; 011; 012, in a monotonic or fluctuating, for example wave-shaped, manner. In this way, an optical impression of a brightness or intensity that steadily increases or decreases or that fluctuates across the group of the relevant security feature F1 is provided or producible.

By way of example, further geometrical structures of such security features F1; F2 are shown in FIG. 5*b*) (denoted here by F1' or F2', and F1" or F2"), which are based on the basic structure from the first group of exemplary embodiments including adjacent raised image elements 002; 003; 004; 006; 007; 008; 009; 011; 012 of different colors c1; c2; c3; cS and/or of different ink film thicknesses $h_C$; $h_C'$; $h_C''$ or intensities and/or different heights H; H'; H", optionally having an ink film thickness $\tilde{h}_C$ and/or height $\tilde{H}$ that vary within the image element 008; 009; 012. The variants denoted by F1'; F1" or F2'; F2", unless explicitly addressed, are included here under the security features F1; F2 and not reported separately.

In a second group of embodiments for a security feature F3; F4; F5; F6 of a security element 001 or a security document B according to the invention, the feature encompasses a preferably optically variable image region comprising image elements 002; 003; 004; 006; 007; 008; 009; 011; 012 that are spaced apart, in particular closely spaced apart in the above-described manner, of an, in particular systematically, varying color c1; c2; cS and/or varying in the ink film thickness $h_C$; $h_C'$ and/or in the height H; H' or overall height H; H' and/or an ink film thickness $\tilde{h}_C$; $\tilde{h}_C'$ and/or height $\tilde{H}$; $\tilde{H}'$ varying within the image element 008; 009; 012. As a result of their variation in the color c1; c2; cS and/or in the ink film thickness $h_C$; $h_C'$ and/or in the height H; H' or overall height H; H' and/or an ink film thickness $\tilde{h}_C$; $\tilde{h}_C'$ and/or height $\tilde{H}$; $\tilde{H}'$ varying within the image element 008; 009; 012, a latent or variable image or pattern, as mentioned above, is created or formed, which constitutes or supplies image information that varies in terms of the color impression and/or in the image content, or an optically varying optical sensory impression, in particular color impression and/or color gradient, as a function of the aforementioned viewing angle $\phi$.

The security feature F3; F4; F4'; F5; F6; F6' comprises, e.g., a first group G1; G3 including a plurality, e.g., a number k of at least 5, in particular at least 10, preferably at least 30, of first raised image elements 002; 008 containing, at least on the upper side, gravure printing ink 517, in particular intaglio printing ink 517, of a first color c1, which are arranged one behind the other along a, for example, aforementioned functional direction $L_F$ that extends in the plane of the security element 001, and between which, e.g., k−1, for example at least nine, preferably at least 29, raised image elements 004; 009; 011; 012 of a second group G2; G4; G5; G6 having a color c2; cS different therefrom are provided. The image elements 004; 009 of the second group G2; G4 are provided, at least on the upper side, with gravure printing ink 517, in particular intaglio printing ink 517, of a second color c2, or the second group G5; G6 involves image elements 011; 012 that are embossed, e.g., using the gravure printing or intaglio process, in particular simultaneously with the production of the first image elements 002; 008, from the substrate S; S' to form the raised image elements 011; 012, but to which no gravure printing ink or intaglio printing ink 517 is or was applied in the process, and whose color cS is that of the unprinted or previously otherwise printed, for example by way of a different printing method, substrate S; S'. Even though these embodiments of the second group of exemplary embodiments are described here specifically based on only two groups G1; G2; G3; G4; G5; G6 of differently colored image elements 002; 004; 008; 009; 011; 012, they are not limited thereto, but, even if not explicitly denoted by respective reference numerals here, can also be applied to more than two groups of differently colored image elements 002; 003; 004; 006; 007; 008; 009; 011; 012.

The relevant security feature F3; F4; F4'; F5; F6; F6' can optionally comprise further image elements, beyond these groups G1; G2; G3; G4; G5; G6. For example, only a subarea of a security feature F3; F4; F5; F6 may be implemented by groups G1; G2; G3; G4; G5; G6 of image elements 002; 004; 008; 009; 011; 012 that are arranged and/or configured in the described manner, while other image elements can deviate therefrom in terms of configuration and/or arrangement. A security feature F3; F4; F5; F6 or image or pattern formed by such a mixed embodiment, e.g., then only supplies the desired effect in the region of the groups G1; G2; G3; G4; G5; G6 of image elements 002; 004; 008; 009; 011; 012 which are encompassed by this security feature and configured and/or arranged accordingly.

The alternating image elements 002; 004; 008; 009; 011; 012 of the first and second groups G1; G2; G3; G4; G5; G6, viewed in the or a functional direction $L_F$ on the security element 001 or security document B, in each case in pairs, e.g., have an aforementioned small distance d; d', i.e., in particular of no more than 1,000 μm and/or no more than ten times the greater height H; H', with respect to one another. Viewed in a functional direction $L_F$ of the security feature F3; F4; F5; F6 or the groups G1; G2; G3; G4; G5; G6 which extends in the plane of the security element 001 or security document B, the distances d; d' between first and second image elements 002; 008; 003; 009; 011; 012, i.e., in the direction of the first and second image elements 002; 004; 008; 009; 011; 012 alternating at the shortest distance d; d', and those between second and first image elements 004; 009; 011; 012; 002; 008, may differ from one another or, in an advantageous embodiment, may be the same. In general, the respective distances d; d' between first and second image elements 002; 008; 004; 009; 011; 012 and/or the distances d; d' between second and first image elements 004; 009; 011; 012; 002; 008 can vary within the relevant group G1; G2; G3; G4; G5; G6, but in an advantageous embodiment are the same in each case.

The term of the functional direction $L_F$ shall indicate a direction $L_F$ along which a corresponding arrangement and configuration of spaced image elements 002; 004; 008; 009; 011; 012 is present and, for example, is variably perceptible by tilting in the above-described manner. For image elements 002; 004; 008; 009; 011; 012 that, for example, extend in a linear and parallel manner, a multiplicity of functional directions $L_F$ that are inclined at different angles in relation to the extension of the image elements 002; 004; 008; 009; 011; 012, of which, for example, the one that includes first and second image elements 002; 004; 008; 009; 011; 012 which alternate at the shortest distance d; d' is referred to as the main functional direction $L_{FH}$. A viewing direction with a viewing angle $\phi$, whose projection onto the security element 001 coincides with such a main functional direction $L_{FH}$, supplies a particularly clear effect and/or the greatest contrast, for example, during tilting.

For at least some of the alternating image elements 002; 008; 004; 009; 011; 012 of the first and second groups G1; G2; G3; G4; G5; G6 or on at least a section of the security feature 001 comprising the groups G1; G2; G3; G4; G5; G6, the first and second image elements 002; 008; 004; 009; 011; 012 that are each situated adjacent to one another, in particular on their entire extension, or at least on a portion aligned in the functional direction $L_F$ of their, e.g., areal or linear, extension extending transversely to the functional direction $L_F$, have a difference in their height H; H' or overall height H; H', e.g., a difference in the height H; H' of at least 10 μm, preferably at least 20 μm, or, e.g., for a larger critical angle for changing the optical impression during a variation of the viewing angle, even at least 30 μm.

For example, on the entire length, or on at least a section, extending in the functional direction $L_F$, of the length determined by the groups G1; G2; G3; G4; G5; G6 of such alternating first and second image elements 002; 008; 004; 009; 011; 012, second image elements 004; 009; 011; 012 located between first image elements 002; 008 have a height H' or overall H' that is less, e.g., by at least 10 μm, preferably at least 20 μm, possibly even at least 30 μm, than that of the respective directly adjacent first raised image elements 002; 008 of the first group G1; G3, or vice versa, so that the image elements 002; 008; 004; 009; 011; 012 of the lesser height H'; H, for example at a steep, e.g., perpendicular viewing angle ϕ; $\phi_\perp$ onto the surface of the security element 001 or object B, are all and completely visible, while they, from a flatter viewing angle ϕ compared thereto, e.g., at less than 45°, in particular at less than 25°, are at least partially occluded by the adjacent raised image element 002; 008 of the other group G1; G3 and are thus not, or at least no longer completely, visible to the observer. By tilting the security element 001 or object B, in particular the banknote B, or by changing the viewing angle in another manner, a color impression, which is perceived by the changed superimposition of the involved colors c1; c2; cS, and/or an image or pattern thus changes, as a result of pieces of information that are transported by the lower image elements 004; 009 being shown and hidden, at least in the section containing image elements 002; 004; 008; 009; 011; 012 of different heights H; H'.

In general, it is possible for multiple pairs or even triples of groups G1; G2; G3; G4; G5; G6 that vary, in the above-described manner, in the color c1; c2; cS and/or the height H; H', and that differ, e.g., in the color combinations and/or the orientation of the functional directions $L_F$ and/or in the relative arrangement of the cooperating image elements 002; 003; 004; 006; 007; 008; 009; 011; 012, to be provided, which overall, for example, constitutes or supplies a two-dimensional, upon variation of the viewing angle and/or a rotation of the viewing direction about an axis that extends perpendicularly through the observed location and with respect to the plane of the security element 001 or security document B, a two-dimensional piece of image information that varies in the color impression and/or in the image content, or an optically varying sensory impression. The involved image elements 002; 003; 004; 006; 007; 008; 009; 011; 012 are effective in the manner of pixel-like image components situated at lower and higher levels which, depending on the variation of the viewing angle in relation to the security element plane or the surface of the security element 001 and/or depending on the variation of the viewing direction about an axis that is perpendicular to the security feature F1; F2; F3; F4; F5; F6, convey changing image information and/or sensory impressions. Image elements 002; 003; 004; 006; 007; 008; 009 of a first color c1, e.g., in a functional direction $L_F$, are spaced apart on both sides at the above maximum distance d; d' with respect to differently colored image elements 002; 003; 004; 006; 007; 008; 009; 011; 012. Such a two-dimensional pictorially variable security feature F3; F4; F5; F6 is, e.g., indicated by way of example in the upper third of FIG. 5*b*) and denoted by F3"; F4"; F5"; F6" as one of the variants to possible embodiments of the security features F3; F4; F5; F6, wherein such a two-dimensional multicolor intaglio pattern or such an intaglio structure made of differently colored image elements 002; 003; 004; 006; 007; 008; 009; 011; 012 conveys, or can convey, an image that changes in terms of content and/or sensory impression when tilting the security element 001 or security feature B within the above-described meaning. Unless an explicit distinction is made and special reference is made thereto, the variants denoted by F3"; F4"; F5" and F6" in FIG. 5*b*) are listed here as one of the variants among the security features F3; F4; F5; F6 and are not reported separately.

In an advantageous embodiment that is, e.g., easy to produce and/or perceive, first and second image elements 002; 004; 008; 009; 011; 012 of the first and second groups G1; G2; G3; G4; G5; G6 have a linear configuration and extend parallel to one another. For example, they have a length that is greater by at least ten times, preferably at least fifty times, than their width b; b'. They preferably extend in a linear and parallel manner, preferably rectilinearly or, optionally, depending on the effect to be achieved, e.g., in parallel wave or zigzag lines or other elongated, irregular, or preferably regular, shapes. The width b; b' of such linearly extending image elements 002; 004; 008; 009; 011; 012 is, e.g., no more than 1,000 μm, advantageously no more than 500 μm, in particular no more than 300 μm and/or at least 10 μm, advantageously at least 100 μm, in particular at least 200 μm. The effect here is caused, e.g., by image elements 002; 004; 008; 009; 011; 012 that only alternate in one direction $L_F$, namely in the main functional direction $L_{HF}$, and can, e.g., be considered to be one-dimensional.

Of the relevant security element 001 or even of the same security feature F3; F4; F5; F6, multiple regions or fields of image elements 002; 004; 008; 009; 011; 012 of first and second groups G1; G2; G3; G4; G5; G6, which are arranged so as to vary two-dimensionally in the surface area and/or one-dimensionally along the main functional direction $L_{HF}$ and which have heights H; H'; H"; $\tilde{H}$; $\tilde{H}$' and/or colors c1; c2; c3; cS that differ and/or vary within the group G1; G2; G3; G4; G5; G6 and/or along the image element 008; 009; 012, can be provided.

In a rectilinear and parallel configuration of the linear image elements 002; 004; 008; 009; 011; 012, the aforementioned main functional direction $L_{HF}$ extends perpendicularly to the longitudinal extension of the linear image elements 002; 004; 008; 009; 011; 012, even though, for example, the effect of the variable image or pattern can be perceptible from viewing directions, possibly with decreasing contrast, whose projection onto the plane of the security element 001 is pivoted by an acute angle in relation to the main functional direction $L_{HF}$ about the axis that is situated perpendicular to the security feature F1; F2; F3; F4; F4'; F5; F6; F6'.

In a first embodiment, which is not shown, of this second group of embodiments, a fixed height H is provided for the image elements 002 of the first group G1 assigned to the security feature F3, and a height H' that deviates therefrom, e.g., is smaller or greater by at least 10 μm, preferably at least 20 μm, possibly even at least 30 μm, is provided for the image elements 004; 011 of the second group G2; G5. In the case of a perpendicular viewing angle $\phi_{\perp}$, the overall image is perceived from the colors c1; c2; cS of the first and second image elements 002; 004; 011 and of the trough situated therebetween, while, starting a certain smaller viewing angle $\phi$, the image information or color c1; c2; cS that is present in the trough and supported by the image elements 002; 004; 011 of a smaller height H; H' increasingly disappears. The image elements 002; 004; 011 can, in general, be configured in any arbitrary shape, preferably however linearly within the above meaning, and in particular rectilinearly.

In the first embodiment, the differently colored raised image elements 002; 004; 11 of the first and second groups G1; G2; G5 can have consistent heights H; H' across the respective group G1; G2; G5 and, at least with respect to the or a functional direction $L_F$, can have the same distance d; d' with respect to one another, so that, during tilting or when changing the viewing angle $\phi$, the color impression and/or image change simultaneously and equally in the entire affected region.

Figure 10:
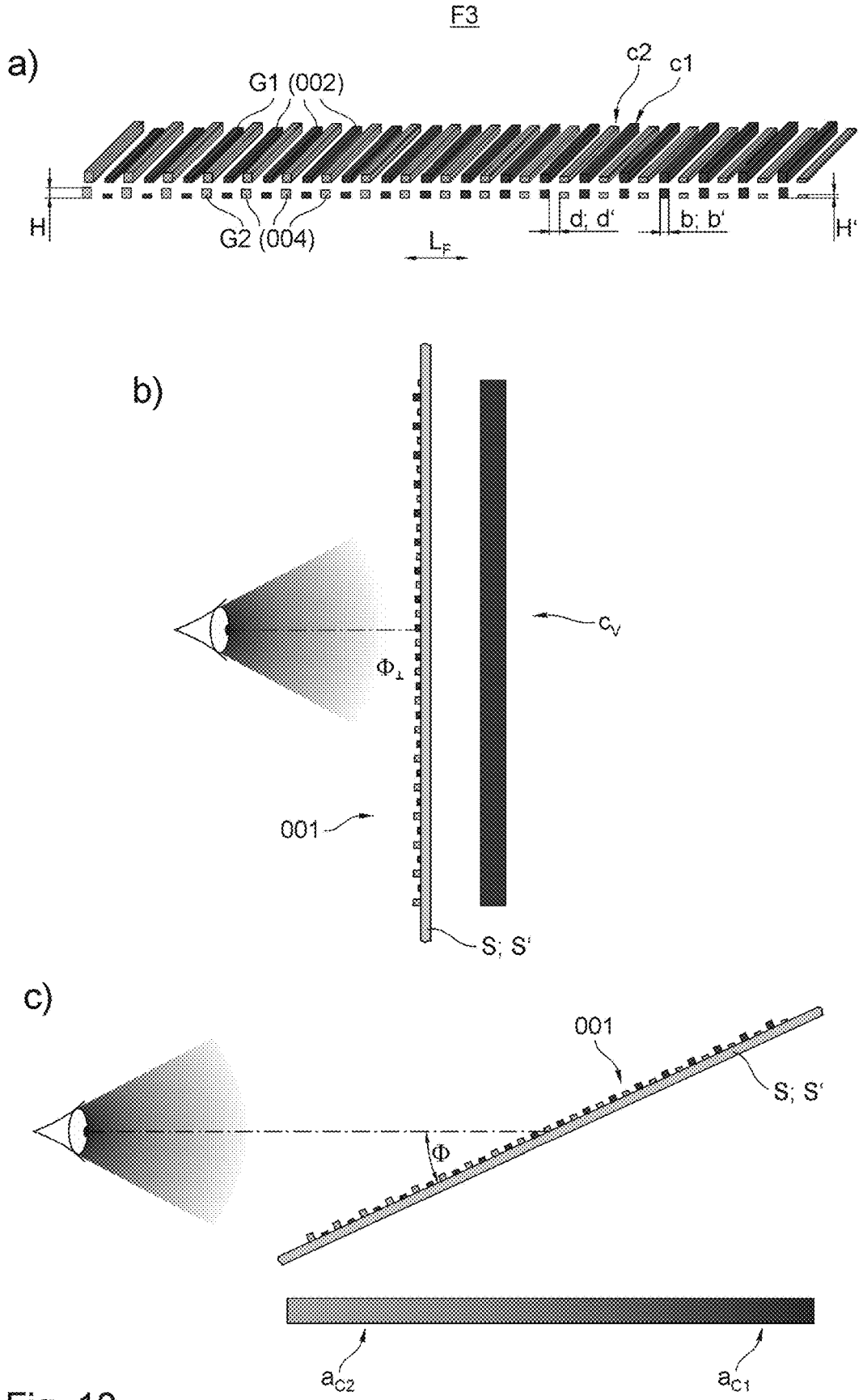
FIG. 10 a schematic illustration of an embodiment of a second group of embodiments for a security feature including image elements that are situated closely adjacent to one another and have different colors, having different and/or varying heights across the image elements, a) in a perspective illustration, b) in a side view from a perpendicular viewing angle, and c) from an acute viewing angle.

In an advantageous second embodiment of the second group of embodiments, however, the ratio between the heights H; H' of the respective adjacent raised first and second, preferably linearly and, e.g., rectilinearly configured image elements 002; 004; 011 can vary over the groups G1; G2; G5 of alternating first and second raised image elements 002; 004; 011, viewed in the or a functional direction $L_F$ (see, e.g., FIG. 10). In a first configuration of the second embodiment, a height H; H' of the raised image elements 002; 004; 011 of one of the groups G1; G2; G5 can have a consistent height H; H' over the relevant group G1; G2; G5, while the height H'; H of the image elements 004; 011; 002 offset thereto from the other group G2; G5; G1 varies in the functional direction $L_F$ across the extension of the relevant group G2; G5; G1. The variation can be monotonically, in particular linearly, increasing or decreasing, or may also fluctuate, for example be wave-shaped across the group G2; G5; G1.

Figure 12:
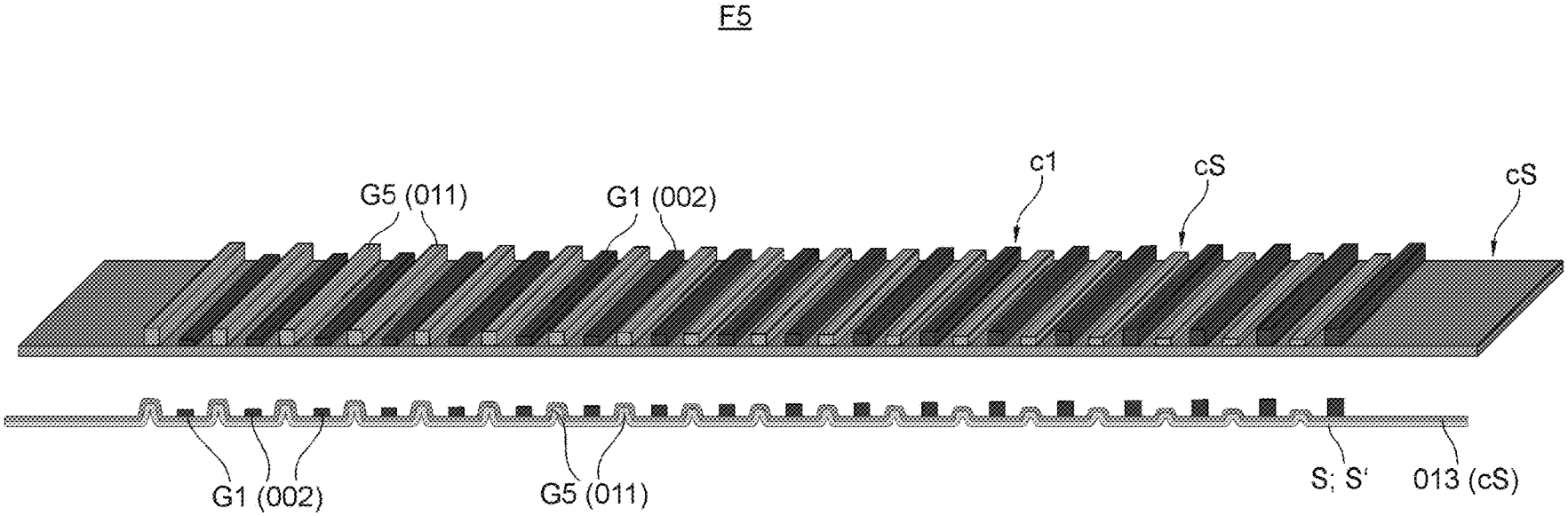
FIG. 12 a schematic illustration of an embodiment of the second group of embodiments for a security feature including image elements that are situated closely adjacent to one another and have different colors, having different and/or varying heights across the image elements, a) in a perspective illustration, b) in a side view from a perpendicular viewing angle, and c) from an acute viewing angle, wherein the color of one of the groups of image elements is determined by that of the substrate.
Figure 13:
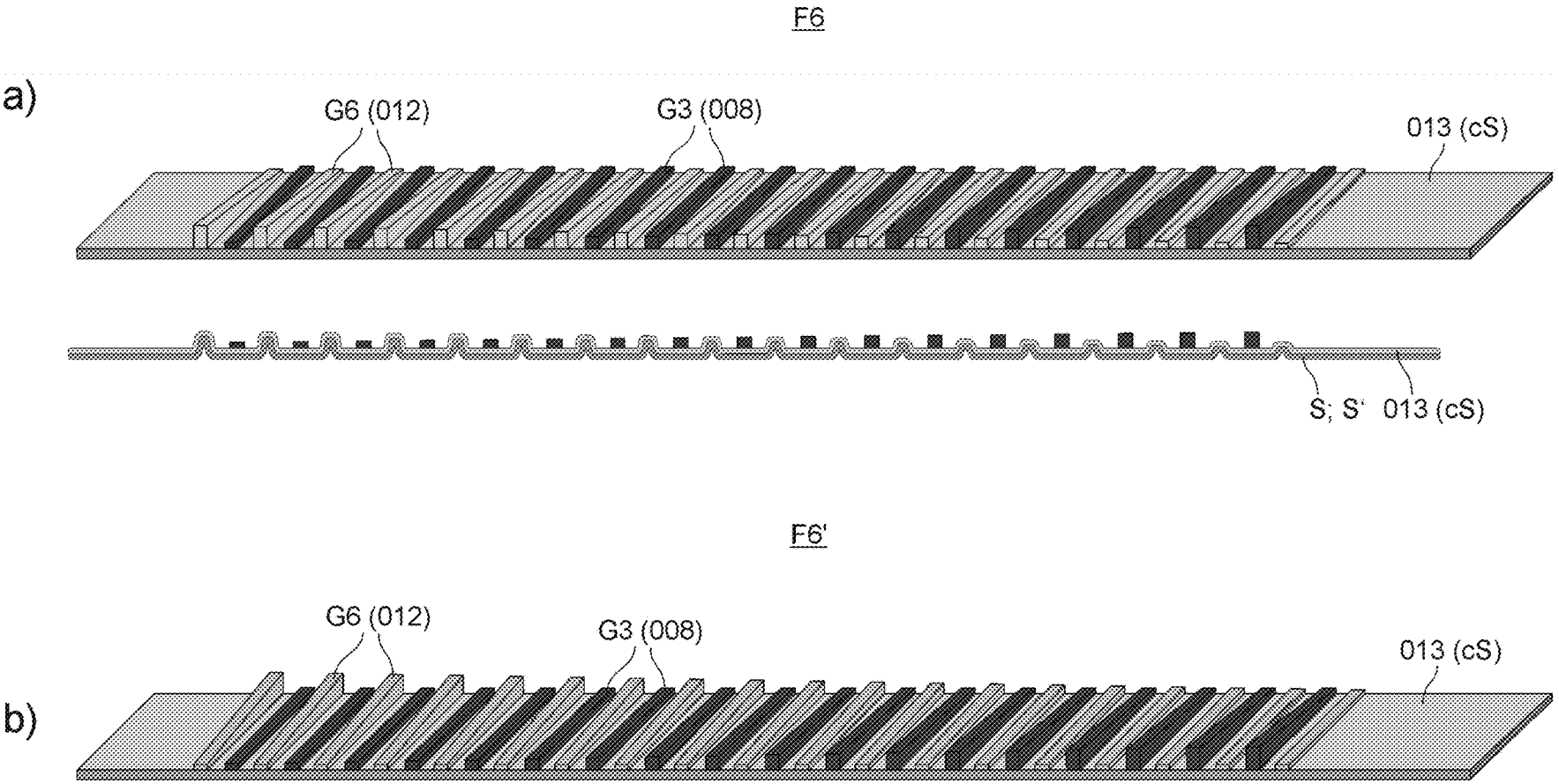
FIG. 13 a schematic illustration of another embodiment of the second group of embodiments for a security feature including image elements that are situated closely adjacent to one another and have different colors, having heights that vary across the image elements and additionally across their extension, a) in a first relative orientation and b) in a second relative orientation in the variation, wherein the color of one of the groups of image elements is determined by that of the substrate.

In the advantageous second configuration of the second embodiment shown here, e.g., in FIG. 10*a*) and FIG. 12, the heights H; H' of the differently colored image elements 002; 004; 011 vary in each case in an opposing manner across the two groups G1; G2; G5, i.e., while the heights H of the one group G1 of image elements 002 increase in the functional direction $L_F$ across the group G1, the height H' of the image elements 004; 011 of the other group G2; G5 situated therebetween decreases. From a perpendicular viewing angle $\phi=90°=\phi_{\perp}$, a color impression $c_v$, in particular color gradient $c_v$, is conveyed to the observer as a result of the superimposition of the at least two colors c1; c2; cS on the raised image elements 002; 004; 011 and, e.g., additionally of the printed or unprinted substrate S; S' situated between two raised image elements 002; 004; 011 that, e.g., in one variant, are provided with gravure printing ink 517, in particular intaglio printing ink 517, of two colors c1; c2; cS (e.g., schematically shown in FIG. 10*b*). From a smaller viewing angle $\phi$, the different and/or varying relative height H; H' results in a transition that, depending on the progression of the variation, is more or less rapid and/or pronounced, from a color impression $c_v$ that is determined by all involved colors c1; c2; cS toward a color gradient $c_v$, with at least one section $a_{C1}$ that is determined or at least dominated by one of the colors c1; c2; cS and, possibly at least one section ace that is determined or dominated by another color c2; cS; c1. Depending on the viewing angle $\phi$, the influence of the background provided by the color cS of the substrate S; S' between the raised image elements 002; 004; 011 may play an increasingly lesser role with a decreasing viewing angle $\phi$. In an embodiment including raised image elements 002; 004 containing gravure printing ink 517, in particular intaglio printing ink 517, of two colors c1; c2, the portion of the color cS determined by the substrate S; S' disappears, e.g., with a decreasing viewing angle $\phi$, and, in contrast, in an embodiment including image elements 011 of one of the groups G5 containing only the second color cS determined by the substrate S; S' (see, e.g., embodiment of the security feature F5 according to FIG. 12), i.e., without separately applied gravure printing ink or intaglio printing ink, the portion of the color cS determined by the substrate S; S', e.g., decreases comparatively less quickly with a decreasing viewing angle $\phi$.

Figure 11:
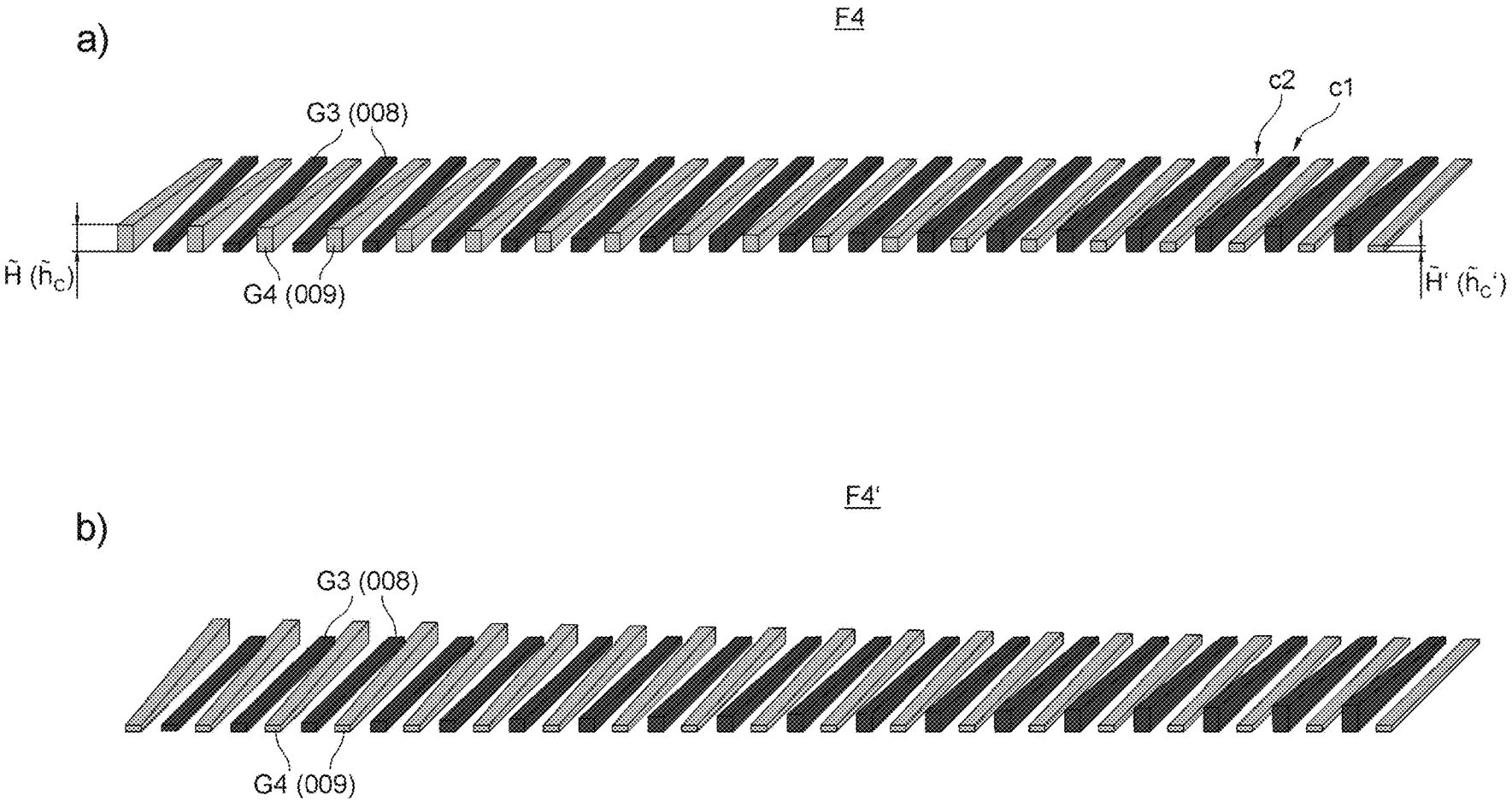
FIG. 11 a schematic illustration of another embodiment of the second group of embodiments for a security feature including image elements that are situated closely adjacent to one another and have different colors, having heights that vary across the image elements and additionally across their extension, a) in a first relative orientation and b) in a second relative orientation in the variation.

In a third embodiment from the second group of embodiments (see, e.g., FIG. 11 and FIG. 13, by way of example), the security feature F4; F6 comprises a first group G3 of first, linear image elements 008, which bear gravure printing ink 517, in particular intaglio printing ink 517, of a first color c1 and, across their longitudinal extension, have an ink film thickness $\tilde{h}_C$ and/or height $\tilde{H}$ that varies in a step-like manner or preferably continuously, e.g., in a monotonic or fluctuating manner. The ink film thickness $\tilde{h}_C$ and/or height $\tilde{H}$ preferably vary monotonically and/or, in particular, linearly. Within the relevant image element 008, the ink film thickness $\tilde{h}_C$ varies, for example, by at least 5 μm, preferably by at least 10 μm, in particular by at least 20 μm. A height $\tilde{H}$, with or without gravure printing ink applied, likewise, for example, varies by at least 5 μm, preferably by at least 10 μm, in particular by at least 20 μm.

In a first configuration of this third embodiment, raised image elements 004; 011 of a second group G2; G5 having a different color c2; cS are in each case provided between the first, in particular linear, raised image elements 08 that vary, e.g., monotonically and/or linearly, in their ink film thickness $\tilde{h}_C$ and/or height $\tilde{H}$, which, in a first variant, can all have the same height H', and, in a second variant, have a height H' that varies across the group G2, but is constant over the respective image element 04, such as e.g., for the configuration according to FIG. 10*a*), for two different gravure printing inks 517, in particular intaglio printing inks 517, of different colors c1; c2, and shown in FIG. 12 for first image elements 002 containing gravure printing ink 517, in particular intaglio printing ink 517, of a first color c1, and only embossed second image elements 011 of a color cS of the substrate S; S'.

In a second configuration of this third embodiment, in particular linear image elements 009; 012 of a second group G4; G6 having a different color c2; cS, which likewise in each case vary in their ink film thickness $\tilde{h}_C$ and/or height $\tilde{H}$, are provided between the first, in particular linear, image elements 008 of the first group G3, which vary in their ink film thickness $\tilde{h}_C$ and/or height $\tilde{H}$. These can generally vary in their height $\tilde{H}$ in a manner that is arbitrary, but different so as to achieve variation of the first image elements 008, so that progressions in the height that differ from one another result between a first and an adjacent second image element 008; 09 on adjacent sections. The variation in the height $\tilde{H}'$ of the second image elements 009; 012 is preferably opposite to the variation in the height $\tilde{H}$ at the first image elements 008, in particular likewise monotonic and/or, in particular, inversely linear.

In a third, special configuration of this third embodiment, the image elements 008; 009; 012 of the first and second, differently colored group G3; G4; G6, similarly to what is described in the preceding second configuration, vary in their ink film thickness $\tilde{h}_C$ and/or height $\tilde{H}$, preferably monotonically and/or, in particular inversely linearly, wherein, however, additionally the maximum of the respective varying height $\tilde{H}$ varies across the relevant group G3; G4; G6 (see, e.g., FIG. 11 and FIG. 13). In a first variant, the maxima for the ink film thicknesses $\tilde{h}_C$ and/or heights $\tilde{H}$ of the first and second raised image elements 008; 009; 012 can be provided on the side of the same end of the linear image elements 008; 009 (see, e.g., security feature F4 or F6 in FIG. 11*a*) or FIG. 13*a*)) or in a second variant, they can be provided on the mutually opposing sides (see, e.g., the variant of the security feature F4 or F6 in FIG. 11*b*) or FIG. 13*b*) denoted there by security feature F4' or F6').

In a particularly advantageous configuration for the above exemplary embodiments, embodiments and configurations comprising raised image elements 008; 009; 011 having a varying ink film thickness $\tilde{h}_C$ and/or height $\tilde{H}$, these are preferably linearly, in particular rectilinearly, configured, and have a wedge-like progressing shape over their length, wherein the upper side can be convex, concave or advantageously planar over the length.

In principle, the teaching of the aforementioned embodiments comprising two groups G1; G2; G3; G4; G5; G6 having different and/or varying heights H; H'; H" is to be applied to three or more groups G1; G2; G3; G4; G5; G6 of image elements 002; 003; 004; 006; 007; 008; 009; 011; 012 of different colors c1; c2; c3; cS and of different and/or varying heights H; H'; H" which are adjacent in pairs, in particular spaced apart at the above-described small distance d; d', which are configured and arranged in a functional direction $L_F$ in such a way that, during tilting, for example, the color information and/or image information to be perceived changes in the above-described manner, however based on one or more additional colors.

For the embodiments comprising, in particular, two, or possibly more, groups G1; G2; G3; G4; G5; G6 of differently colored image elements 002; 003; 008; 009; 011; 012, a maximum distance d; d' between at least two image elements 002; 007; 008; 009 to which gravure printing ink 517, in particular intaglio printing ink 517, of the same color c1; c2; c3 has been applied, between which, in particular one, or possibly at least one, image element 004; 006; 002; 009; 008; 011; 012 of a different color c2; c3; cS is provided, is, e.g., no more than 2,000 μm, in particular no more than 1,200 μm, for example no more than 1,000 μm, and/or, e.g., no more than twenty times, in particular no more than ten times, a highest elevation of the, or possibly of the higher of the two, spaced-apart image elements 002; 003; 004; 006; 007; 008; 009; 011; 012 of the same first color c1; c2; c3.

In variants of the embodiments comprising image elements 011; 012 that are or have been configured without intaglio printing ink 517, the substrate S; S' is of a different color, for example in the region of relevant image elements 011; 012, than the adjacent image elements 002; 003; 004; 006; 007; 008; 009 to which intaglio printing ink 517 has been applied, and also of a different color in relation to the adjacent troughs. For this purpose, the substrate S; S' is treated differently, e.g., in the region of the troughs and in the region of the image elements 011; 012 that are only embossed, e.g., both are provided with different colors, or are only provided in the region of the troughs or only in the region of the embossed image elements 011; 012 with a color that differs from the unprinted substrate color. Preferably, before the substrate S; S' is treated according to the intaglio method, the relevant areas are coated, in particular printed, in a different color with corresponding, for example aforementioned, printing ink, which differs from the intaglio printing ink 517, according to another, e.g., an aforementioned printing method. As a result of the embossing process, the image elements 011; 012 that are unprinted, or have previously been printed in a different color, are then formed, while the troughs adjacent to the adjoining image elements 002; 003; 004; 006; 007; 008; 009; 011; 012 remain in a different color or are printed.

In general, regardless of the above-described embodiment, according to which different and/or varying heights H; H' are present and result in at least partially varying patterns or images, however, preferably in conjunction therewith, multicolor intaglio patterns are formed or can be formed by a plurality of first and further, differently colored image elements 002; 003; 004; 006; 007; 008; 009; 011; 012, in which individual first image elements 002; 008 are surrounded on multiple sides by differently colored image elements 003; 004; 006; 007; 009; 011; 012 in such a way that, as a result of their arrangement, a multicolor intaglio print image having a color resolution, i.e., a distance between image elements 003; 004; 006; 007; 009; 011; 012 of different colors c1; c2; c3; cS of 1,000 μm or less is present at least in some areas. The differently colored image elements 002; 004; 006; 007; 008; 009; 011; 012 can have the same height or different heights H; H'.

A printing press, in particular security printing press, that is particularly suitable for producing a, in particular such a, security-relevant object B, in particular security document B, or a security element 001 present thereon or to be applied thereto, comprises at least one printing unit 500, in particular gravure printing unit or, in particular, intaglio printing unit 500, by way of which substrate S; S' can be printed at least according to a gravure printing method. The substrate S; S' can be the substrate S which forms the basis for the later security document B, e.g., a fiber-based or polymer-based print substrate S, or possibly a carrier substrate S' acting as a carrier for the security element 001. The printing press comprises a substrate infeed 100, for example, by which the substrate S; S' to be printed can be fed to the printing press on the input side, a first conveyor line 200 by which the substrate S; S' can be fed to the at least one printing unit 500, a product receiving unit 400 by which the substrate S; S' that has been printed on at least one side can be combined into bundles, and a second conveyor line 300 by which the substrate S; S' can be fed, optionally via additional processing units, to the product receiving unit 400.

The printing press is configured, e.g., as a sheet-fed printing press, in particular as a sheet-fed gravure printing press, preferably as a sheet-fed printing press that prints in an intaglio printing process. The intaglio printing method or steel engraving method is a gravure printing method that is preferably used during the industrial production of security elements 001 on or for security-relevant objects B, e.g., security documents B, e.g., banknotes B.

The printing press is preferably configured as a sheet-fed printing press, in particular as a sheet-fed gravure printing press, preferably as a sheet-fed printing press that prints in an intaglio printing process.

Figure 1B:
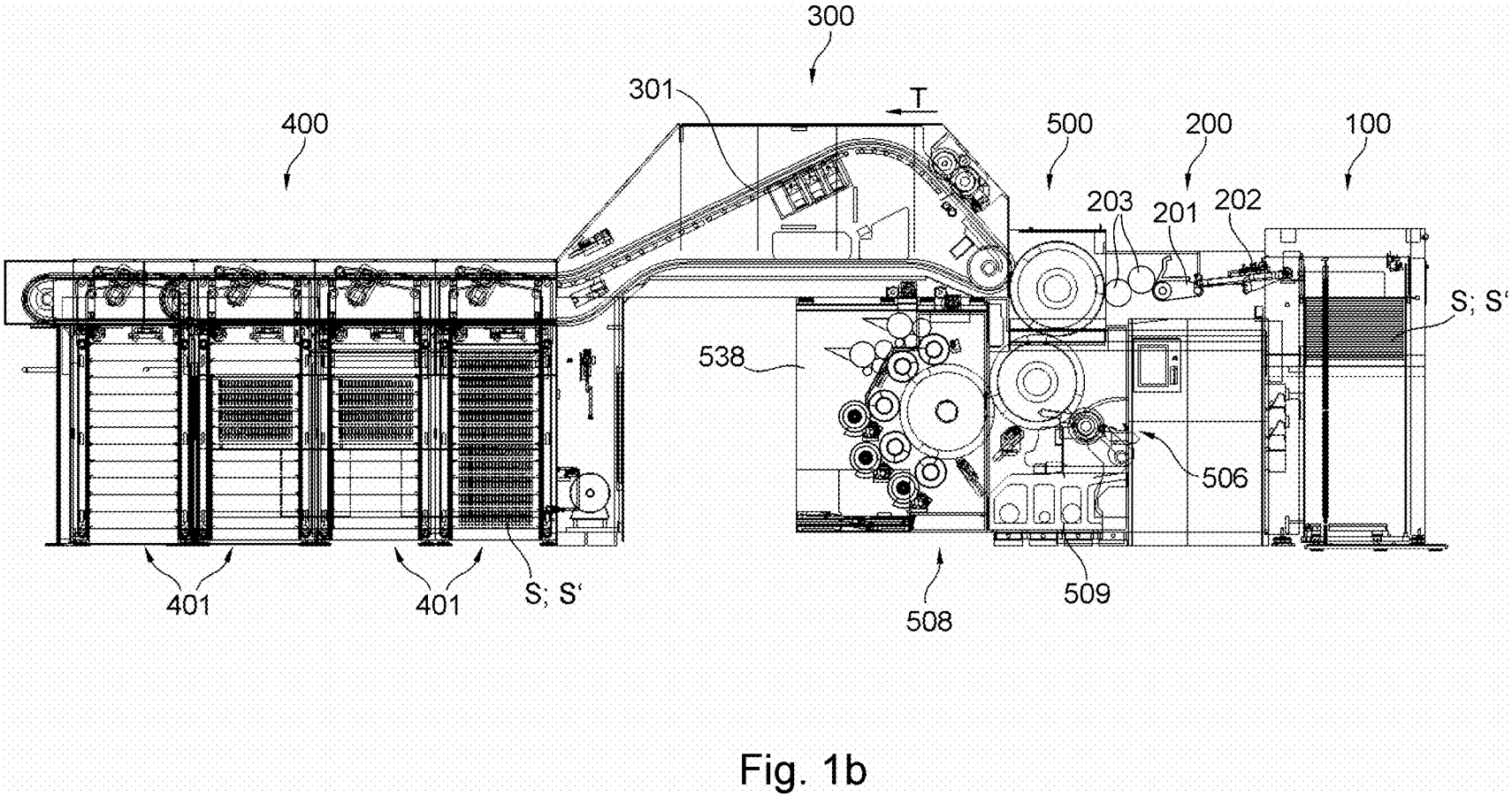
FIG. 1*b* a side view of a printing press, in particular a gravure printing press in a second embodiment.

The printing press, which preferably prints by a gravure printing process, in particular in an intaglio printing process, in a preferred embodiment as a sheet-fed printing press, comprises the at least one printing unit 500, in particular gravure printing or in particular intaglio printing unit 500 that operates according to a gravure printing process, in particular an intaglio printing process, along with preferably at least one substrate infeed 100 embodied as a sheet feeder 100, by means of which a substrate S; S' to be printed, in the form particularly of stacked substrate sheets S; S', e.g. printing substrate sheets S, in particular security paper sheets S; S', is or at least can be provided on the input side of the printing press. The edges of the rectangular substrate sheets S; S' measure, e.g., between 475×450 mm and 700×820 mm; the grammage of the substrate sheets S; S' is, e.g., between 70 g/m$^2$ and 120 g/m$^2$. The printing press furthermore comprises, as part of the first conveyor line 200, a sheet infeed 201, by means of which substrate sheets S; S' furnished at the sheet feeder 100 are or at least can be fed, e.g. via conveying means 202 and/or one or more transfer drums 203, to the or a first printing unit 200 of the printing press in series, i.e. individually in succession. A rocking gripper system is preferably provided for transferring the substrate sheets S; S' to the first transfer drum 203. Downstream of the or a last printing unit 500, the printing press furthermore comprises, e.g., a transport device 301 comprised by the second conveyor line 300 and configured, for example, as a revolving conveyor belt or as a revolving chain system, in particular a chain gripper system, to which the substrate sheets S; S' that have been printed at least by the printing unit 500 are transferred directly or via at least one or more intermediate cylinders comprised, e.g., by the second conveyor line 300, wherein substrate sheets S; S' that have been transferred to the transport device 301 are or at least can be transported by means of this device to a downstream processing unit or to a product receiving unit 400, configured as delivery 400, in this case pile delivery 400, e.g. multi-pile delivery, where they are or at least can be deposited. In the embodiment of FIG. 1*a* and FIG. 1*b*, the pile delivery 400 comprises, e.g., four piles or pile spaces 401 arranged one behind the other, as viewed in the transport direction T of the substrate sheets S; S'. In the region of the transport device 301, an e.g. optoelectronic, preferably camera-based inspection system (not denoted) may be provided, by means of which the quality of the printed substrate sheets S; S' is or at least can be checked. The substrate sheets S; S' are inspected in particular to ensure that they are free of defects as compared with a designated master. Depending on the results of this inspection, the substrate sheets S; S' are then deposited on a designated pile in the multi-pile delivery.

In the case of a printing press configured as a web-processing press, the printed images of a certain printing length are formed not as substrate sections S; S' formed by substrate sheets S; S,' but as substrate sections S; S' formed by repeating lengths arranged in a row, which are then or can then be wound to form a product roll or cut into substrate sheets S; S' and stacked.

Generally, the at least one printing unit 500 operating according to a gravure printing method can be provided with one or more additional printing units operating by the same printing method or by different printing methods in the first and/or second conveyor line 200; 300.

The printing unit 500 operating according to a gravure printing method, in particular an intaglio printing method, hereafter also referred to as gravure printing unit 500, in particular as recess printing unit 500 or intaglio printing unit 500, comprises at least one printing unit cylinder 501, also acting and/or designated as an impression cylinder 501, and a printing unit cylinder 503 that forms a printing nip 502 with the impression cylinder 501 and is embodied as a forme cylinder 503 for gravure printing, in particular an intaglio printing cylinder 503, wherein the impression cylinder 501 and the forme cylinder 503 preferably are or at least can be thrown onto one another under high pressure. In the embodiment as a printing press for processing sheet-format substrate S; S', the impression cylinder 501 preferably comprises on its circumference one or m axially extending cylinder channels, each including a holding means, e.g. a gripper bar, by which the sheet-format substrate S; S' resting on the impression cylinder 501 can be conveyed through the printing nip 502. On its circumference, the forme cylinder 503 carries one or more printing formes 504 having a pattern of recesses 514 that form the basis of the print image to be printed, e.g. motif, hereafter also referred to synonymously, where not explicitly otherwise specified, as "engravings" 514, regardless of their method of production. Unless explicitly distinguished, the printing forme 504, in particular gravure printing forme 504, is to be understood both as an outer circumferential surface of the cylinder itself that comprises the recesses 514 or engravings 514, and in a preferred embodiment as a printing forme 504 that comprises the recesses 514 or engravings 514 and is or can be detachably arranged on the forme cylinder 503, e.g. as a printing plate 504 or optionally as a printing forme sheath. The forme cylinder 503 is preferably configured to be "multiple sized", e.g. m-sized, (with m ε ℕ ≤5, in particular m≤3), e.g. triple-sized, and is configured to accommodate m, e.g. m=3, printing formes 504 in a row and/or for printing m, e.g. m=3, print lengths, in particular for accommodating and/or printing multiple, e.g. m=3, substrate sheets S; S' per revolution. The engravings 514 are preferably provided in an outer metal layer of the printing forme 504, which is or has been coated with a hard metallic material, in particular with chrome, after the engravings 514 have been introduced.

A depth x; x' of the raised engravings 514 on the forme cylinder 503, for example on at least a section or on at least a lowest point of the engraving 514, is, e.g., at least 5 μm, in particular at least 10 μm, advantageously at least 20 μm, and/or, e.g., no more than 200 μm, in particular no more than 150 μm, advantageously no more than 100 μm. In particular, the depth x, on at least a section or at a point of the engraving 514, is for example, in a range of 10 μm to 150 μm. The recesses 513 on the gravure inking cylinder 519 corresponding to recesses 514 of different depths x; x' on the forme cylinder 503 have, e.g., a depth that is different, in particular greater, by at least 5 μm.

Preferably, the printing unit 500 or the printing press for printing the substrate S, in particular the substrate sheet S, is configured with multiple copies. The overall image applied to a printing length or repeat length and/or assigned to a substrate sheet S; S' or substrate section S; S' is preferably formed by the print images of a plurality of copies $N_i$, e.g. banknotes $N_i$, to be printed in multiple columns side by side and in multiple rows one after another onto the substrate S; S'. The engraving pattern of a printing forme 504 assigned to the printing length is therefore formed by a corresponding multiplicity of patterns of recesses, e.g. motif engravings, in particular with the identical motif, arranged in matrix form in columns and rows. Generally, a number of first rows or columns containing a plurality of first patterns of recesses 514 of first copies $N_i$, e.g. banknotes of a first currency and/or a first value, and a number of second rows or columns containing a plurality of second patterns of recesses 514 of second copies $N_i$, e.g. banknotes of a second currency, can also be comprised on a printing length or printing forme 504.

The print image to be printed by the printing unit 500 can generally comprise a single image motif that extends, e.g., over the entire printing width and length, i.e. over one substrate section S; S'. In the case that is preferred here, however, which involves printing a plurality of copies $N_i$ per substrate section S; S', the same image motifs are printed onto each of at least a plurality of copies $N_i$, preferably onto all copies $N_i$. Such an image motif may be a spatially isolated print image region with complete image information, as is found in portraits, cultural sites, objects of daily use, landscape details, or the like. Alternatively, the image motif may be composed of alphanumeric information or of a regular or irregular pattern, e.g. without actual meaningful representational content. An image motif may also be a combination of the aforementioned characteristics. In a particularly advantageous embodiment, the image motif to be printed in the gravure or intaglio printing method can be a security feature or a portion of such a feature, which is, for example, by a particularly high resolution in terms of the ink intensity and/or ink density of, in particular raised, lines or print elements, that are applied in the gravure or intaglio printing process.

It is also possible for multiple such image motifs, spatially separated from one another, to be provided per copy $N_t$.

To remove excess ink, a removal device 506, e.g. a wiping device 506 comprising a wiping cylinder 507, is or at least can be set against the forme cylinder 503. The wiping cylinder 507 is coated on its outer cylindrical surface, e.g., with a plastic material.

The forme cylinder 503 or a printing forme 504 provided thereon can be inked with one or preferably with multiple colors by an inking unit 508. The inking unit 508 can be mounted so as to be movable as a whole or in sections away from the preferably stationary printing unit part 509, which comprises the printing unit cylinders 501; 503 that form the printing nip 502, and/or can even be configured as separable therefrom.

The inking unit 508 comprises, at its upstream end as viewed in the direction of ink transport within the inking unit 508, an inking device 511, which is or can be supplied with printing ink 517 by an ink feed system, for example, and by means of which an inking unit cylinder 512, e.g. a first inking unit cylinder, can be inked. The inking unit cylinder 512 comprises recesses 513 in the region of its outer cylindrical surface 518, hereafter also referred to synonymously, where not explicitly specified, as "engravings" 513, regardless of their method of production, which correspond to the engravings 514 or some of the engravings on the printing forme 504 of the forme cylinder 503. This does not mean that they must have the same dimensions and the same depth z as the corresponding engravings 514, but that their shape and/or depth x; z are in a defined relationship to one another that is obtained, for example, based on regularities that are established or are to be established. For engravings 513 on the inking unit cylinder 512, a greater width b513, e.g. than line width b513, and/or a greater depth z is preferably provided than for the corresponding engravings 514 on the forme cylinder 503 or the printing forme 504 comprised or carried by the same.

For at least some of the recesses 514 on the forme cylinder 503, for example, corresponding recesses 513 on the gravure inking cylinder 512 are greater on all sides of the recess 513, for example, by at least 20 μm and/or by no more than 200 μm, advantageously by at least 50 μm and/or no more than 150 μm, in particular by 80 to 120 μm, preferably by 100±5 μm than the corresponding recesses 514 on the forme cylinder 503. Thus, for at least some of the recesses 514 on the forme cylinder 503, a width b513 or line width b513 on the gravure inking cylinder 512 is greater, e.g., by at least 40 μm and/or no more than 400 μm, advantageously by at least 100 μm and/or no more than 300 μm, in particular by 160 to 240 μm, preferably by 200±10 μm, than that of the corresponding recess 514 on the forme cylinder 503. Narrow line structures on the printing forme 504 can in some cases merge to form larger engraved areas, for example, on the inking unit cylinder 512 comprising the engravings 513. When there is a partial merging of engravings 513, e.g. two or more such partially contiguous recesses 513 are contiguous due to an aforementioned larger size as compared to the recesses 514 on the forme cylinder 503 and, e.g., only narrow spacing, wherein the recesses 513 are apparent at least on a non-merged longitudinal section, for example. There may also be areas of recesses 513 that are merged in this way, so that as a result of the larger size and due to a high line density on the forme cylinder 503, individual recesses 513, e.g. situated in the interior of such an area, are no longer apparent in isolation. Nevertheless, in the following such overlapping recesses 513 on the gravure inking cylinder 512, which in this case are overlapping due to a transfer of the individual recesses 514 on the forme cylinder 503 in accordance with a regularity, are likewise regarded as corresponding to recesses 514 on the forme cylinder 503.

For the sake of simplicity, the inking unit cylinder 512 that comprises the recesses 513 configured as engravings 513 is also referred to synonymously, where not explicitly specified, as a "gravure inking cylinder" 512, regardless of the method by which the recesses 513 are produced.

The outer diameter of the gravure inking cylinder 512 is preferably in a ratio of 1:n in relation to the outer diameter of the forme cylinder 503, with $n \in \mathbb{N} < 10$, in particular n=1, 2 or 3.

By means of the inking device 511, the first inking unit cylinder 512, which comprises recesses 513 in the region of its outer cylindrical surface 518 that correspond to recesses 514 on the forme cylinder 503, can be inked at an application point located on its circumference. In this context, the "application point" shall also be understood as a circumferential section, extending in the circumferential direction, in which ink is applied to the first inking unit cylinder 512 by the inking device 511 and/or in which the cylinder comes into contact with a supply of printing ink 517. Ink can generally be applied at the application point as desired.

Figure 3A:
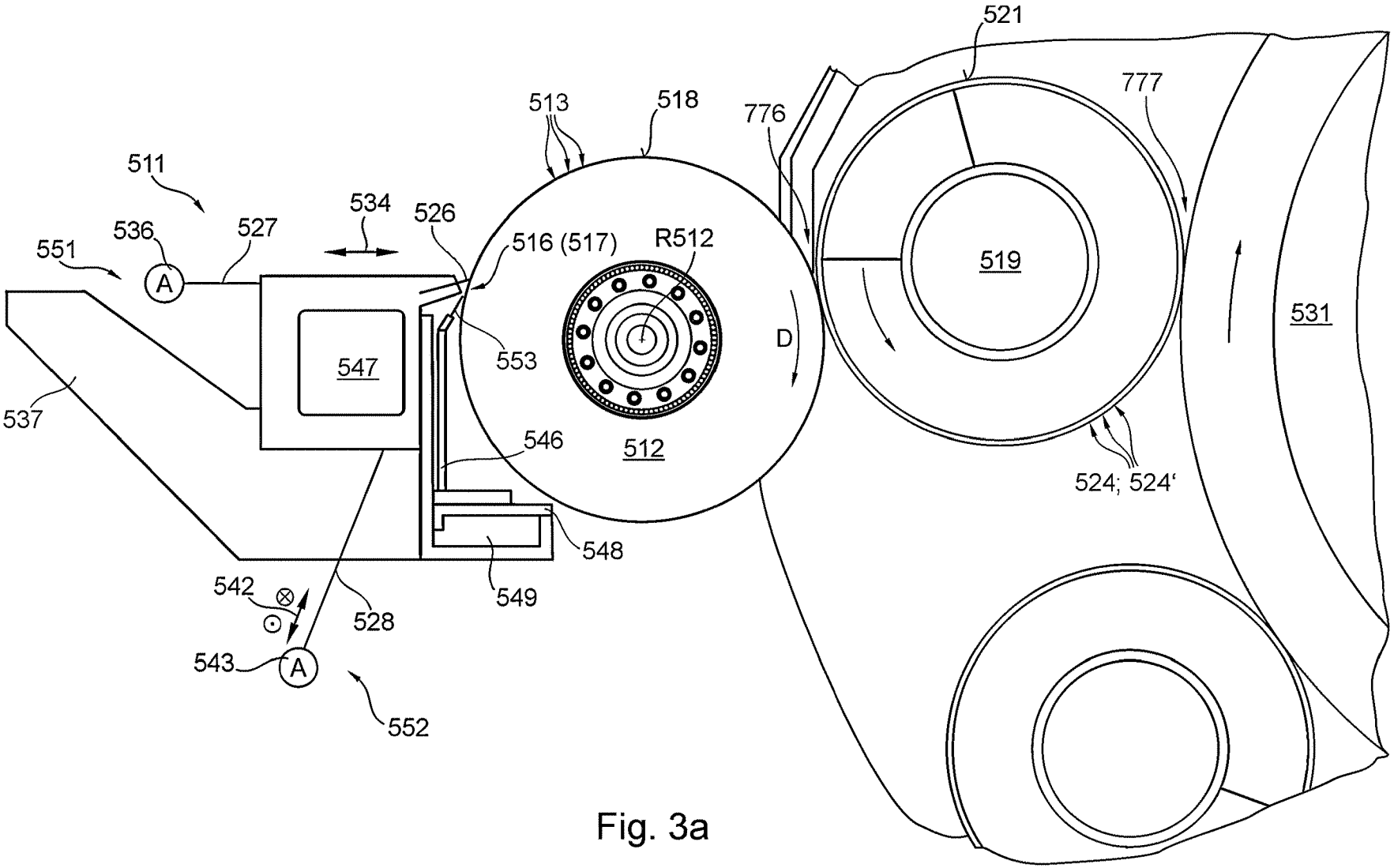
FIG. 3*a* an enlarged detail of the printing unit according to FIG. 2*a*)
Figure 3B:
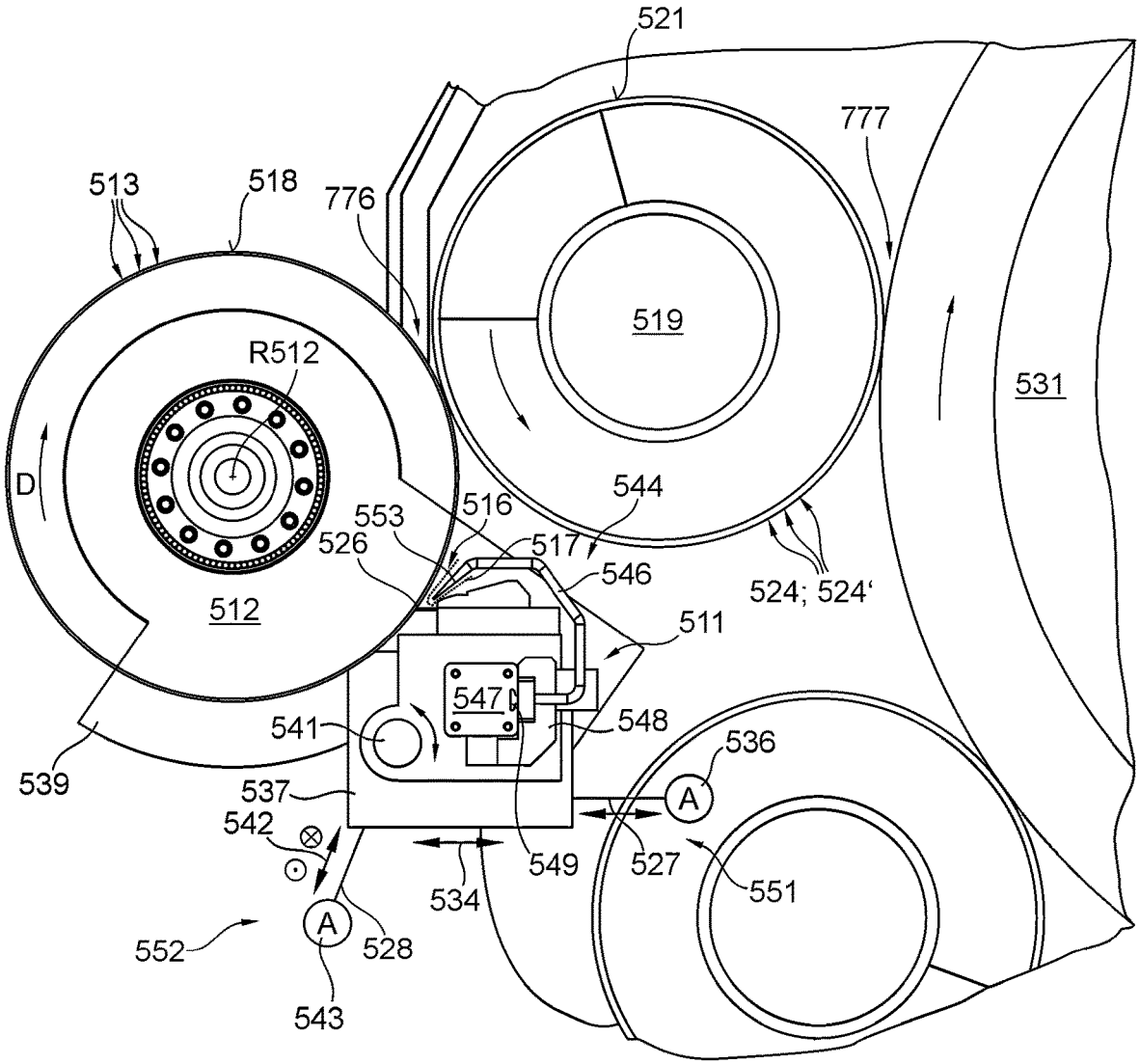
FIG. 3*b* an enlarged detail of the printing unit according to FIG. 2*b*)

In a preferred embodiment, the inking device 511 for inking the gravure inking cylinder 512 comprises an ink supply chamber 516, which is at least partially delimited on the side facing the gravure inking cylinder 512 by the outer cylindrical surface 518 thereof (see, e.g., FIG. 3*a* and FIG. 3*b*). Leading or protruding into the ink supply chamber 516, for example, e.g. centered in the axial position thereof, is the opening of at least one, stationary or axially moved, ink feed line, by way of which the amount of printing ink 517 consumed is or can be replaced in the ink supply chamber 516. The ink supply chamber 516 here shall be understood, e.g. in general, to mean the space in which the printing ink 517 to be applied, which is in contact with the outer cylindrical surface 518, is located. Depending on the embodiment, this can be an ink supply chamber 516 that is open toward the top, open toward the bottom, or closed at the top and bottom.

The engravings 513 or recesses 513 of the inking unit cylinder 512 are, for example, recesses having a depth z (513) of, for example, up to no more than 0.3 mm, in particular no more than 0.2 mm, in relation to the non-engraved outer cylindrical surface region.

Downstream from the gravure inking cylinder 512 in the inking unit 508, an inking unit cylinder 519, e.g. a second inking unit cylinder, to be inked thereby, is provided, which, in the region of its, preferably elastic and/or compressible, outer cylindrical surface 521, includes elevations 522; 524; 524' separated from one another by deeper points or areas, so as to cooperate in the region of these elevations 522; 524; 524' with the outer cylindrical surface of the next inking unit cylinder or printing unit cylinder 531; 503 downstream. Ink is then transferred, e.g., only in the region of these elevations 522; 524; 524'. Ink is then transferred, e.g., only in the region of these elevations 522; 524; 524'. The elevations 522; 524; 524' provided for ink transport are situated with their surface in an outer cylindrical surface, which represents the cylinder diameter of the inking unit cylinder 519 that is effectively used for printing.

In a first embodiment, the elevations 522; 524; 524' can be raised areas 522, which correspond to engraved areas 523 of the printing forme 504 to be inked. These engraved areas 523 are assigned, for example, to the individual image motifs and, in a first embodiment, for example for monochrome image motifs, cover the entire surface area of the image motif or of the engravings 514 relating thereto on the forme cylinder 503. Such elevations 522 are, for example, areas 522 having a surface area that extends over an image motif composed of a multiplicity of engravings 514, e.g. more than 100, provided on the forme cylinder 503, and/or are elevations 522 that are spaced apart from one another and that extend over spatially separate, in particular not interwoven image motifs, as is known, for example, from the prior art.

In an embodiment that is generally advantageous on its own, but is particularly advantageous in conjunction with the gravure inking cylinder 512 and/or a multicolor printing process, the engravings 514 on the inking unit cylinder 519 for the same image motif provided on the forme cylinder 503 are assigned a raised area 522, the surface area of which is smaller than that of the image motif, or an elevation 522 that does not extend over all engravings 514 that relate to the same image motif, and are provided on the inking unit cylinder 519. An area 522 of this type extends, for example, over an uninterrupted surface area or a closed region of recesses 514 on the forme cylinder 503 that are to be inked via the same gravure inking cylinder 512 or that belong to a part of an image motif to be inked with the same ink, in particular irrespective of the line density present there. In such an embodiment, e.g. one or more areas 522, each having a maximum diameter of less than 50 mm, are provided on a gravure inking cylinder 512.

In an advantageous embodiment, the elevations 522; 524; 524' that relate to or cover the entirety of the engravings 514 of the same image motif are provided on multiple different inking unit cylinders 519 of the printing unit 500, which is e.g. configured as a multicolor printing unit 500, in particular such that they cover the entirety of the engravings 514 of the image motif on the forme cylinder 503. In that case, one or a plurality of non-contiguous elevations 522; 524; 524' assigned to the same image motif can be provided on the same inking unit cylinder 519 and can, e.g., ink the engravings 514 of image parts of the same color.

The aforementioned areas of elevations 522 are, e.g. areas 522 that each only extend over a portion of an image motif or over some of the recesses 514 relating to the image motif, wherein another portion of the same image motif or the recesses 514 relating to the image motif is covered by one or more respective elevations 522 on another gravure inking cylinder 512 of the printing unit 500. When rolled off onto the forme cylinder 503, these elevations 522 of the same image motif provided on different inking unit cylinders 519 relate to mutually adjacent, for example at least partially interwoven and/or interpenetrating portions of the same image motif or of the associated engravings 514. Areas 522 of multiple inking unit cylinders 519, e.g. two, three, four or even five, may be assigned to one copy $N_i$ or to one image motif provided on the surface area of one copy $N_i$.

In a particularly advantageous embodiment, however, elevations 524; 524' that correspond to engravings 514, especially individual engravings (i.e., individual point-like, area-like, or preferably line-like engravings 514, for example) of the forme cylinder 503 or the printing forme 504 are provided on the outer cylindrical surface 521, e.g. in the manner of a relief with point-like, area-like, or preferably line-like ridges 524; 524', which correlate in terms of shape and surface area, e.g. as viewed in a plan view and/or when rolled out, to the shape and/or surface area of the respective recess 514. Again, the latter does not mean that the elevations 524; 524' must have the same dimensions in terms of surface area as the corresponding engravings 514, but that their shape has a defined relationship to the shape of the corresponding engraving 514 of the printing forme 504, which is also obtained here, for example, based on regularities that are established or are to be established. Ridges 524; 524' that correspond to multiple adjacent engravings 513 as set out below can then merge to form a larger structure of an elevation 524'; however, due to the underlying regularity, the periphery will correspond, e.g. to the underlying engravings 513. For the sake of simplicity, the inking unit cylinder 519 comprising the raised areas 522 and/or elevations 524; 524' is also referred to synonymously, unless explicitly otherwise specified, as "relief inking cylinder" 519, regardless of the nature and configuration of the elevations 524; 524'. Elevations 524; 524' on the relief inking cylinder 519 that correspond to engravings 514 on the forme cylinder 503 preferably have a greater width b524 than the width b514 or line width b514 of corresponding engravings 514 on the forme cylinder 503 or the printing forme 504.

As already mentioned, for narrow line structures on the forme cylinder 503 or on the printing forme 504, for example, individual, e.g. corresponding elevations 524 on the relief inking cylinder 519 can merge partially or completely to form larger elevations 524'. If elevations 524; 524' are only partially merged, two or more partially contiguous elevations 524; 524' are connected to one another, for example, due to an aforementioned increased size relative to the recesses 513; 514 on the gravure inking cylinder 512 or on the forme cylinder 503 and, e.g., only a small distance with respect to one another, wherein, for example, the elevations 524; 524' are still individually discernible at least on a longitudinal section that is not merged. It is also possible for entire areas of merged elevations 524; 524' to be present, such that, as a result of the larger size and due to a high line density on the forme cylinder 503 and/or on the gravure inking cylinder 512, individual recesses 513, e.g. situated in the interior of such an area, become merged and are no longer individually resolved and/or discernible. Nevertheless, in the following such elevations 524; 524' on the gravure inking cylinder 512, which result from the transfer of the individual recesses 514 on the forme cylinder 503 to individual, in this case overlapping elevations 524; 524' on the gravure inking cylinder 512 (e.g., in contrast to the aforementioned rough areas 522) are likewise regarded as corresponding to recesses 514 on the forme cylinder 503, since they result, for example, based on a fixed rule, from the individual engravings 513 on the forme cylinder 503 and/or on the gravure inking cylinder 512 and/or allow at least a partial discernment of the underlying structure of the recesses 514 at the edge on the forme cylinder 503. Thus, even where merging does occur, the individual engravings 514 on the forme cylinder 503 form the basis for the pattern of corresponding elevations 524; 524', which due to the regularities applied to individual engravings 514 are also to be understood within this meaning as corresponding to individual recesses 514 on the forme cylinder 503. Moreover, at least a number of actually individually resolved elevations 524, i.e. elevations 524 that correspond precisely to an engraving 513, are preferably also included on the outer cylindrical surface 521 of the relief inking cylinder 519.

Especially in the case of the aforementioned raised areas 522, the dimensions of which are greater than those of individual elevations 524, this second inking unit cylinder 519 is also referred to as a chablon cylinder 519.

Generally, all elevations 524; 524' on the relief inking cylinder 519 that are assigned to recesses 514 on the forme cylinder 503 or to recesses 514 of the same image motif on the forme cylinder 503 can be configured as correlated, corresponding elevations 524; 524', individual or merged as described above, or optionally as only some of the elevations 522; 524; 524' that are provided on the relief inking cylinder 519, wherein in the latter case additionally one or more larger raised areas 522 may be provided.

The elevations 522; 524; 524' are, for example, elevations 522; 524; 524' having a height between 0.03 and 2.0 mm, for example, in particular a height between 0.5 and 1.2 mm in relation to the non-printing base. The non-printing base is provided at the same depth, for example, so that elevations rolling in the same cylindrical shell surface produce elevations of the same height above the base. For the embodiment comprising only larger raised areas 522, the height of the areas above the base may be greater than that of the elevations 524; 524' correlated to individual engravings 514.

In an embodiment that is to be particularly preferred, the width b524 of elevations 524 on the relief inking cylinder 519 that correspond to engravings 514 on the printing forme 504 is greater than the width b513 of the engravings 513 corresponding thereto on the gravure inking cylinder 512, and the width of these engravings 513 on the gravure inking cylinder 512 is, in turn, greater than the width b514 of the engravings 514 corresponding thereto on the forme cylinder 503 or on the printing forme 504 (see, for example, FIG. 4*a*).

For example, multiple individual elevations 524; 524' on the relief inking cylinder 519 are greater on all sides of the relevant elevations 524; 524', for example by at least 20 μm and/or by no more than 200 μm, advantageously by at least 50 μm and/or by no more than 150 μm, in particular 80 to 120 μm, preferably by 100±5 μm, than the respectively corresponding recesses 513 on the gravure inking cylinder 512 and/or are greater, e.g., by at least 40 μm and/or no more than 400 μm, advantageously by at least 100 μm and/or no more than 300 μm, in particular 160 to 240 μm, preferably by 200±10 μm, than the corresponding recesses 514 on the forme cylinder 503. Thus, for example, for at least some of the recesses 514 on the forme cylinder 503, a line width b524 or width b524 of the corresponding elevations 524; 524' on the relief inking cylinder 519 is greater, e.g., by at least 40 μm and/or no more than 400 μm, advantageously by at least 100 μm and/or no more than 300 μm, in particular 160 to 240 μm, preferably by 200±10 μm, than the corresponding recess 513 on the gravure inking cylinder 512 and/or is greater, e.g., by at least 80 μm and/or no more than 800 μm, advantageously by at least 200 μm and/or no more than 600 μm, in particular 320 to 480 μm, preferably by 400±20 μm, than the corresponding recess 514 on the forme cylinder 503.

In the embodiment comprising corresponding elevations 524; 524', e.g. multiple elevations 524, optionally among other things, which correspond to individual engravings 514 on the forme cylinder 503 and which are greater, e.g. on all sides, by no more than 400 μm, in particular by no more than 300 μm, preferably by no more than 200 μm, than the corresponding recess 514 on the forme cylinder 503, and/or multiple contiguous elevations 524', each resulting from the areal merging of elevations 524 that correspond to a group of recesses 514 on the forme cylinder 503, are provided on the outer cylindrical surface 521 of the relief inking cylinder 519, wherein the contiguous elevations 524' preferably each occupy a contiguous surface area, which results from the overlapping of the relevant corresponding recesses 514 of the forme cylinder 503 that are enlarged on all sides by no more than 400 μm, in particular by no more than 300 μm, preferably by no more than 200 μm, and/or which protrudes on all sides by no more than 400 μm, in particular by no more than 300 μm, preferably no more than 200 μm, beyond the surface area resulting from the shortest envelope curve around the relevant recesses 514. On the relief inking cylinder 519, multiple such individual or merged and contiguous elevations 524; 524', e.g. at least five, are provided per copy $N_i$ to be printed, for example.

In contrast to the aforementioned raised areas 522, in which the raised area 522 extends over the surface area of a plurality of adjacent engravings 514 on the forme cylinder 503, e.g. more than fifty, for example, regardless of the density of recesses 514 on the forme cylinder 503, and at the edge of which area no structure of elevations 524 corresponding to individual recesses 514 on the forme cylinder 503 is discernible, elevations 524 are preferably provided, as elevations 524 that correspond individually to engravings 514 on the printing forme 504, that, in the region of their smallest diameter, i.e. a shortest distance between opposing margins or edges, for example have a maximum width b524 of 1,000 μm, in particular of no more than 800 μm, and/or that have a width b524 that is no more than 800 μm, preferably no more than 600 μm, greater than that of the corresponding engraving 514 on forme cylinder 503 and/or that match, e.g., individual engravings 514 on the forme cylinder 503 having a width b524 that is greater by no more than a factor of ten, preferably by no more than of a factor of three, and/or that individually match engravings 514 on the forme cylinder 503 that are spaced from one another, for example, by 1,000 μm or less, advantageously by 1,000 μm or less, preferably by no more than 600 μm, in particular no more than 500 μm, i.e. that ink or can ink elevations 524 that are spaced apart from one another. In contrast to the aforementioned raised areas 522, e.g. overlappings of elevations 524 obtained individually via a regular enlargement from corresponding recesses 514 and/or, e.g., elevations 524' having a maximum diameter of less than 20 mm, in particular less than 10 mm, are provided as merged elevations 524' produced from individual corresponding elevations 524. At least a number, for example, in particular a plurality of such individually resolved and/or merged elevations 524; 524' are formed or provided on the relief inking cylinder 519, in particular over a surface area corresponding to one copy $N_i$.

In a preferred embodiment including the aforementioned corresponding elevations 524; 524', for example, an area of corresponding elevations 524; 524', which belongs to the same image motif to be printed, of a first color to be printed or on a first relief inking cylinder 519, can be surrounded on all sides by corresponding elevations 524; 524' that belong to the same image motif and are of a second color or of a second relief inking cylinder 524; 524', e.g. of the same printing unit 500, and/or areas of corresponding elevations 524; 524', which belong to the same image motif to be printed, of a first color or on a first relief inking cylinder 519 and areas of corresponding elevations 524; 524', which belong to the same image motif, of a second color to be printed or on a second relief inking cylinder 519 may be interwoven or may penetrate one another when rolled out.

In a preferred embodiment including, e.g., the aforementioned elevations 524; 524', e.g. more than 50, in particular more than 100, and in special configurations even more than 250 such spaced-apart, i.e. non-contiguous elevations 524; 524' are provided on the relief inking cylinder 519 and/or, e.g. at least 5, advantageously at least 10, in particular more than 25, and in special configurations even more than 50 such spaced-apart, i.e. non-contiguous, elevations 524; 524' are provided on an outer cylindrical surface area of the relief inking cylinder 519 that corresponds to one copy $N_i$.

In an embodiment that is advantageous in the case of a particularly high resolution, the relief inking cylinder 519 comprises on its outer cylindrical surface 521, e.g., elevations 524; 524' that, in the region of their smallest diameter, have a width b524 of no more than 0.6 mm and/or a width b524 that is no more than 0.3 mm greater than the width b514 of the corresponding engraving 514 on the forme cylinder 503, and/or that match individual engravings 514 on the forme cylinder 503 having a width b514 that is greater by no more than a factor of three and/or that individually match engravings 514 that are spaced from one another, for example, by 1,000 μm or less, or even 500 μm or less, on the forme cylinder 503.

For example, areas having more than 20 or more than 50 (individually resolved and/or merged) non-contiguous elevations 524; 524' over a surface area of, in particular no more than, 10 $cm^2$, preferably over a surface area of 1 $cm^2$, and/or having two or more non-contiguous elevations 524; 524' are provided, which are spaced by no more than 2,000 μm, advantageously 1,000 μm, in particular no more than 500 μm, preferably no more than 300 μm, apart from an adjacent elevation 524; 524'. For example, the relief inking cylinder 519 comprises on its outer cylindrical surface 521 a number of areas, corresponding to the number of copies $N_i$ to be printed, that have such a surface density and/or resolution of elevations 524; 524' and that are arranged in rows and columns according to the grid of the copies $N_i$ to be printed.

Areas that have an aforementioned surface density and/or resolution of elevations 524; 524' can include at least five elevations 524; 524' and/or can extend, e.g., over at least 1 $cm^2$, in particular over at least 2 $cm^2$. The elevations 524; 524' do not need to be evenly distributed within such an area and/or may be part of a larger area that also comprises, e.g., elevations 524; 524' in a lower surface density and/or a greater resolution.

In general, independently of the presence of an area having an aforementioned number, surface density, and/or resolution, but preferably in conjunction therewith, the relief inking cylinder 519 can include areas on the outer cylindrical surface 521, in particular a number of areas corresponding to the number of copies, which comprise a total of at least five, for example, preferably at least ten non-contiguous elevations 524; 524' over a surface area of 10 $cm^2$.

The embodiment of the relief inking cylinder or cylinders 519 including, individual and/or merged, elevations 524; 524' that correspond in the aforementioned manner, for example, allows color resolutions and/or image effects to be achieved that otherwise cannot be realized in gravure or intaglio printing. This applies not only, but especially in conjunction with an aforementioned gravure inking cylinder 512.

The engravings 513 on the gravure inking cylinder 512 are provided directly on the outer cylindrical surface 518 of the gravure inking cylinder 512, for example, which is comprised at least by the cylinder shell on the outer circumference of the gravure inking cylinder 512, or are provided on the outer circumference of an ink transfer forme embodied as a printing forme, which can be configured in the form of a circumferentially closed ink transfer forme sheath, e.g. what is known as a sleeve, or in the form of a finite gravure printing forme, e.g. with leading and trailing ink transfer forme ends. In an advantageous embodiment, the engravings 513 are provided in a ceramic or metallic outer layer of the inking unit cylinder 512 or the ink transfer forme sheath.

In an advantageous embodiment, the raised areas 522 or elevations 524; 524' of the second inking unit cylinder 519 can likewise be provided on the surface of an ink transfer forme, which is or can be detachably arranged in the form of a circumferentially closed ink transfer forme sheath, e.g. what is known as a sleeve, on a cylinder body that is or can be rotatably mounted in the inking unit 508.

In the possibly present case that the lateral flanks of the recesses 514 on the forme cylinder 503 or of the elevations 524; 524' on the relief inking cylinder 519 or of the recesses 513 on the gravure inking cylinder 512 do not have any perpendicular flanks, the principle of the half heights or depths, outlined above with regard to the raised image elements 002; 003; 004; 006; 007; 008; 009; 011; 012, can be applied, or is to be applied, accordingly for ascertaining widths or distances.

On at least the downstream side of the aforementioned application point in the operating direction of rotation D of the inking unit cylinder 512 comprising the recesses 513, the inking device 511 comprises a retaining means 526, e.g. a doctor blade or an ink blade, by means of which, as viewed in the operating direction of rotation D, downstream from the ink application, and in particular upstream from a nip point 554 with a subsequent inking unit cylinder 519, printing ink 517 that was previously applied to the outer cylindrical surface 518 can be removed.

In particular, the inking device 511 comprises such a retaining means 526 on at least the downstream side of the ink supply chamber 516 in the operating direction of rotation D of the gravure inking cylinder 512, by means of which, on the output side of the ink supply chamber 516 as viewed in the operating direction of rotation D, i.e. in the region of the downstream end of the ink supply chamber 516, printing ink 517 that has been carried along previously by contact with the outer cylindrical surface 518 can be removed. In this embodiment of the ink application process, the ink supply chamber 516 is delimited on its downstream side in the circumferential direction by the retaining means 526.

The inking device 511 is preferably configured without inking zones, i.e. for example without individually adjustable inking zones, and/or with a retaining means 526 that is continuous in the axial direction over the printing width and/or without individually adjustable ink blade sections.

The inking device 511 preferably also comprises a sensor device, by means of which a measure of the volume of ink present in the ink supply chamber 516 and/or a fill level, but at least information regarding a critical fill level being reached, e.g. a lower and/or an upper limit value of the fill level, can be derived.

In a first embodiment that is advantageous, e.g. in terms of a particularly low ink infeed, the inking device 511 comprises, on at least the downstream side of the application point or of the ink supply chamber 516 in the operating direction of rotation D of the inking cylinder 512, a retaining means 526 in the form of a wiping means, in particular a doctor blade, the contact force of which is preferably variable or adjustable and which is in physical contact with the preferably hard and unyielding outer cylindrical surface 518 of the gravure inking cylinder 512, in particular at least in the working or operating position, and which can be used to remove, substantially completely, printing ink 517 that has been applied to non-engraved regions. In this way, an infeed of printing ink 517 at points where no printing ink 517 is required on the forme cylinder 503 can be reduced quite substantially from the outset. A complete removal of the printing ink 517 shall also be understood to mean that traces of printing ink 517 will remain on non-engraved regions of the outer cylindrical surface despite doctoring with physical contact. In contrast to ink blades, with which the ink film thickness desired for operation can be adjusted, e.g. zonally, by adjusting the size of the gap between the cylinder shell and the ink blade, and which can be moved up to the outer cylindrical surface, e.g. to avoid an outflow of printing ink in the idle state, the retaining means 526 that is in physical contact with the preferably hard and unyielding outer cylindrical surface 518 of the gravure inking cylinder 512 shall be understood as one that, during operation, is set against the outer cylindrical surface 518 for the purpose of doctoring the printing ink 517. A doctor blade suitable for this purpose must have greater abrasion resistance and/or hardness at the end of the doctor blade that is in physical contact in the working position than would be required for an adjustable ink blade that is spaced at a distance during operation. At the same time, it must have a certain elasticity and/or resilience so as to rest flexibly and/or over the entire width against the outer cylindrical surface 518. The retaining means 526 embodied as a doctor blade is configured, at least in a section adjoining the doctor blade edge, having a thickness of 0.7 to 1.3 mm, for example, in particular of 0.9 to 1.1 mm. In addition to or independently of this, the embodiment that involves physical contact during operation requires, e.g., a positioning drive 551, which moves the doctor blade not only up to the position of initial contact, but beyond that to the point of at least slight elastic deformation caused by the contact pressure against the outer cylindrical surface 518.

The retaining means 526, in particular in the form of a wiping means, e.g. a doctor blade, is advantageously configured as "positive" or is arranged correspondingly "positively" in the inking device 511, i.e., it is or can be deployed at an inclination relative to the tangent, so that the tangent at the point of contact forms an acute angle with the retaining means 526, e.g. wiping means, in particular the doctor blade, on the side of the ink supply chamber 516. This angle prevails, e.g. at least in the region of the operative end, i.e. in an end section of the retaining means 526, e.g. at least 3 mm in length, which cooperates in contact with the outer cylindrical surface 518 or without contact with the same.

In an embodiment of the pattern of recesses 513 on the gravure inking cylinder 512 that is advantageous in particular in conjunction with the embodiment of the retaining means 526 as a doctor blade that is in physical contact during operation, recesses 513, in particular linear recesses, on the gravure inking cylinder 512 that correspond to recesses 514 on the forme cylinder 503 are at least not all configured as uninterrupted; instead, particularly in the case of recesses 513 of greater length, e.g. for recesses 513 measuring at least 500 μm in length, at least some have at least one supporting point 515, in particular one supporting ridge 515, which interrupts the recess 513 on the second inking unit cylinder 512 that corresponds to the continuous recess 514 on the forme cylinder 503 and/or which is situated within the envelope of a recess 514 that corresponds in shape to a continuous recess 514 on the forme cylinder 503, and whose upper surface lies at the level of the undisrupted, i.e. non-engraved, outer cylindrical surface 518 of the gravure inking cylinder 512, for the purpose of supporting the doctor blade (indicated, e.g., in FIG. 4*a*, iii), by way of example, based on two engravings 513 in the lower portion of the diagram). A supporting ridge 515 of this type, the upper surface of which lies at the undisrupted level, preferably connects two wheels that are located on opposite sides of the relevant recess 513 to one another. These supporting points 515 or supporting ridges 515 prevent the doctor blade edge from dipping, e.g. even very slightly, into elongated recesses 513, which can lead to irregularities in the doctor blade edge and/or to erosions at the edges of recesses 513 if such dipping is repeated a large number of times.

Preferably, however, such supporting points 515 or supporting ridges 515 are not placed individually in individual recesses 513, and are instead accounted for or provided during the derivation of recesses 513 to be provided on the gravure inking cylinder 512 from image-producing recesses 514 on the forme cylinder 503, particularly during the transformation of image-producing recesses 514 present or to be provided on the forme cylinder 503 into specifications for corresponding recesses 513 to be provided on the gravure inking cylinder 512, as will be described in greater detail below, for example.

Such supporting points 515 or supporting ridges 515 can generally be provided, by means of appropriate software, for example, "randomly", i.e. in a random, non-regular arrangement, which entails advantages in terms of the avoidance of visible structures. In a solution that is advantageous in terms of the reliability of secure support, however, supporting points 515 or supporting ridges 515 are superimposed on the pattern of recesses 513 on the gravure inking cylinder 512 in a regular structure 525 (see, e.g., FIG. 4*b*, ii)). This structure is preferably superimposed over at least the entire area of recesses 513 of the same image motif to be inked on the forme cylinder 503, e.g. over all lines or the lines of a color segment of the image to be depicted, for example a portrait, a building, or an illustration of fauna or flora. As a result of the superposition, in places where the intended structure 525 and a recess 513 on the gravure inking cylinder 512 overlap, an elevation is provided, the height of which is at the level of the undisrupted outer cylindrical surface 518. In other words, the structure 525 is only discernible in the region of the recesses 513, at the supporting points 515 or supporting ridges 515 extending there according to the pattern of recesses 513, and continues correspondingly, e.g. in adjacent recesses 513.

Such a regular structure 525 of supporting ridges 515 can generally be configured in a variety of ways. For example, supporting ridges 515 can be provided along rectilinear and parallel lines of an open structure 525 configured as a line structure 525 (see, e.g., FIG. 4*b*, i) and ii)). Alternatively, supporting ridges 515 may be provided on walls of closed, circular or polygonal structures 525, such as honeycomb structures 525, for example (see, e.g., FIG. 4*b*, iii)), or along structures 525 that run in opposite directions (see, e.g., FIG. 4*b*, iv)) or in the same direction, such as wave structures 525 (see, e.g., FIG. 4*b*, v)), or along structures 525 otherwise provided in open or closed form. In a particularly advantageous embodiment, the structure is superimposed, e.g., as a line structure 525 of rectilinear lines, onto the pattern of recesses 513, wherein the lines run rectilinearly and parallel to one another and are spaced apart from one another by 100 to 700 μm, for example, advantageously by 200 to 600 μm, and/or run at an incline of 10° to 50° (ten degrees to fifty degrees), for example, advantageously 15° to 40° (fifteen degrees to thirty-five degrees), in particular 20° to 30° (twenty to thirty degrees), in relation to a line that runs parallel to the axis of rotation of the gravure inking cylinder 512 on the outer cylindrical surface 518, or in relation to the doctor blade edge 566, and/or have a ridge width at the level of their surface of 10 to 50 μm, for example, in particular of 15 to 45 μm, preferably of 20 to 40 μm. In particular, in a first, e.g., rougher configuration, the lines are spaced apart by, for example, 300 to 700 μm, advantageously 400 to 600 μm or, in a second, e.g., finer configuration, they are spaced apart by, for example, 100 to 500 μm, advantageously 200 to 400 μm, in particular 300±30 μm, or, for example, in a first, e.g., steeper configuration, extend at an incline of 20° to 50° (twenty to fifty degrees), advantageously 25° to 45° (twenty-five degrees to forty-five degrees), in particular 40°±2° (forty degrees plus minus two degrees), or in a second, e.g., flatter configuration, extend at an incline of 10° to 35° (ten degrees to thirty-five degrees), advantageously 15° to 25° (fifteen degrees to twenty-five degrees), in particular 20°±2° (twenty degrees plus minus two degrees) in relation to a line that runs parallel to the axis of rotation of the gravure inking cylinder 512 on the outer cylindrical surface 518, or in relation to the doctor blade edge 566, and/or, in a first, wider configuration, e.g., have a ridge width at the level of their surface of 30 to 50 μm, in particular 35 to 45 μm, preferably 40°±2° μm, or, in a second, narrower configuration, have a ridge width of 10 to 40 μm, in particular 15 to 30 μm, preferably 20±2 μm. The finer and/or narrower configuration, even though it may be more complex, may reduce the risk of a line formation in, e.g., image regions having a high line density, if necessary, and, for example, the wear behavior of the doctor blade may be influenced on the one hand, and the filling of the recesses may be influenced on the other hand, by the angle of inclination.

In a second embodiment, which is advantageous in terms of wear, for example, the inking device 511 can comprise, on at least the downstream side of the application point or the ink supply chamber 516 in the operating direction of rotation D of the gravure inking cylinder 512, a retaining means 526 configured as an ink blade, for example, preferably an adjustable ink blade, by means of which in the working or operating position, a small, preferably adjustable distance of at least 2 μm, for example, in particular at least 5 μm, and/or of less than 100 μm, for example, advantageously of less than 50 μm, in particular less than 20 μm, with respect to the outer cylindrical surface 518 of the gravure inking cylinder 512 can be produced or is produced during operation. In this way, the printing ink 517 applied to non-engraved regions is or can be limited to a thin film thickness of at least 2 μm, for example, in particular at least 5 μm, and/or less than 100 μm, for example, advantageously less than 50 μm, in particular less than 20 μm.

Particularly in conjunction with at least a substantial removal of the printing ink 517, i.e. a complete removal or a removal except for a thin layer, from the non-engraved outer cylindrical surface regions of the gravure inking cylinder 512, a significant ink infeed is achieved selectively at desired locations, which is why the inking unit cylinder 512 or gravure inking cylinder 512 that is furnished with the engravings 513 or recesses 513 is also referred to as a "selective cylinder" 512.

The relief inking cylinder 519 includes, on its circumference, a preferably elastic and/or at least slightly compressible material layer, for example, the outer surface of which forms the outer cylindrical surface 521 and which comprises the raised areas 522 or elevations 524; 524' and the recesses therebetween.

The gravure inking cylinder 512 to be inked by the inking device 511 and the relief inking cylinder 519 downstream, optionally with one or more inking unit rollers or cylinders arranged in series therebetween, make up an inking unit 529 here, hereafter also referred to as an inking train 529, by means of which printing ink 517 of a certain color can be fed into the printing unit 500 and is or can be conveyed in the direction of the forme cylinder 503.

This inking train 529 can generally be arranged in the region of its downstream end, so as to cooperate, for example with the outer cylindrical surface 521 of the chablon cylinder 519, directly with the forme cylinder 503 or with the printing forme 504 thereof, in the printing unit 500. In an embodiment that is advantageous in terms of multicolor printing, multiple such inking trains 529, e.g. at least two, can also be arranged around the forme cylinder 503. It is also possible for the forme cylinder 503 to be assigned one or more inking trains 529 configured as comprising a gravure inking cylinder 512, as described above, and one or more inking units 532, e.g. inking trains 532, configured differently, e.g. configured conventionally, without a gravure inking cylinder, and including an ink fountain comprising an ink blade, for example, and an ink fountain roller with a smooth surface.

When multiple inking trains 532 are provided, each of these inks up one so-called color segment of the print image, for example, i.e. one print image segment assigned to this color to be applied. The patterns of recesses 513 and/or elevations 524; 524' or raised areas 522 on the relevant inking unit cylinders 512; 519 of two inking trains 529 are therefore different from one another, at least to a large extent. In particular, the relevant inking unit cylinders 512; 519 have different patterns of recesses in the respective region of the outer cylindrical surface 518; 521 that corresponds to the same image motif to be printed at the printing nip 502.

In a preferred embodiment, particularly with regard to multicolor printing, the inking train 529 is arranged in the region of its downstream end, e.g. in the region of the relief inking cylinder 519, so as to cooperate with another inking unit cylinder 531, e.g. acting as a transfer cylinder 531. This cylinder is, in turn, arranged so as to cooperate with the forme cylinder 503 in the printing unit 500 and preferably has an elastic and/or compressible outer cylindrical surface.

Figure 2A:
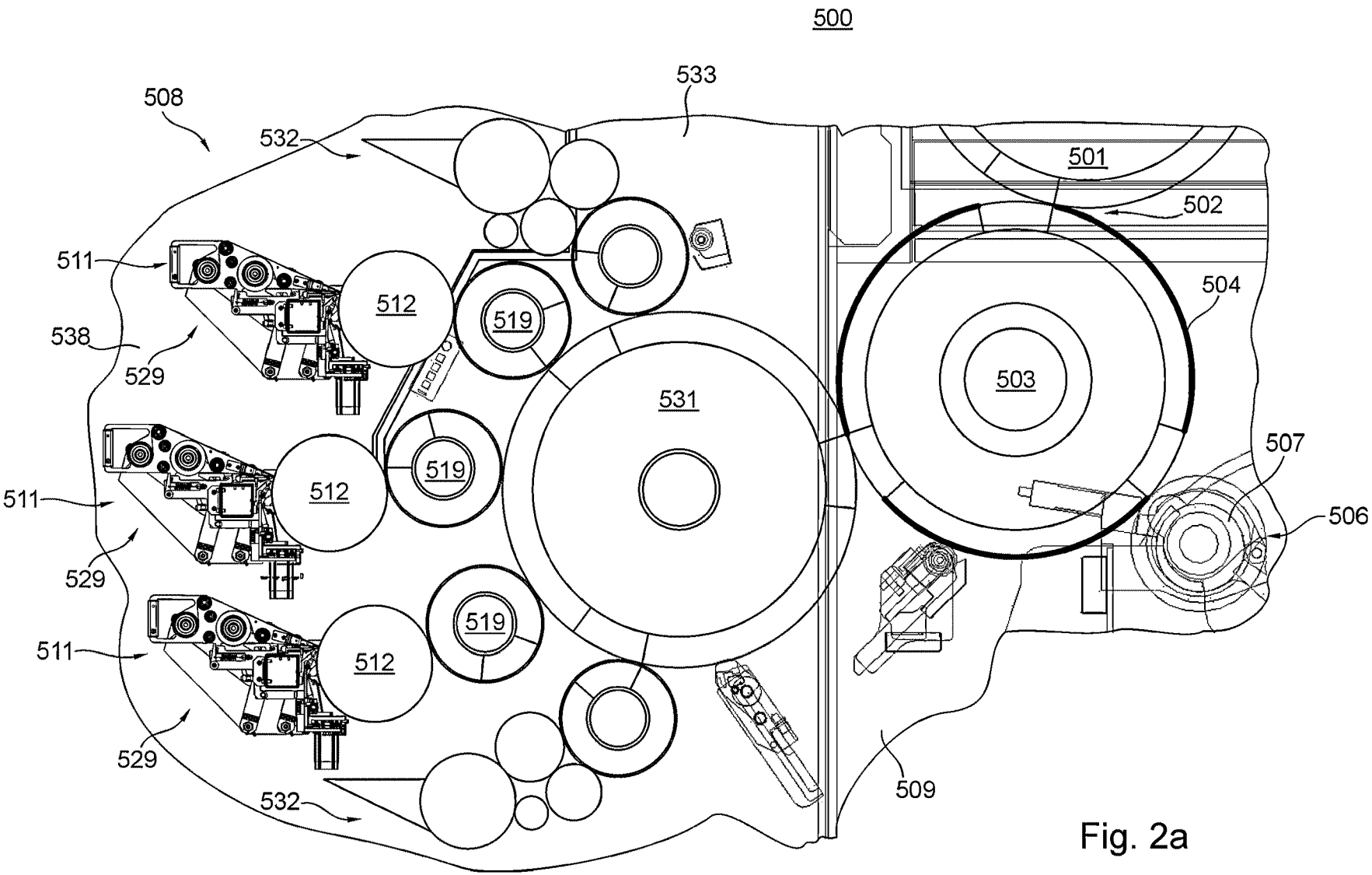
FIG. 2*a* an enlarged illustration of the printing unit of FIG. 1*a*)
Figure 2B:
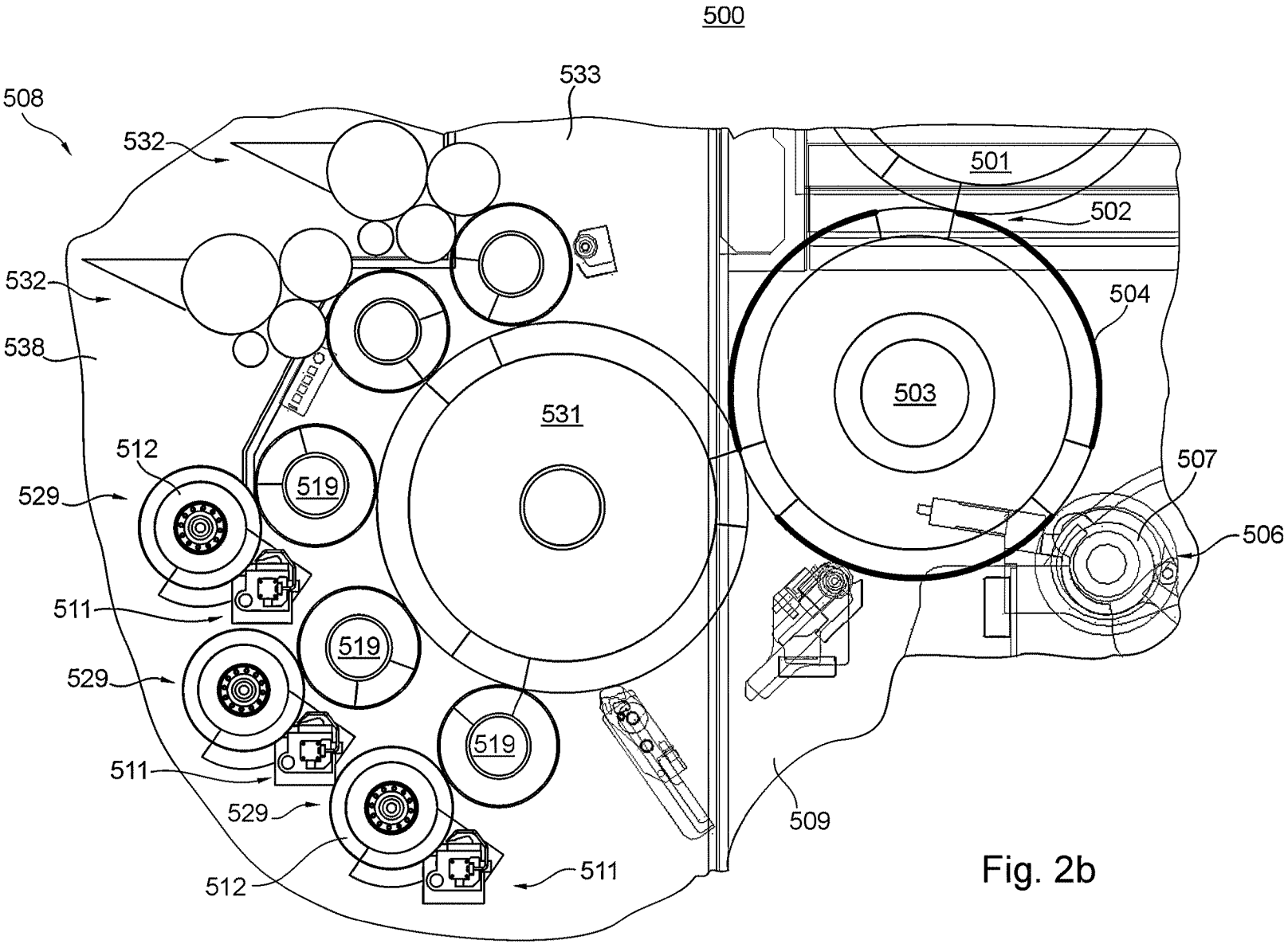
FIG. 2*b* an enlarged illustration of the printing unit of FIG. 1*b*)

In a particularly preferred embodiment of the printing unit 500 as a multicolor printing unit 500, in particular configured for simultaneous multicolor printing at the printing nip 502, the additional inking unit cylinder 531 is embodied or acting as an ink collecting cylinder 531. In that case, multiple inking trains 529, e.g. at least two, configured as described above as having a gravure inking cylinder 512, or a combination of one or more inking trains 529 configured as described above as having a gravure inking cylinder 512, and one or more inking trains 532 that are configured differently, e.g. conventionally, without a gravure inking cylinder, for example including an ink fountain comprising an ink blade and an ink fountain roller having a smooth surface, can be arranged on the circumference of the ink collecting cylinder 531. For example, a total of five inking trains 529; 532 can be provided, of which, for example, three, e.g. lower, inking trains 529 are configured as inking trains 529 that feed in printing ink 517 selectively (i.e., selective inking trains 529), while the other two, e.g. upper, inking trains 532 are conventionally configured (see, e.g. FIG. 2*b*). However, it is also generally possible for another heterogeneous breakdown and/or positioning of selective and conventional inking trains 529; 532 to be provided, e.g. one lower and one upper inking train 532 of five conventionally configured inking trains 529; 532, with three selective inking trains 529 therebetween, or for a homogeneous embodiment including exclusively selective inking trains 529 to be provided.

Generally, the inking device 511 can be arranged as desired so as to cooperate with the outer cylindrical surface 518 on the open circumference, i.e. on the circumference that is not covered by the nip point 554 with the relief inking cylinder 519 or by any other components.

In a first embodiment, however (see, inter alia, e.g. FIG. 1*a*, FIG. 2*a* and FIG. 3*a*), the inking device 511 can be arranged on the side of the gravure inking cylinder 512 that faces away from the relief inking cylinder 519. In that case, the aforementioned line of contact or line of the shortest distance is situated on the side that faces away from the relief inking cylinder 519, for example.

Thus a line of contact that, if the retaining means 526 is embodied as a wiping means, in particular a doctor blade, is formed between this doctor blade and the outer cylindrical surface 518 of the gravure inking cylinder 512, or if the retaining means 526 is embodied as an ink blade, the line of the shortest distance on the circumference of the gravure inking cylinder 512 is thus located in this first embodiment of the positioning of the inking device 511, on a circumferential section of the gravure inking cylinder 512 that is located on the side facing the relief inking cylinder 519, in particular upstream from the line of intersection with the aforementioned vertical plane, as viewed in the operating direction of rotation D. A line of contact shall also be understood, of course, as a point of physical contact that, as viewed in the circumferential direction, has an actual width not equal to zero, e.g. a width of up to 2 mm. In the case of physical contact, this may be caused by a "grinding in" of the doctor blade edge through contact with the outer cylindrical surface 518 and/or may be desirable to create a better seal.

In an alternative second embodiment, which is especially advantageous particularly with respect to ink supply and ink metering (see, inter alia, e.g. FIG. 1*b*, FIG. 2*b* and FIG. 3*b*), the inking device 511 is arranged on the side of the gravure inking cylinder 512 that faces the relief inking cylinder 519. A side of the gravure inking cylinder 512 shall be understood as a half space that is located on one side of a vertical plane extending through the axis of rotation R512 of the gravure inking cylinder 512.

In that case, for example, both for the first and for the alternative embodiment, an arrangement of the gravure inking cylinder(s) and associated relief inking cylinder(s) 512; 519 in the printing unit 500 is provided, such that, in the print-on position, the plane connecting the rotational axes R512 of the gravure inking cylinder and the associated relief inking cylinder 512; 519 of all, some, or at least one gravure inking cylinder 512, e.g. a third of five, comprised by the printing unit 500, forms an angle of no more than 60°, preferably no more than 45°, with the horizontal. An arrangement of this type represents an arrangement of the main components of the inking unit aligned predominantly in the horizontal direction, namely from the infeed of ink, through the selective transfer and optionally the collection of ink, to the inking of the forme cylinder 503.

Where the two aforementioned embodiments functionally involve the same components or component groups, no differentiation is made in the reference symbols used for this purpose.

The inking unit cylinders 512; 519; 531 and the inking device 511 may be provided, together with the printing unit cylinders 501; 503, in a common frame, or may be arranged in a separate frame 533; 538, e.g. frame section 533; 538, which is different from the frame supporting the printing unit cylinders 501; 503, for example.

Generally, independently of the specific position and/or specific configuration of the inking device 511, but advantageously in conjunction with one of the aforementioned positions and/or embodiments, the inking unit frame 533, 538 is configured to be separable. The frame comprises a frame 538, e.g. frame section 538, that supports, e.g. the at least and the inking device 511 and the gravure inking cylinder 512 and has frame walls provided on both sides, which can be separated from a frame part that supports the relief inking cylinder(s) 519 and optionally the transfer cylinders 531 and can be moved away or backed out radially, in particular horizontally, in order to form therebetween, for example in the open state, an operating and/or maintenance space for operating technicians. This frame part can be a frame part that also supports the printing unit cylinders 501; 503, but is preferably embodied as a frame section 533 that is assigned solely to the inking unit 508, which can, in turn, be moved away from a preferably spatially fixed frame section supporting the printing unit cylinders 501; 503, radially of the printing unit part 509, in particular horizontally, in order to form therebetween, for example in the open state, an operating and/or maintenance space for operating technicians.

Generally, independently of the specific position and/or specific configuration of the inking device 511, but advantageously in conjunction with one of the aforementioned positions and/or embodiments, the inking device 511, but at least the retaining means 526, e.g. wiping means or doctor blade, or the ink blade, and if applicable the boundaries of the ink supply chamber 516 on the side of the inking device 511, is adjustable with respect to the radial position relative to the gravure inking cylinder 512, for example can be moved further or closer to the outer cylindrical surface 518 and less or further away from the outer cylindrical surface 518 (as indicated, e.g., schematically by double arrow 534). Positioning is implemented by means of a positioning drive 551, e.g. via a transmission 527 comprised by the positioning drive 551, and/or is preferably implemented by a remotely actuatable drive means 536 comprised by the positioning drive 551. The positioning drive 551, in particular for the embodiment of the retaining means 526 as a doctor blade that is in contact during operation, is preferably configured such that if the doctor blade becomes shortened due to wear, the doctor blade will be repositioned toward or against the outer cylindrical surface 518. This can generally be accomplished by means of a control loop including a sensor that registers the shortening and a drive motor 536 as the drive means, or by means of a drive motor 536 as the drive means 536, which is controlled with respect to the applied torque. In a particularly advantageous embodiment, the drive means 536 is configured as a force-based drive means 536, preferably in the form of a pressurized medium-actuated actuator 536, e.g. working cylinder 536, in particular pneumatic cylinder 536. Particularly if the retaining means 526 is configured as a doctor blade, this enables a level of contact force to be ensured and/or to be varied deliberate by choosing the pressure level. If the retaining means 526 is configured as an ink blade, the distance of which is adjustable, for example, such a force-based drive means 536 can be positioned against a, preferably adjustable, stop means, for example. This positioning movement preferably takes place at least in a region close to the cylinder, i.e. in at least the last 3 mm before reaching the outer cylindrical surface 518, for example, in a linear or at least approximately linear manner. The conditions at the outer cylindrical surface 518 are thus maintained, e.g. even with repositioning or with changing lengths of the retaining means. In the case of a pivoting movement about a pivot axis, preferably with a radius of curvature that corresponds to at least twice the diameter of the gravure inking cylinder. Particularly advantageous is a movement, or a guidance that forces this movement, for which the angle of inclination of the retaining means 526 or of the entire moving assembly is maintained within the positioning range, e.g. in relation to the horizontal or to the tangent of the gravure inking cylinder 512 at the point of contact in the case of repositioning induced by wear and/or during activation and deactivation. The movement preferably extends linearly in the doctor blade plane, i.e. in the direction of the extension extending from the mount to the first physical contact with the gravure inking cylinder 512. The movement can be established via a guide, which defines the movement path and which is included in the drive train between the drive means 536 and the component to be moved, or which, parallel to the drive train acting on the component, forces the component that is to be moved onto the movement path. The guide that maintains the angle of inclination of the retaining means 526 or of the parts that delimit the ink supply chamber 516 on the side of the inking device 511, e.g. with respect to the horizontal, can be provided, in particular, as a straight linear guide, for example, or as a parallelogram guide. For this purpose, the inking device 511 or at least the retaining means 526 and the parts that form the ink supply chamber 516 on the side of the inking device 511 are mounted, accordingly movably, for example directly or indirectly on a side part 537, e.g. side frame part 537, in particular side panels 537, which is in turn mounted so as to be fixed to a frame 538 of the inking unit 508 or preferably on holding means 539 that are fixed with respect to the axis of rotation R512 of the gravure inking cylinder 512, e.g. end-face side parts 539 of a subframe that is moved together with the gravure inking cylinder 512. For the preferred case in which the gravure inking cylinder 512 is mounted movably in the frame 538 of the inking unit 508, e.g. for alignment purposes or for throwing-on and throwing-off in the radial direction, mounting the inking device 511 or the frame part 537 that supports the inking device 511 in a manner fixed to the cylinder, i.e. coupled to the gravure inking cylinder 512, ensures a constant relative position of the retaining means 526 to outer cylindrical surface 518, even when the gravure inking cylinder 512 changes position. The end-face side parts 539 can be arranged fixed, for example, to an outer, non-rotating but, e.g. itself eccentrically mounted bearing ring of a radial bearing, which receives an end-face cylinder journal or an end-face ends of a shaft supporting the inking unit cylinder 512. In the following, where not explicitly distinguished, such a shaft end is also referred to as a journal or cylinder journal of the gravure inking cylinder 512. This, for example eccentrically embodied, bearing ring, or an outer ring that accommodates the bearing ring eccentrically, is mounted, e.g. in a frame bore and is configured, for example, as an eccentric ring, in particular as an eccentric bushing.

To reinforce the subframe, the two side parts 539 can be reinforced, e.g. in an end region lying furthest from the axis of rotation R512 of the gravure inking cylinder 512, by a cross member, in particular a crossbar.

The positioning mechanism and its drive can generally be configured such that, in addition to adjusting the position and/or the contact force or the distance of the retaining means 526, it is also possible to back the inking device 511 away over a long positioning path, e.g. at least 50 mm, in particular 100 mm, which is necessary for maintenance or makeready purposes, for example. In an advantageous embodiment, however, the inking device 511 is mounted, e.g. on the frame part 537, such that it can be moved away from the gravure inking cylinder 512, for example such that it can be pivoted about an axis 541 provided on the frame part 537. Movement toward and away from the cylinder can be implemented manually or by a remotely actuatable drive means.

Generally independently of the specific position and/or specific configuration of the inking device 511, but advantageously in conjunction with one of the aforementioned positions and/or embodiments, the inking device 511, but at least the retaining means 526, e.g. in the form of a wiping means or doctor blade or as an ink blade, and optionally the boundaries of the ink supply chamber 516 on the side of the inking device 511, is mounted such that it can be moved, in particular can oscillate, in its axial position relative to the gravure inking cylinder 512, for example such that it is movable back and forth between a right reversal position and a left reversal position. This movement corresponds, e.g. in FIG. 3*a* and FIG. 3*b*, to a movement into and out of the plane of the sheet and is therefore indicated only by a slightly inclined double arrow 542 and by the symbols representing an arrow end and an arrow tip. This oscillating movement is preferably carried out over a total traversing distance of at least 2 mm, e.g. a distance between 3 and 8 mm, preferably between 4 and 6 mm. The mounting of the inking device 511 or at least of the retaining means 526, e.g. in the form of a wiping means or a doctor blade or an ink blade, and optionally of the boundaries of the ink supply chamber 516 on the side of the inking device 511, is configured to enable an axial oscillation over a traversing distance of at least 2 mm, e.g. a distance between 3 and 8 mm, preferably between 4 and 6 mm. The axial movement is implemented by way of an axial drive 552, for example oscillating drive 552, e.g. via a transmission 528 comprised by the oscillating drive 552 and/or preferably by a remotely actuatable drive means 543, in particular an electric motor 543, which is comprised by the oscillating drive 552. For this purpose, the inking device 511 or at least the retaining means 526, in particular the doctor blade, and the parts that form the ink supply chamber 516 on the side of the inking device 511, are mounted such that they are accordingly axially movable on the frame part 537, for example, or on the frame, frame part, or frame section 538 that supports the gravure inking cylinder 512. This mounting to enable the axial relative movement may be provided, as described above, directly or indirectly on the frame 538 of the inking unit 508 or preferably on a holding means 539 that is fixed to the cylinder. A frequency for axial oscillation is between 0.05 and 1.00 Hz, for example, preferably in the range of 0.1 to 0.3 Hz.

Generally, independently of the specific position and/or specific configuration of the inking device 511, but advantageously in conjunction with one of the aforementioned positions and/or embodiments, a device 544 for axially equalizing the ink level in the ink supply chamber 516, e.g. an ink distribution device 544, in particular an ink stirring device 544, is provided. The device comprises at least one ink distributor 546, for example, acting as a distributor finger 546 or, in particular, an ink stirrer 546, which protrudes with a leading end 553, at least in the working position, into the ink supply chamber 516, in particular far enough that one end 553 of it is or can be immersed into the fill level located operationally upstream from the retaining means 526 or the doctor blade. In place of the immersing end 553 or preferably additionally thereto, the ink distributor 546 of the ink distribution device 544 can comprise an ink outlet, which is or can be moved axially back and forth on the ink distributor 546 in the ink supply chamber 516, thereby distributing the printing ink 517 to be fed in. During operation, the, in particular viscous, printing ink 517, which is held in reserve in the ink supply chamber 516, forms a so-called ink roll, which forms directly upstream from the retaining means 526 as a result of contact with the outer cylindrical surface 518 as it moves past. The at least one ink distributor 546 is mounted, axially movably for example, directly or indirectly on the frame 533; 538 that supports the inking device 511, or preferably on a side part 537 of the inking device 511, or directly on an optionally provided cross member 547, e.g. crossbar 547. For example, it is arranged on a slide 548, which is mounted so as to be axially movable in or on a guide 549, in particular a linear guide 549, and can be moved back and forth by a drive means, e.g. an electric motor. For instance, in an advantageous first embodiment, it can be moved back and forth by a drive means configured as an electric motor, for example by way of a transmission that converts rotation into linear movement. In a second advantageous embodiment, carried out by a drive means configured as a pressurized medium-actuated piston-cylinder system. For example, a piston connected to the slide 548 carrying the ink distributor 546 is moved back and forth in an axially extending pressurized medium chamber, e.g. cylinder. In a preferred embodiment, the pressurized medium chamber extends in a crossbar, in particular in the aforementioned crossbar 547 carrying the doctor blade mount or the slide 548 with the doctor blade mount. The two chambers on the two sides of the piston can be supplied with pressurized fluid, in particular pressurized compressed air, through two separate pressurized fluid lines, or through such a pressurized fluid line via a controlled switching valve.

Advantageously, the ink distributor 546 is moved back and forth at a frequency of at least 0.3 Hz, preferably at least 0.5 Hz.

Generally, independently of the specific position and/or specific configuration of the inking device 511, but advantageously in conjunction with one of the aforementioned positions and/or embodiments, the gravure inking cylinder 512 is mounted in the inking unit 508 or in the frame 533; 538 thereof such that it is removable operationally, i.e. for example for replacement or for maintenance and/or makeready purposes, and/or without dismantling additional inking unit components, for example. In one embodiment, this may be a removal in the axial direction of the inking unit cylinder 512, or in another embodiment, it may be a removal in the radial direction.

Generally, independently of the specific position and/or specific configuration of the inking device 511, but advantageously in conjunction with one of the aforementioned positions and/or embodiments, the gravure inking cylinder 512 is configured to be temperature-controllable, in particular such that temperature control fluid can flow through it.

Generally, independently of the specific position and/or specific configuration of the inking device 511, but advantageously in conjunction with one of the aforementioned positions and/or embodiments, the temperature of the printing ink 517 to be supplied to the ink supply chamber 516 can be controlled in the line path upstream from an outlet into the ink supply chamber 516. For this purpose, a temperature control device, in particular a heating device, is provided in the ink supply line path, for example.

Generally, independently of the specific position and/or specific configuration of the inking device 511, but advantageously in conjunction with one of the aforementioned positions and/or embodiments, in a preferred embodiment the gravure inking cylinder 512 can be rotationally driven by its own drive means, e.g. a drive motor, which is mechanically independent of the drive of the other inking unit cylinders 519; 531 and/or printing unit cylinders 501; 503.

During the production of a security element 001, in particular an aforementioned security element 001 comprising two differently colored, adjacent image elements 002; 003; 004; 006; 007; 009; 011; 012, substrate S; S' is fed to a gravure printing unit 500 operating according to an intaglio printing method and is printed at a printing nip 502 by a forme cylinder 503, wherein the forme cylinder 503, on its circumference, has an image-producing pattern of recesses 514, of which, in a first embodiment, a portion of first recesses 514 is inked by an inking unit 508 with intaglio printing ink 517 of a first color c1, and by which the substrate S; S' is provided with raised first image elements 002; 008, when passing through the printing nip 502, which contain intaglio printing ink 517 of the first color c1 in the area of the upper side. On the forme cylinder 503, first recesses 514, e.g., of a first depth x, are inked, which in the region of their smallest diameter, for example, have a width b; b' of no more than 1,000 μm.

In an advantageous embodiment, first recesses 514 of this type on the forme cylinder 503 are inked with the first printing ink 517 indirectly or directly by way of an inking unit cylinder 519 configured as a relief inking cylinder 519, which, on its circumference, comprises elevations 524; 524' that correspond to individual first recesses 514 of this type on the forme cylinder 503 and/or elevations 524; 524' which have a width b513 that is greater by no more than 0.5 mm than the width b514 of the corresponding first recesses 514 on the forme cylinder 503 and/or which match individual first recesses 514 on the forme cylinder 503 having a width b513 that is greater by no more than a factor of ten and/or which individually match recesses 514 on the forme cylinder 503 that are spaced 1,000 μm apart and/or which comprises, on its outer cylindrical surface 521, regions including at least five non-contiguous elevations 524; 524' over a surface area of no more than 10 $cm^2$ and/or including two or more non-contiguous elevations 524; 524', which are in each case spaced no more than 2,000 μm apart from respective adjacent elevations 524; 524'.

Preferably, individual first elevations 524; 524' on the first relief inking cylinder 519 are selectively inked by ink-carrying recesses 513 on the circumference of an inking unit cylinder 512 configured as a gravure inking cylinder 512, which likewise correspond to the first recesses 514 on the forme cylinder 503 that correspond to the relevant elevations 524; 524'. Individual first recesses 514 on the forme cylinder 504 are preferably selectively inked by way of corresponding elevations 524; 524' on the first relief inking cylinder 519.

In this first advantageous embodiment, adjacent second recesses 514 on the forme cylinder 503 that are spaced no more than 1,000 μm apart from first recesses 514 are provided, which in the region of their smallest diameter have a width b; b' of no more than 1,000 μm, wherein, in a first variant, these are not inked and provide the substrate S; S', when passing through the inking nip 502, with raised second image elements 011; 012, without applying intaglio printing ink thereto.

In a second variant, such adjacent second recesses 514 on the forme cylinder 503 are indirectly or directly inked via a second relief inking cylinder 519 with intaglio printing ink 517 of a second color c2 by way of elevations 524; 524' that are provided on the circumference of the second gravure inking cylinder 519. These provide the substrate S; S', when passing through the printing nip 502, with raised second image elements 003; 009 that are adjacent to the first raised image elements 002; 008.

The second recesses 514 are also inked by way of elevations 524; 524' that correspond to individual second recesses 514 on the forme cylinder 503 and/or by way of elevations 524; 524' as they have been characterized above for the first relief inking cylinder 519.

In an advantageous embodiment, individual elevations 524; 524' on the second relief inking cylinder 519 can be selectively inked by ink-carrying recesses 513 on the circumference of a second gravure inking cylinder 512, which likewise correspond to the second recesses 514 on the forme cylinder 503 that correspond to the relevant elevations 524; 524'.

Advantageously, individual second recesses 514 on the forme cylinder 503 can be selectively inked by way of corresponding elevations 524; 524' on the second relief inking cylinder 519.

During the production of another security element 001, in particular an aforementioned security element 001, substrate S; S' is fed to a gravure printing unit 500 operating according to an intaglio printing method and is printed at a printing nip 502 by a forme cylinder 503, wherein the forme cylinder 503, on its circumference, has an image-producing pattern of recesses 514, of which at least one first recess 514 of a first depth x and a second recess 514 of a second depth x' are inked by an inking unit 508 with intaglio printing ink 517 of a first color c1, and which provide the substrate S; S', when passing through the printing nip 502, with a first and a second raised image element 002; 003; 004; 006; 007; 008; 009, which contains intaglio printing ink 517 of the first color c1 in the area of the respective upper side. The first and second recesses 514 are provided on the circumference of the forme cylinder 503 spaced no more than 1,000 μm apart from one another and at a depth x; x' that is different by at least 5 μm, wherein they receive the intaglio printing ink 517 in each case indirectly via respective ink-carrying recesses ink-carrying 513 of a gravure inking cylinder 512 provided in the inking unit 508, which in each case correspond to the first and second recesses 514 on the forme cylinder 503.

The at least one first recess 514 on the forme cylinder 503 is advantageously provided adjacent to the second and a third recess 514 at a respective distance d; d' of no more than 1,000 μm, wherein all three recesses 514 receive the intaglio printing ink 517 indirectly by way of respective corresponding recesses 513 on the gravure inking cylinder 512 (see, e.g., security feature F1 from FIG. 9).

The recesses 514 on the forme cylinder 503 advantageously receive the respective intaglio printing ink 517 from the gravure inking cylinder 512 via a relief inking cylinder 519, which, on its circumference, includes elevations 524; 524' that correspond to the relevant recesses 514 on the forme cylinder 503.

The recesses 513 on the gravure inking cylinder 519 that correspond to recesses 514 of different depths x; x' on the forme cylinder 503 preferably have a depth that differs, in particular is greater, by at least 5 μm.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A security element comprising:

a substrate that includes at least one security feature extending over a portion of the substrate, the at least one security feature being configured as, or at least including, a three-dimensional (3D) intaglio structure, the 3D intaglio structure comprising first raised image elements that, at least in an area of an upper side of the first raised image elements, contain intaglio printing ink of a first color, at least one of the first raised image elements being situated adjacent to at least one second raised image element included in the 3D intaglio structure, the at least one second raised image element containing intaglio printing ink of a second color that differs from the first color, characterized in that a first group, which is included in the at least one security feature and which comprises a plurality of the first raised image elements containing the intaglio printing ink of the first color, and a second group, which is included in the security feature and which comprises a plurality of the second raised image elements containing the intaglio printing ink of the second color, are arranged so that the first raised image elements of the first group and the second raised image elements of the second group are offset and spaced apart from one another to form an optically variable structure, and that at least some mutually adjacent first raised image elements and second raised image elements, which differ from one another in color, occlude and/or expose one another to varying degrees from a varying viewing angle, wherein several of the groups of at least the first raised image elements and the second raised image elements that differ in color are arranged with respect to one another and configured with different and/or varying heights so as to provide image components that are situated at lower and higher levels, which, depending on a variation of the viewing angle in relation to a surface of the security element and/or depending on a variation of a viewing direction about an axis that is perpendicular to the at least one security feature at an observed location, convey changing image information and/or different optical sensory impressions and/or perceptions.

2. The security element according to claim 1, characterized in that a plurality of the first and second raised image elements that differ in color and/or in an ink film thickness form a multicolor intaglio pattern, in which individual first raised image elements are surrounded on multiple sides by the second raised image elements and/or third raised image elements of at least one further color so that, from at least one viewing direction and/or from at least one viewing angle, a multicolor intaglio print image having a distance between raised image elements of different colors of 1,000 μm or less, at least in some areas, is present and/or perceptible.

3. The security element according to claim 1, characterized in that the first and second groups include alternating first and second raised image elements, and that a ratio between the heights of respective adjacent first and second raised image elements varies across the alternating first and second raised image elements.

4. The security element according to claim 3, characterized in that the heights of the raised image elements of one of the groups that include one of the alternating first and second raised image elements varies across that group, while the heights of the raised image elements in the other group that includes the other of the alternating first and second raised image elements varies differently or is constant.

5. The security element according to claim 1, characterized in that the mutually adjacent first and second raised image elements of the first and second groups, respectively, are separated from one another by a trough and have a distance of no more than 1,000 μm from one another and/or a distance that corresponds to no more than ten times a maximum elevation of a higher one of a pair of first and second raised image elements that are adjacent to one another, and/or that the first group of the first raised image elements comprises at least ten of the first raised image elements, and the second group of the second raised image elements comprises at least nine of the second raised image elements, and/or that the first and second raised image elements are arranged so as to alternate, and/or are linearly configured, and/or extend parallel to one another.

6. The security element according to claim 1, wherein the security element is incorporated into a security document that includes a security document substrate which forms a basis of the security document, wherein:

the substrate that includes the at least one security feature is included in the security document substrate, or the substrate that includes the at least one security feature comprises a carrier substrate, which is integrally bonded to the security document substrate.

7. The security element according to claim 1, characterized in that at least some of the first raised image elements of the first group and the second raised image elements of the second group are configured with heights that differ among respective groups and/or vary within at least one group and/or vary over an extension of first and/or second raised image elements and, viewed along a functional direction, are arranged in a pattern in a sequence and spaced apart from one another, such that, when a viewing angle is varied in a plane that is spanned by a functional direction and an axis that is perpendicular to the at least one security feature at an observed location, at least the first and/or second raised image elements convey a color effect and/or a color gradient and/or a color shade gradient that changes with the viewing angle.

8. The security element according to claim 1, characterized in that at least some of the first raised image elements of the first group and the second raised image elements of the at least one second group are linear and are configured with heights that differ among respective groups and/or vary within at least one group and/or vary over an extension of first and/or second raised image elements and, viewed along a functional direction, are arranged in a pattern in a sequence and spaced apart from one another, such that, when a viewing angle is varied in a plane that is spanned by a functional direction and an axis that is perpendicular to the at least one security feature at an observed location, at least the linear first raised image elements and/or linear second raised image elements convey a color effect and/or a color gradient and/or a color shade gradient that changes with the viewing angle.

9. The security element according to claim 8, characterized in that first raised image elements of the first group that are linear and of the first color have an ink film thickness and/or height that varies in a sequentially increasing or decreasing manner or continuously across a longitudinal extension thereof.

10. The security element according to claim 9, characterized in that the second raised image elements of the second group that are linear are individually disposed between first raised image elements that at least one of: (i) vary in ink film thickness and/or height, (ii) all have a same height and/or ink film thickness or (iii) have a height that varies across the second group and/or varies in a sequentially increasing or decreasing manner or continuously across a longitudinal extension thereof.

11. The security element according to claim 9, characterized in that a maximum of the height varies across the first group of first raised image elements.

12. A method for producing a security element that includes a plurality of first raised image elements containing intaglio printing ink of a first color, and a plurality of second raised image elements containing intaglio printing ink of a second color that is different from the first color, the first raised image elements and the second raised image elements being arranged on a substrate offset and spaced apart from one another to form an optically variable structure, wherein at least some of the first raised image elements and second raised image elements that are mutually adjacent occlude and/or expose one another to varying degrees from a varying viewing angle, the security element being produced on the substrate by being fed to a gravure printing unit operating according to an intaglio printing method and being printed at a printing nip by a forme cylinder, the forme cylinder, on a circumference thereof, having an image-producing pattern of recesses, of which some first recesses are inked by an inking unit with the intaglio printing ink of the first color, and by which the substrate, when passing through the printing nip, is provided with the first raised image elements, which contain the intaglio printing ink of the first color in an area of an upper side of the first raised image elements, characterized in that on the forme cylinder first recesses are inked, which in a region of a smallest diameter thereof have a width of no more than 1,000 μm, and that the first recesses on the forme cylinder are inked with the first printing ink indirectly or directly by way of an inking unit cylinder configured as a first relief inking cylinder, which, on a circumference thereof, comprises elevations which correspond to individual ones of the first recesses on the forme cylinder and/or two or more non-contiguous elevations, which are individually spaced no more than 2,000 μm apart from respective adjacent elevations, the individual first recesses on the forme cylinder being selectively inked by way of corresponding elevations on the first relief inking cylinder, and that adjacent second recesses on the forme cylinder, which are spaced no more than 1,000 μm apart from the first recesses, are indirectly or directly inked via a second relief inking cylinder with the intaglio printing ink of the second color by way of second elevations that are provided on a circumference of the second relief inking cylinder, and which provide the substrate, when passing through the print nip, with the second raised image elements that are adjacent to the first raised image elements, with the second recesses being inked by way of elevations on the second relief inking cylinder that correspond to individual second recesses on the forme cylinder.

13. The method according to claim 12, characterized in that individual ones of the first elevations on the first relief inking cylinder are selectively inked by ink-carrying recesses on a circumference of an inking unit cylinder configured as a first gravure inking cylinder, and which correspond to the first recesses on the forme cylinder that correspond to the corresponding elevations on the first relief inking cylinder, and/or that individual ones of the elevations on the second relief inking cylinder are selectively inked by ink-carrying recesses on a circumference of a second gravure inking cylinder, and which correspond to the second recesses on the forme cylinder that correspond to the corresponding elevations on the second relief inking cylinder.

14. A device for producing a security element that includes a plurality of first raised image elements containing intaglio printing ink of a first color, and a plurality of second raised image elements containing intaglio printing ink of a second color that is different from the first color, the first raised image elements and the second raised image elements being arranged on a substrate offset and spaced apart from one another to form an optically variable structure, wherein at least some of the first raised image elements and second raised image elements that are mutually adjacent occlude and/or expose one another to varying degrees from a varying viewing angle, the device comprising a gravure printing unit operating according to an intaglio printing method to which, on an input side, receives the substrate that is unprinted or already printed according to another printing method and upon which the security element is printed at a printing nip by a forme cylinder, the forme cylinder, on a circumference thereof, having an image-producing pattern of recesses, of which some first recesses can be inked by an inking unit with a first intaglio printing ink, and by which the substrate is provided with the first raised image elements having an upper side to which the intaglio printing ink of the first color is applied, with the gravure printing unit comprising an inking unit cylinder configured as a first relief inking cylinder, via which first recesses on the forme cylinder can be indirectly or directly inked with the first intaglio printing ink, characterized in that on the forme cylinder the first recesses in a region of a smallest diameter thereof have a width of no more than 1,000 μm, and that the first relief inking cylinder, on a circumference thereof, comprises elevations that correspond to individual ones of the first recesses on the forme cylinder and/or two or more non-contiguous elevations, which are individually spaced no more than 2,000 μm apart from respective adjacent elevations, the individual first recesses on the forme cylinder being selectively inkable by way of corresponding elevations on the first relief inking cylinder, and that adjacent second recesses that are spaced no more than 1,000 μm apart from the first recesses are provided on the forme cylinder, which in a region of a smallest diameter thereof have a width of no more than 1,000 μm and can be inked by the inking unit with the second intaglio printing ink that differs from the first intaglio printing ink, and that elevations that correspond to individual ones of the second recesses on the forme cylinder are provided for inking the second recesses on a second relief inking cylinder.

15. The device according to claim 14, characterized in that an inking unit cylinder configured as a gravure inking cylinder is provided, which comprises ink-carrying recesses on a circumference thereof, and which correspond to the first recesses on the forme cylinder that correspond to the elevations on the first relief inking cylinder, and by which individual ones of the elevations on the first relief inking cylinder can be selectively inked.

16. The device according to claim 15, characterized in that recesses that correspond to the first and/or second recesses on the forme cylinder are provided on the gravure inking cylinder, and a width of the recesses provided on the gravure inking cylinder is greater by at least 40 μm and/or no more than 400 μm than that of corresponding recesses on the forme cylinder.

17. The device according to claim 14, characterized in that the first relief inking cylinder includes the elevations which have a width that is greater by no more than 0.5 mm than a width of the corresponding first recesses on the forme cylinder and/or which match individual first recesses on the forme cylinder having a width that is greater by no more than a factor of ten and/or which individually match recesses on the forme cylinder that are spaced no more than 1,000 μm apart, and/or which comprises, on an outer cylindrical surface thereof, regions including at least five non-contiguous elevations over a surface area of no more than 10 $cm^2$, and/or that a second gravure inking cylinder is provided with ink-carrying recesses on a circumference thereof, which comprises recesses that correspond to the second recesses on the forme cylinder and which can be inked by the elevations on the second relief inking cylinder that correspond to the second recesses on the forme cylinder, and/or that the elevations that are provided on the second relief inking cylinder for inking the second recesses have a width that is greater by no more than 0.5 mm than a width of the corresponding second recesses on the forme cylinder and/or which match individual second recesses on the forme cylinder having a width that is greater by no more than a factor of ten and/or which individually match the second recesses on the forme cylinder that are spaced no more than 1,000 μm apart, and/or which comprises, on an outer cylindrical surface thereof, regions including at least five non-contiguous elevations over a surface area of no more than 10 $cm^2$ and/or including two or more non-contiguous elevations, which are in each case spaced no more than 2,000 μm apart from respective adjacent elevations.

* * * * *